US009982444B2

(12) United States Patent
Richardson et al.

(10) Patent No.: US 9,982,444 B2
(45) Date of Patent: May 29, 2018

(54) LIQUID AND GAS-IMPERMEABLE CONNECTIONS FOR PANELS OF STAY-IN-PLACE FORM-WORK SYSTEMS

(71) Applicant: CFS Concrete Forming Systems Inc., Vancouver (CA)

(72) Inventors: George David Richardson, Vancouver (CA); Semion Krivulin, Richmond (CA)

(73) Assignee: CFS Concrete Forming Systems Inc., Vancouver, British Columbia (CA)

( * ) Notice: Subject to any disclaimer, the term of this patent is extended or adjusted under 35 U.S.C. 154(b) by 0 days. days.

(21) Appl. No.: 15/129,414

(22) PCT Filed: Apr. 2, 2015

(86) PCT No.: PCT/CA2015/050276

§ 371 (c)(1),
(2) Date: Sep. 26, 2016

(87) PCT Pub. No.: WO2015/149187

PCT Pub. Date: Oct. 8, 2015

(65) Prior Publication Data

US 2017/0175407 A1 Jun. 22, 2017

Related U.S. Application Data

(60) Provisional application No. 61/975,725, filed on Apr. 4, 2014.

(51) Int. Cl.

| | |
|---|---|
| ***E04G 17/00*** | (2006.01) |
| ***E04B 1/61*** | (2006.01) |
| ***E04B 2/86*** | (2006.01) |

(52) U.S. Cl.

CPC ..... *E04G 17/001* (2013.01); *E04B 1/6116* (2013.01); *E04B 2/8611* (2013.01);
(Continued)

(58) Field of Classification Search

USPC ..... 52/415, 422, 424.426, 428, 429, 434, 52/435, 439, 489.1, 563

See application file for complete search history.

(56) References Cited

U.S. PATENT DOCUMENTS

| | | | |
|---|---|---|---|
| 154,179 | A | 8/1874 | Hubert |
| 374,826 | A | 12/1887 | Clarke |

(Continued)

FOREIGN PATENT DOCUMENTS

| | | |
|---|---|---|
| CA | 0574720 | 4/1959 |
| CA | 0957816 | 11/1974 |

(Continued)

OTHER PUBLICATIONS

Vector Corrosion Technologies Marketing Materials, 2005.

(Continued)

*Primary Examiner* — Brian E Glessner
*Assistant Examiner* — Adam G Barlow
(74) *Attorney, Agent, or Firm* — Todd A. Rattray; Oyen Wiggs Green & Mutala LLP

(57) ABSTRACT

A stay-in-place form comprises a plurality of elongated panels connectable to one another in edge-to-edge relationship. The plurality of panels comprises first and second panels connectable to one another in edge-adjacent relationship by a connection which comprises a contact joint. The first panel comprise a longitudinally extending first seal-retaining projection shaped to project outwardly from the outer surface of the first panel at a location spaced apart from a first outer-surface transverse edge of the first panel in a first transverse direction. The second panel comprising a longitudinally extending second seal-retaining projection shaped to project outwardly from the outer surface of the second panel at a location spaced apart from a second outer-surface transverse edge of the second panel in a second transverse
(Continued)

direction opposite the first transverse direction. The first and second seal-retaining projections and the outer surfaces of the first and second panels defining at least a portion of a seal-receiving concavity which opens outwardly from the form when the connection is made.

33 Claims, 30 Drawing Sheets

(52) U.S. Cl.
CPC ..... *E04B 2/8641* (2013.01); *E04B 2/8652* (2013.01); *E04G 17/005* (2013.01); *E04B 2002/867* (2013.01); *E04B 2002/8676* (2013.01)

(56) References Cited

U.S. PATENT DOCUMENTS 510,720 A 12/1893 Stewart, Jr.
820,246 A 5/1906 Nidds
999,334 A 8/1911 Pearson
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,063,122 A 11/1962 Katz
3,100,677 A 8/1963 Frank et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,321,884 A 5/1967 Klaue
3,468,088 A 9/1969 Miller
3,545,152 A 12/1970 Knohl
3,555,751 A 1/1971 Thorgusen
3,588,027 A 6/1971 Bowden
3,682,434 A 8/1972 Boenig
3,769,769 A 11/1973 Kohl
3,788,020 A 1/1974 Gregori
3,822,557 A 7/1974 Frederick
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,114,388 A 9/1978 Straub
4,180,956 A 1/1980 Gross
4,182,087 A 1/1980 Schall et al.
4,193,243 A 3/1980 Tiner
4,276,730 A 7/1981 Lewis
4,299,070 A 10/1981 Ottmanns et al.
4,332,119 A 6/1982 Toews
4,351,870 A 9/1982 English
4,383,674 A 5/1983 Fricker
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,664,560 A 5/1987 Cortlever
4,695,033 A 9/1987 Imaeda et al.
4,703,602 A 11/1987 Pardo
4,731,964 A 3/1988 Phillips
4,731,971 A 5/1988 Terkl
4,742,665 A 5/1988 Baierl
4,808,039 A 2/1989 Fischer
4,856,754 A 8/1989 Yokota et al.
4,866,891 A 9/1989 Young
4,930,282 A 6/1990 Meadows
4,946,056 A 8/1990 Stannard
4,995,191 A 2/1991 Davis
5,014,480 A 5/1991 Guarriello et al.
5,028,368 A 7/1991 Grau
5,058,855 A 10/1991 Ward
5,078,360 A 1/1992 Spera
5,106,233 A 4/1992 Breaux
5,124,102 A 6/1992 Serafini
5,187,843 A 2/1993 Lynch
5,216,863 A 6/1993 Nessa et al.
5,243,805 A 9/1993 Fricker
5,247,773 A 9/1993 Weir
5,265,750 A * 11/1993 Whiteley ..... F16J 10/00 220/4.26
5,292,208 A 3/1994 Berger
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A * 9/1996 Majnaric ..... E01D 11/00 52/236.8
5,591,265 A 1/1997 Tusch
5,608,999 A * 3/1997 McNamara ..... E04B 1/12 52/220.1
5,625,989 A 5/1997 Brubaker et al.
5,714,045 A 2/1998 Lasa et al.
5,729,944 A 3/1998 De Zen
5,735,097 A * 4/1998 Cheyne ..... B63B 5/06 114/263
5,740,648 A * 4/1998 Piccone ..... E04B 2/86 249/191
5,747,134 A 5/1998 Mohammed et al.
5,791,103 A 8/1998 Coolman
5,824,347 A 10/1998 Serafini
5,860,262 A 1/1999 Johnson
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.

(56) References Cited

U.S. PATENT DOCUMENTS

| | | | | |
|---|---|---|---|---|
| 6,185,884 | B1 | 2/2001 | Myers et al. | |
| 6,189,269 | B1 | 2/2001 | De Zen | |
| 6,212,845 | B1 | 4/2001 | De Zen | |
| 6,219,984 | B1 | 4/2001 | Piccone | |
| 6,220,779 | B1 | 4/2001 | Warner et al. | |
| 6,247,280 | B1 | 6/2001 | Grinshpun et al. | |
| 6,286,281 | B1 | 9/2001 | Johnson | |
| 6,293,067 | B1 | 9/2001 | Meendering et al. | |
| 6,357,196 | B1 | 3/2002 | McCombs | |
| 6,387,309 | B1 | 5/2002 | Kojima | |
| 6,405,508 | B1 | 6/2002 | Janesky | |
| 6,435,470 | B1 | 8/2002 | Lahham et al. | |
| 6,435,471 | B1 * | 8/2002 | Piccone | E04B 2/8641 249/191 |
| 6,438,918 | B2 | 8/2002 | Moore et al. | |
| 6,467,136 | B1 | 10/2002 | Graham | |
| 6,530,185 | B1 | 3/2003 | Scott et al. | |
| 6,550,194 | B2 | 4/2003 | Jackson et al. | |
| 6,588,165 | B1 | 7/2003 | Wright | |
| 6,622,452 | B2 | 9/2003 | Alvaro | |
| 6,691,976 | B2 | 2/2004 | Myers et al. | |
| 6,694,692 | B2 | 2/2004 | Piccone | |
| 6,832,456 | B1 | 12/2004 | Bilowol | |
| 6,866,445 | B2 | 3/2005 | Semler | |
| 6,935,081 | B2 | 8/2005 | Dunn et al. | |
| 7,320,201 | B2 | 1/2008 | Kitchen et al. | |
| 7,444,788 | B2 | 11/2008 | Morin et al. | |
| 7,818,936 | B2 | 10/2010 | Morin et al. | |
| 8,074,418 | B2 | 12/2011 | Thiagarajan et al. | |
| 8,322,115 | B2 * | 12/2012 | Foell | E04B 2/8629 52/309.17 |
| 8,485,493 | B2 | 7/2013 | Wells et al. | |
| 8,707,648 | B2 | 4/2014 | Timko et al. | |
| 8,769,904 | B1 | 7/2014 | Brandt et al. | |
| 8,793,953 | B2 * | 8/2014 | Richardson | E04B 1/6116 52/422 |
| 8,806,839 | B2 | 8/2014 | Zhou | |
| 8,881,483 | B2 | 11/2014 | Caboni | |
| 8,959,871 | B2 | 2/2015 | Parenti et al. | |
| 9,441,365 | B2 * | 9/2016 | Richardson | E04B 2/8652 |
| 9,850,658 | B2 * | 12/2017 | Alcala Ordaz | E04B 2/8635 |
| 2003/0005659 | A1 | 1/2003 | Moore, Jr. | |
| 2003/0009967 | A1 * | 1/2003 | Piccone | E04B 1/12 52/426 |
| 2003/0085482 | A1 | 5/2003 | Sincock et al. | |
| 2003/0155683 | A1 | 8/2003 | Pietrobon | |
| 2004/0010994 | A1 | 1/2004 | Piccone | |
| 2004/0020149 | A1 | 2/2004 | Messiqua | |
| 2004/0093817 | A1 | 5/2004 | Pujol Barcons | |
| 2004/0216408 | A1 | 11/2004 | Hohmann, Jr. | |
| 2005/0016083 | A1 * | 1/2005 | Morin | E04B 2/8641 52/79.14 |
| 2005/0016103 | A1 * | 1/2005 | Piccone | E04B 2/8641 52/481.1 |
| 2006/0032172 | A1 * | 2/2006 | Foell | E04B 2/8629 52/426 |
| 2006/0179762 | A1 | 8/2006 | Thome et al. | |
| 2006/0185270 | A1 | 8/2006 | Handley et al. | |
| 2006/0213140 | A1 | 9/2006 | Morin et al. | |
| 2007/0028544 | A1 | 2/2007 | Messiqua et al. | |
| 2007/0107341 | A1 | 5/2007 | Zhu | |
| 2007/0193169 | A1 | 8/2007 | Emblin | |
| 2008/0168734 | A1 | 7/2008 | Degen et al. | |
| 2009/0120027 | A1 | 5/2009 | Amend | |
| 2009/0229214 | A1 | 8/2009 | Nelson | |
| 2009/0269130 | A1 | 10/2009 | Williams | |
| 2010/0047608 | A1 | 2/2010 | Seccombe | |
| 2010/0050552 | A1 | 3/2010 | David | |
| 2010/0071304 | A1 | 3/2010 | Richardson et al. | |
| 2010/0251657 | A1 * | 10/2010 | Richardson | E04B 2/8641 52/588.1 |
| 2010/0325984 | A1 | 12/2010 | Richardson et al. | |
| 2011/0000161 | A1 | 1/2011 | Aube | |
| 2011/0099932 | A1 | 5/2011 | Saulce | |
| 2011/0131914 | A1 | 6/2011 | Richardson et al. | |
| 2011/0277410 | A1 | 11/2011 | Richardson | |
| 2012/0056344 | A1 | 3/2012 | Richardson et al. | |
| 2013/0081345 | A1 | 4/2013 | Sheehy | |
| 2016/0289960 | A1 * | 10/2016 | Darwell | E04B 1/6137 |

FOREIGN PATENT DOCUMENTS

| | | |
|---|---|---|
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2716118 | 8/2008 |
| CA | 2681963 | 10/2008 |
| CA | 2751134 | 12/2011 |
| CA | 2855742 | 5/2013 |
| CH | 317758 | 1/1957 |
| CH | 669235 | 2/1989 |
| CN | 2529936 | 1/2003 |
| DE | 1684357 | 4/1967 |
| DE | 1812590 | 6/1970 |
| DE | 2062723 | 8/1972 |
| DE | 3003446 | 8/1981 |
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0179046 | 4/1986 |
| EP | 0757137 | 2/1997 |
| EP | 2169133 | 3/2010 |
| FR | 0507787 | 7/1920 |
| FR | 1381945 | 11/1964 |
| FR | 1603005 | 4/1971 |
| FR | 2364314 | 4/1978 |
| FR | 2535417 | 5/1984 |
| FR | 2721054 | 6/1994 |
| FR | 2717848 | 9/1995 |
| FR | 2669364 | 3/2012 |
| GB | 137221 | 1/1920 |
| GB | 779916 | 7/1957 |
| GB | 1243173 | 8/1971 |
| GB | 1253447 | 11/1971 |
| GB | 2141661 | 1/1985 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2005040526 | 5/2005 |
| WO | 2008000608 | 1/2008 |
| WO | 08119178 | 10/2008 |
| WO | 09059410 | 5/2009 |
| WO | 09092158 | 7/2009 |
| WO | 2010012061 | 2/2010 |
| WO | 2010037211 | 4/2010 |

(56) References Cited

FOREIGN PATENT DOCUMENTS

| | | |
|---|---|---|
| WO | 2010078645 | 7/2010 |
| WO | 2010094111 | 8/2010 |
| WO | 2013075251 | 5/2013 |
| WO | 2013102274 | 7/2013 |
| WO | 2013188980 | 12/2013 |

OTHER PUBLICATIONS

Vector Corrosion Technologies Marketing Materials, 2007.
Vector Corrosion Technologies Marketing Materials, 2008.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.
The Digigraph System, http://www.digigraph-housing.com/web/system.ht, accessed online Jan. 2012.

* cited by examiner

LIQUID AND GAS-IMPERMEABLE CONNECTIONS FOR PANELS OF STAY-IN-PLACE FORM-WORK SYSTEMS

RELATED APPLICATIONS

This Applicant claims the benefit of the priority of U.S. application No. 61/975,725 (filed 4 Apr. 2014) which is hereby incorporated herein by reference.

TECHNICAL FIELD

This invention relates to stay-in-place form-work systems for fabricating structural parts for buildings, tanks and/or other structures out of concrete or other similar curable construction materials. Particular embodiments provide fluid (i.e. liquid and gas)-impermeable connections between modular form-work units (e.g. panels).

BACKGROUND

It is known to fabricate structural parts for buildings, tanks or the like from concrete using modular stay-in-place forms (also known as "form-works"). Such structural parts may include walls, ceilings or the like. Examples of such modular stay in place forms include those described US patent publication No. 2005/0016103 (Piccone) and PCT publication No. WO96/07799 (Sterling). A representative drawing depicting a partial form 28 according to one prior art system is shown in top plan view in FIG. 1. Form 28 includes a plurality of wall panels 30 (e.g. 30A, 30B, 30D), each of which has an inwardly facing surface 31A and an outwardly facing surface 31B. Each of panels 30 includes a terminal male T-connector component 34 at one of its transverse, vertically-extending edges (vertical being the direction into and out of the FIG. 1 page) and a terminal female C-connector component 32 at its opposing vertical edge. Male T-connector components 34 slide vertically into the receptacles of female C-connector components 32 to join edge-adjacent panels 30 to form a pair of substantially parallel wall segments (generally indicated at 27, 29). Depending on the needs for particular wall segments 27, 29, different panels 30 may have different transverse dimensions. For example, comparing panels 30A and 30B, it can be seen that panel 30A has approximately ¼ of the transverse length of panel 30B.

Form 28 includes support panels 36 which extend between, and connect to each of, wall segments 27, 29 at transversely spaced apart locations. Support panels 36 include male T-connector components 42 slidably received in the receptacles of female C-connector components 38 which extend inwardly from inwardly facing surfaces 31A or from female C-connector components 32. Form 28 incorporates tensioning panels 40 which extend between panels 30 and support panels 36 at various locations within form 28. Tensioning panels 40 include male T-connector components 46 received in the receptacles of female C-connector components 38.

In use, form 28 is assembled by slidable connection of the various male T-connector components 34, 42, 46 in the receptacles of the various female C-connectors 32, 38. Liquid concrete is then poured into form 28 between wall segments 27, 29. The concrete flows through apertures (not shown) in support panels 36 and tensioning panels 40 to fill the inward portion of form 28 (i.e. between wall segments 27, 29). When the concrete solidifies, the concrete (together with form 28) may provide a structural component (e.g. a wall) for a building or other structure.

One well-known problem with prior art systems is referred to colloquially as "unzipping". Unzipping may refer to the partial or complete separation of connector components from one another due to the weight and/or outward pressure generated by liquid concrete when it is poured into form 28. By way of example, unzipping may occur at connector components 32, 34 between panels 30. FIG. 2 schematically depicts the unzipping of a prior art connection 50 between male T-connector component 34 and corresponding female C-connector component 32 at the edges of a pair of edge-adjacent panels 30. The concrete (not explicitly shown) on the inside 51 of connection 50 exerts outward forces on panels 50 (as shown at arrows 52, 54). These outward forces tend to cause deformation of the connector components 32, 34. In the FIG. 2 example illustration, connector components 32, 34 exhibit deformation in the region of reference numerals 56, 58, 60, 62, 64, 68. This deformation of connector components 32, 34 may be referred to as unzipping.

Unzipping of connector components can lead to a number of associated problems. In addition to the unattractive appearance of unzipped connector components, unzipping can lead to separation of male connector components 34 from female connector components 32. To counteract this problem, prior art systems typically incorporate support panels 36 and tensioning panels 40, as described above. However, support panels 36 and tensioning panels 40 represent a relatively large amount of material (typically plastic) which can increase the overall cost of form 28. Furthermore, support panels 36 and tensioning panels do not completely eliminate the unzipping problem. Notwithstanding the presence of support panels 36 and tensioning panels 40, in cases where male connector components 34 do not separate completely from female connector components 32, unzipping of connector components 32, 34 may still lead to the formation of small spaces (e.g. spaces 70) or the like between connector components 32, 34. Such spaces can be difficult to clean and can represent regions for the proliferation of bacteria or other contaminants and can thereby prevent or discourage the use of form 28 for particular applications, such as those associated with food storage or handling or other applications for which sanitary conditions or the like are desirable. Such spaces can also permit the leakage of fluids (e.g. liquids and/or gasses) between the inside 51 and outside 53 of panels 30 (e.g. between panels 30 and the concrete lined by panels 30). In some cases, fluids can leak through the concrete contained in the form and through the panels on the opposing side of the structure. Fluid leakage can prevent or discourage the use of form 28 for applications where it is desirable that form 28 be impermeable to liquid and/or gas. Such leakage can also lead to unsanitary conditions on the inside of form 28. The leakage of fluids to spaces between panels 30 and the concrete lined by panels 30 can cause panels 30 to separate further from the concrete they contain, exacerbating other issues, such as the cleanliness, sanitariness, or fluid impermeability of the form-work and/or the resulting structure.

There is a general desire to provide modular form components and connections therefor which overcome or at least ameliorate some of the drawbacks with the prior art.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 2:
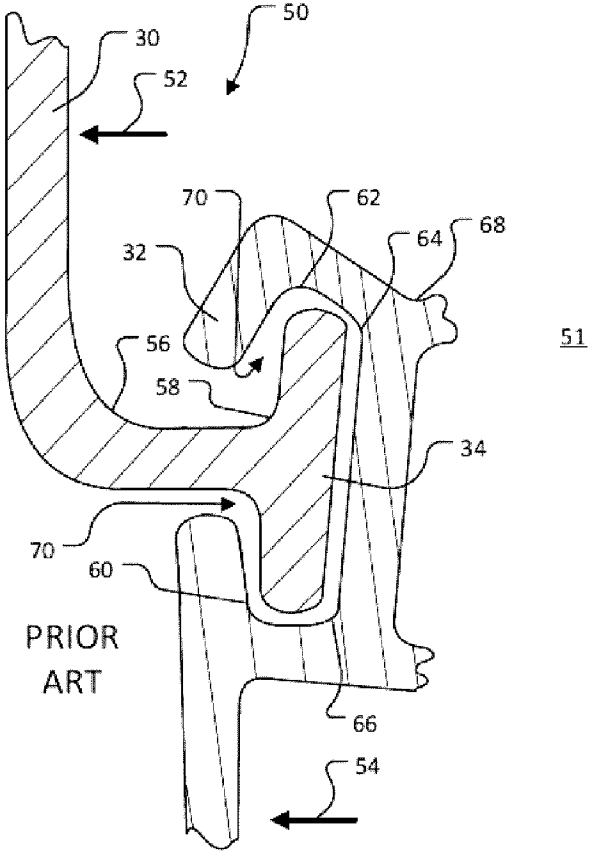
FIG. 2 is a magnified partial plan view of the FIG. 1 prior art form, showing the unzipping of a connection between wall panels.
Figure 1:
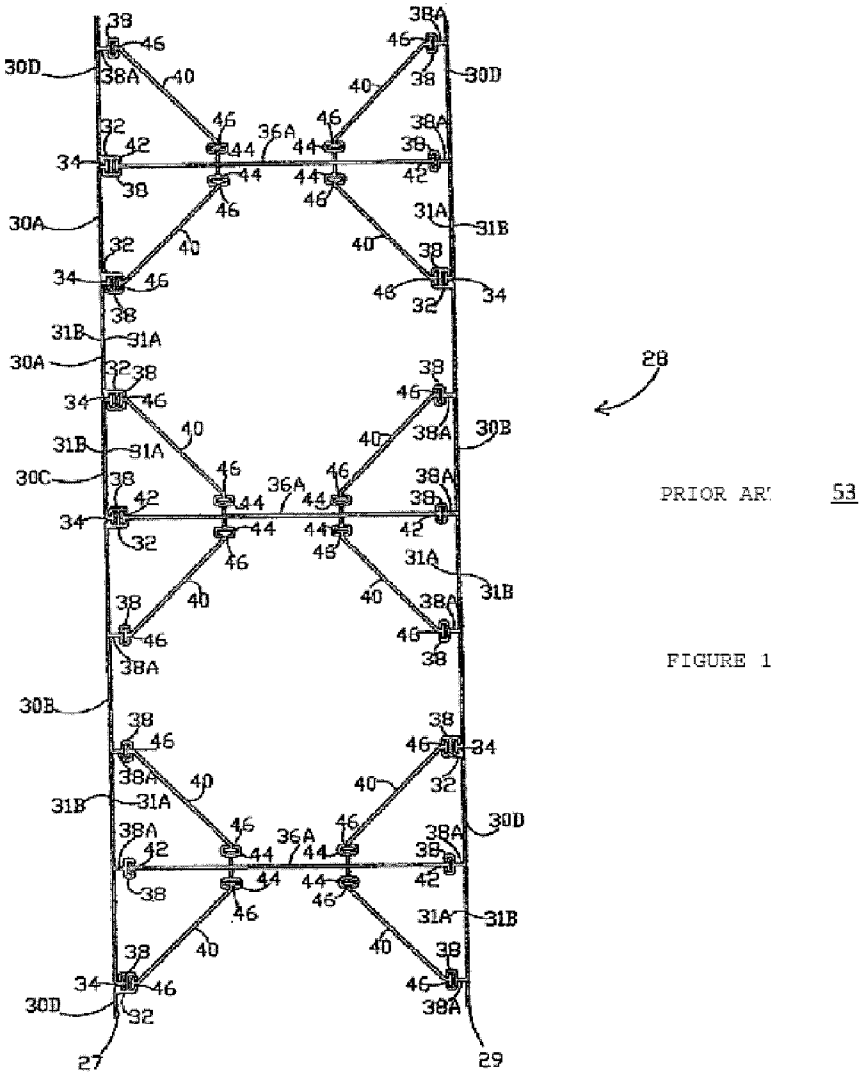
PRIOR ART FIGURE 1
FIG. 1 is a top plan view of a prior art modular stay-in-place form.
Figure 3:
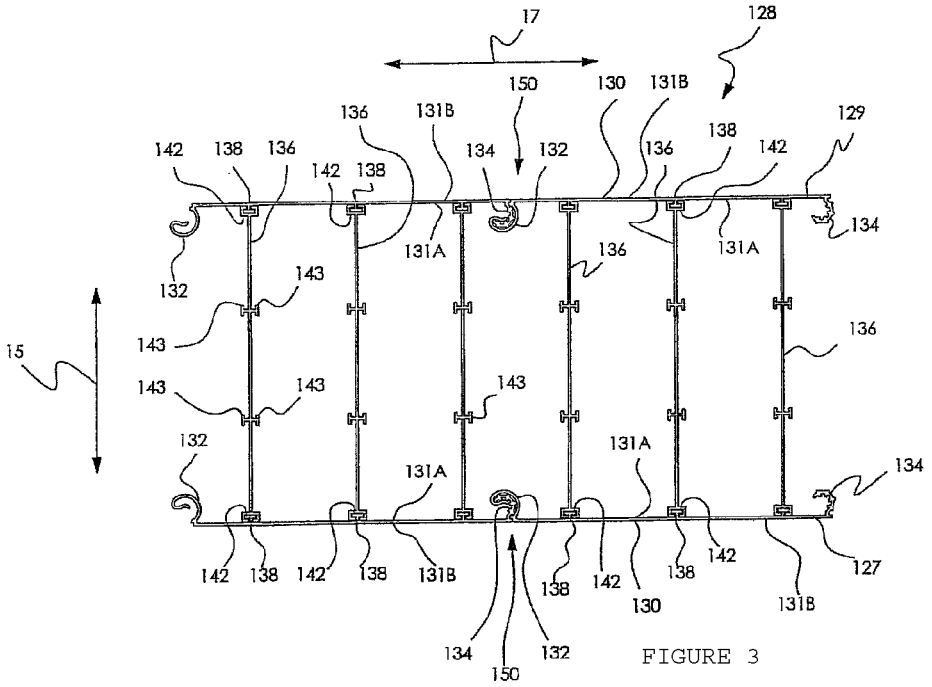
FIG. 3 is a plan view of a modular stay-in-place form according to a particular embodiment of the invention.

FIG. 3 is a partial plan view of a modular stay-in-place form 128 according to a particular embodiment of the invention which may be used to fabricate a portion of a wall of a building or other structure. Form 128 of the FIG. 3 embodiment includes wall panels 130 and support members 136. The components of form 128 (i.e. panels 130 and support members 136) are preferably fabricated from a lightweight and resiliently deformable material (e.g. a suitable plastic) using an extrusion process. By way of non-limiting example, suitable plastics include: poly-vinyl chloride (PVC), acrylonitrile butadiene styrene (ABS) or the like. In other embodiments, the components of form 128 may be fabricated from other suitable materials, such as steel or other suitable alloys, for example. Although extrusion is the currently preferred technique for fabricating the components of form 128, other suitable fabrication techniques, such as injection molding, stamping, sheet metal fabrication techniques or the like may additionally or alternatively be used.

Figure 6A:
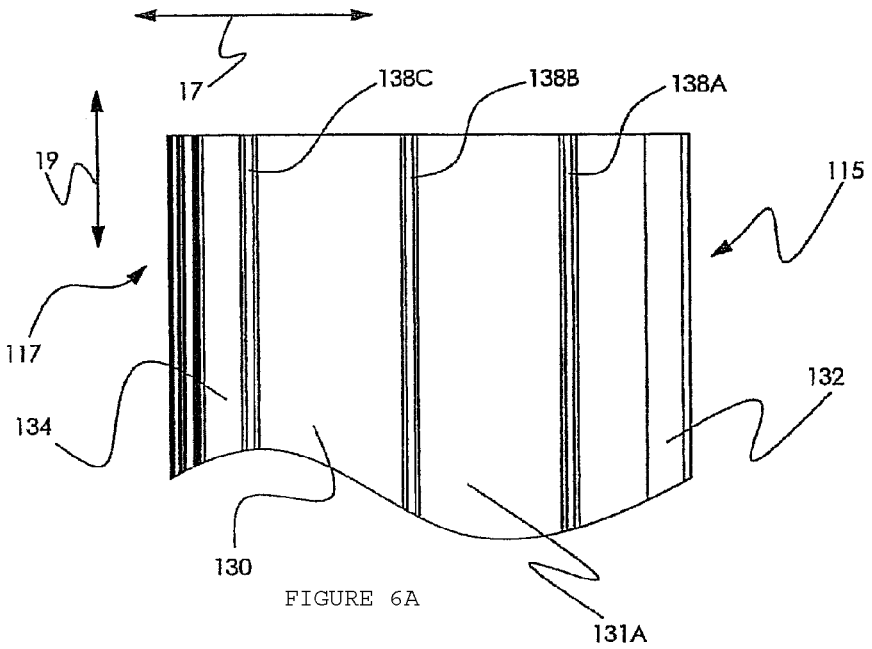
FIGS. 6A, 6B and 6C represent partial side plan views of the panels and the support members of the forms of FIGS. 3, 4, 5A and 5B and of the tensioning components of the FIGS. 4 and 5B form.
Figure 6B:
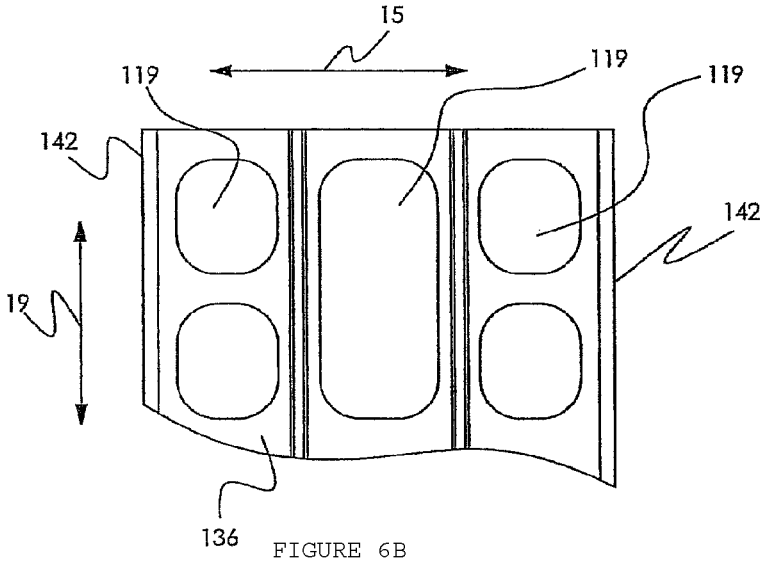

Form 128 comprises a plurality of panels 130 which are elongated in the longitudinal direction (i.e. the direction into and out of the page of FIG. 3 and the direction of double-headed arrow 19 of FIGS. 6A and 6B). Panels 130 comprise inward facing surfaces 131A and outward facing surfaces 131B. In the FIG. 3 illustration, all panels 130 are identical to one another, but this is not necessary. In general, panels 130 may have a number of features which differ from one another as explained in more particular detail below. As shown in FIGS. 3, 6A and 7A-7F, panels 130 incorporate first, generally female, curved connector components 132 at one of their transverse edges 115 and second, generally male, curved connector components 134 at their opposing transverse edges 117. In the illustrated embodiment, panels 130 (including first and second connector components 132, 134) have a substantially uniform cross-section along their entire longitudinal length, although this is not necessary.

In some embodiments, panels 130 are prefabricated to have different longitudinal dimensions. In other embodiments, the longitudinal dimensions of panels 130 may be cut to length. Preferably, panels 130 are relatively thin in the inward-outward direction (shown by double-headed arrow 15 of FIG. 3) in comparison to the inward-outward dimension of the resultant walls fabricated using form 128. In some embodiments, the ratio of the inward-outward dimension of a structure formed by form 128 to the inward-outward dimension of a panel 130 is in a range of 10-600. In some embodiments, the ratio of the inward-outward dimension of a structure formed by form 128 to the inward-outward dimension of a panel 130 is in a range of 20-300.

As shown in FIG. 3 and explained further below, connector components 132, 134 may be joined together to form connections 150 at transverse edges 115, 117 of panels 130. Panels 130 may thereby be connected in an edge-adjacent relationship to form wall segments 127, 129. In the FIG. 3 illustration, form 128 comprises a pair of wall segments 127, 129 which extend in the longitudinal direction 19 and in the transverse direction (shown by double headed arrows 17 in FIGS. 3 and 6A). In some embodiments, wall segments 127, 129 are oriented such that longitudinal direction 19 is generally vertical and transverse direction 17 is generally horizontal, although this is not necessary. As explained in more particular detail below, forms used for tilt-up walls according to the invention need only comprise a single wall segment. In addition, structures fabricated using forms according to the invention are not limited to walls. In such embodiments, groups of edge-adjacent panels 130 connected in edge-to-edge relationship at connections 150 may be more generally referred to as form segments instead of wall segments. In the illustrated embodiment, wall segments 127, 129 are spaced apart from one another in the inward-outward direction by an amount that is relatively constant, such that wall segments 127, 129 are generally parallel. This is not necessary. In some embodiments, wall segments 127, 129 need not be parallel to one another and different portions of forms according to the invention may have different inward-outward dimensions.

FIGS. 7A-7E schematically illustrate represent magnified partial plan views of the connector components 132, 134 for implementing connections 150 between edge-adjacent panels 130A, 130B of form 128 and a method of coupling connector components 132, 134 to form such edge-to-edge connections 150. Generally speaking, rather than sliding panels relative to one another to form connections between connector components, edge-adjacent panels 130A, 130B are pivoted relative to one another such that second, generally male, curved connector component 134 pivots into receptacle 154 of first, generally female, curved connector component 132. In some embodiments, edge-adjacent panels 130A, are moved relative to one another such that connector components 132, 134 engage one another in an intermediate loose-fit connection and then edge-adjacent connector components 132, 134 (or panels 130A, 130B) are pivoted relative to one another (e.g. about an axis oriented in longitudinal direction 19) to lock connector components 132, 134 to one another in a snap-together fitting via restorative deformation forces. The coupling of second connector component 134 to first connector component 132 may also involve resilient deformation of various features of connector components 132, 134 such that resilient restorative forces tend to lock connector components 132, 134 to one another (i.e. snap-together fitting).

Figure 7A:
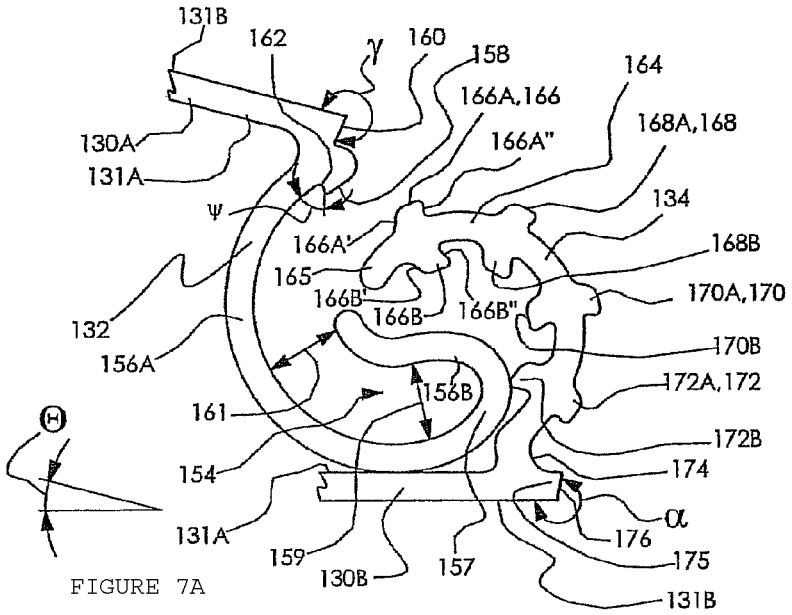
FIGS. 7A-7E represent magnified partial plan views of the connector components for implementing the edge-to-edge connections between edge-adjacent panels of the forms of FIGS. 3, 4, 5A and 5B and a method of coupling the connector components to form such edge-to-edge connections.
Figure 7B:
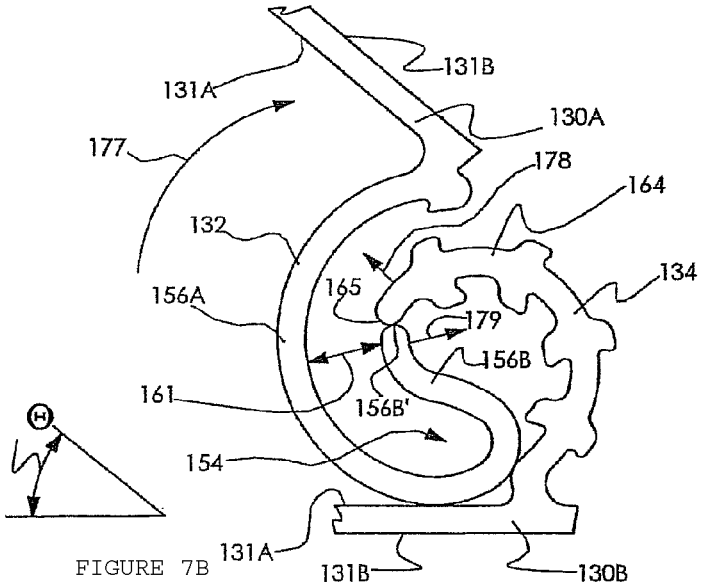

The features of connector components 132, 134 are shown best in FIGS. 7A and 7B. Connector component 132 is a part of (i.e. integrally formed with) panel 130A and includes a pair of curved arms 156A, 156B which join one another in region 157 to form a curved receptacle or channel 154 therebetween. Region 157 may be referred to as bight 157. Proximate arm 156A extends generally away from panel 130A toward bight 157 and distal arm 156B extends generally from bight 157 back toward panel 130A to form receptacle 154. Receptacle 154 comprises an open end 161 at an end opposite that of bight 157. In currently preferred embodiments, the curvatures of arms 156A, 156B are not concentric and distal arm 156B extends slightly toward proximate arm 156A as arms 156A, 156B extend away from bight 157. That is, the dimension of receptacle 154 (i.e separation of arms 156A, 156B) is wider in a central portion 159 of receptacle 154 than at opening 161 of receptacle 154.

In the illustrated embodiment, proximate arm 156A comprises a protrusion 158 in a vicinity of inward surface 131A of panel 130A. Protrusion 158 extends away from inward surface 131A of panel 130A. In the illustrated embodiment, protrusion 158 comprises a hook portion 162. The open angle ø between the surface of proximate arm 156A and hook portion 162 may be less than 90. Connector component 132 also comprises a beveled surface 160 which joins outward facing surface 131B of panel 130A. The open angle ã between beveled surface 160 and outward facing surface 131B of panel 130A may be greater than 270.

Connector component 134 is part of panel 130B and comprises a curved protrusion or prong 164 which initially extends away from inward facing surface 131A of panel 130B. The radius of curvature of prong 164 may vary along the length of prong 164. Depending on the curvature of prong 164, a distal portion of prong 164 may curve back toward inward facing surface 131A of panel 130. Connector component 134 also comprises a plurality of projections 166, 168, 170, 172 which extend from prong 164 at spaced apart locations therealong. In the illustrated embodiment, each of projections 166, 168, 170, 172 comprises a distal lobe 166A, 168A, 170A, 172A and a proximate lobe 166B, 168B, 170B, 172B. Distal lobe 166A may comprise a forward surface 166A' (closer to the end 165 of prong 164) for which the open angle (not explicitly enumerated) between forward surface 166A' and the surface of the central shaft of prong 164 is greater than 90. Distal lobe 166A may comprise a rearward surface 166A" (further from the end 165 of prong 164) for which the open angle (not explicitly enumerated) between rearward surface 166B" and the surface of the central shaft of prong 164 is less than 90.

Proximate lobe 166B may comprise similar forward and rearward surfaces 166B', 166B" which exhibit similar angular properties as forward and rearward surface 166A', 166A" with respect to the surface of prong 164. Furthermore, although not explicitly enumerated for the sake of clarity, distal lobes 168A, 170A, 172A and proximate lobes 168B, 170B, 172B may comprise forward and rearward surfaces (similar to forward and rearward surfaces 166A', 166A") which exhibit similar angular properties with respect to the surface of prong 164. The relative size of projections 166, 168, 170, 172 (i.e. the distance between the extremities of proximate lobes 166B, 168B, 170B, 172B and distal lobes 166A, 168A, 170A, 172A) may increase as projections 166, 168, 170, 172 are spaced further from the end 165 of prong 164. That is, projection 172 (lobes 172A, 172B) may be larger than projection 170 (lobes 170A, 170B), projection 170 (lobes 170A, 170B) may be larger than projection 168 (lobes 168A, 168B) and projection 168 (lobes 168A, 168B) may be larger than projection 166 (lobes 166A, 166B).

In the illustrated embodiment, connector component 134 also comprises a receptacle 174 in a vicinity of inward surface 131A of panel 130B. Receptacle 174 opens away from inward surface 131A of panel 130B. Connector component 134 also comprises a thumb 175 that extends transversely beyond the region at which prong 164 extends from inward facing surface 131A of panel 130B. Thumb 175 terminates in a beveled surface 176 which joins outward facing surface 131B of panel 130B. The open angle á between beveled surface 176 and outward facing surface 131B of panel 130B may be less than 270. As explained in more detail below, the angles á, ã of beveled surfaces 176, 160 may be selected such that beveled surface 176 of connector component 134 abuts against beveled surface 160 of connector component 132 when connector components 132, 134 are coupled to one another to form connection 150 (e.g. when outward facing surfaces 131B of panels 130A, 130B are parallel to one another to form a portion of wall segments 127, 129).

The coupling of connector components 132, 134 to one another to form connection 150 between wall segments 130A, 130B is now described with reference to FIGS. 7A-7E. A user starts by placing wall segments 130A, 130B into the configuration shown in FIG. 7A. In the FIG. 7A configuration, the end 165 of prong 164 is clear of receptacle 154 between arms 156A, 156B. In the illustrated embodiment, the angle è between the inward facing surfaces 131A of panel 130A and panel 130B may be less than about 45 when panels 130A, 130B are in the FIG. 7A configuration.

As shown in FIG. 7B, a user then starts effecting a relative pivotal (or quasi-pivotal) motion between panel 130A and panel 130B as shown by arrow 177 (e.g. about an axis oriented in longitudinal direction 19). The end 165 of prong 164 approaches the end 156B' of arm 156B and opening 161 of receptacle 154. Contact between the end 165 of prong 164 and the end 156B' of arm 156B may cause deformation of prong 164 (e.g. in the direction of arrow 178) and/or the deformation of arm 156B (e.g. in the direction of arrow 179). Contact between the end 165 of prong 164 and the end 156B' of arm 156B is not necessary. In some embodiments, the relative pivotal movement between panel 130A and panel 130B may cause the end 165 of prong 164 to project at least partially into opening 161 of receptacle 154 without contacting arms 156A, 156B. In the FIG. 7B configuration, the angle è between the inward facing surfaces 131A of panel 130A and panel 130B may be in a range of 30-75.

Figure 7C:
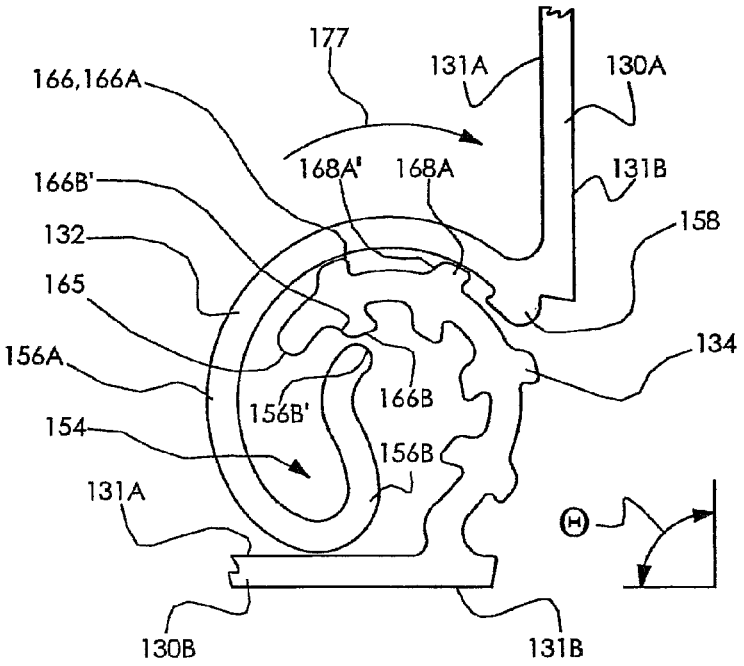

As shown in FIG. 7C, the user continues to effect relative pivotal (or quasi-pivotal) motion between panel 130A and panel 130B as shown by arrow 177 (e.g. about an axis oriented in longitudinal direction 19). As a consequence of this relative pivotal motion, end 165 of prong 164 begins to project past the end 156B' of arm 156B and through opening 161 of curved receptacle or channel 154. As projection 166 enters curved receptacle 154, distal lobe 166A may contact proximate arm 156A while proximate lobe 166B may contact distal arm 156B. This contact may cause deformation of proximate arm 156A, distal arm 156B and/or prong 164 as curved prong 164 moves into curved receptacle 154. The angle (greater than 90) of forward surface 166B' of proximate lobe 166B may facilitate this deformation as forward surface 166B' contacts the end 156B' or arm 156B. In addition, as curved prong 164 enters curved receptacle 154, there may be contact between distal lobes 166A, 168A and protrusion 158. Such contact may cause deformation of proximate arm 156A, distal arm 156B and/or prong 164. The angle (greater than 90) of forward surfaces 166A', 168A' of distal lobes 166A, 168A may facilitate this deformation as forward surfaces 166A', 168A' contact protrusion 158. In the FIG. 7C configuration, the angle è between the inward facing surfaces 131A of panel 130A and panel 130B may be in a range of 75-105.

Figure 7D:
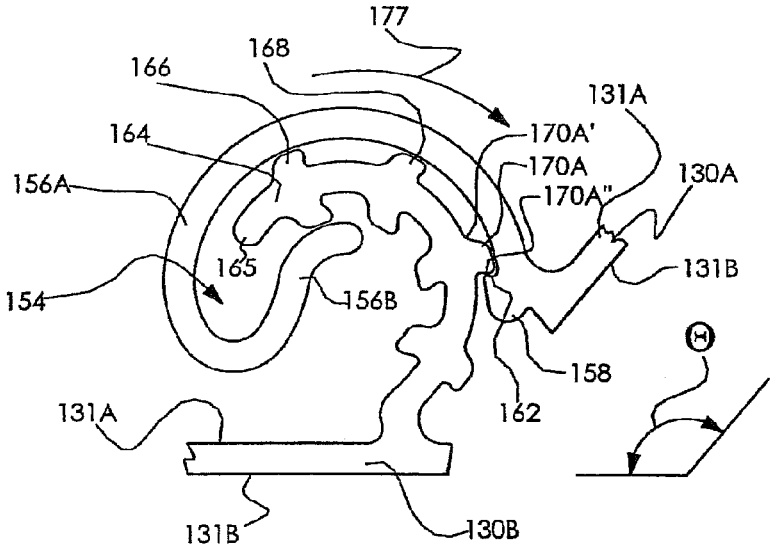

In the illustrated view of FIG. 7D, the user continues to effect relative pivotal (or quasi-pivotal) motion between panel 130A and panel 130B as shown by arrow 177 (e.g. about an axis oriented in longitudinal direction 19). The FIG. 7D configuration is similar in many respects to the FIG. 7C configuration, except that curved prong 164 projects further into curved receptacle 154. As prong 164 continues to project into receptacle 154, there may be contact between distal lobe 170A and protrusion 158. Such contact may cause the deformation of proximate arm 156A, distal arm 156B and/or prong 164. The angle (greater than 90) of forward surface 170A' of distal lobe 170A may facilitate this deformation as forward surface 170A' contacts protrusion 158. In addition, once protrusion 158 has cleared distal lobe 170A, rearward surface 170A" may interact with hook 162 of protrusion 158 to make it more difficult to decouple connector components 132, 134. More particularly, the angle (less than 90) between rearward surface 170A" and the surface of the shaft of prong 164 and the angle ø (FIG. 7A, less than 90) of hook 162 tend to prevent pivotal motion of panel 130A with respect to panel 130B in a direction opposite that of arrow 177. While the interaction between rearward surface 170A" and hook 162 is explained above, it will be appreciated that the rearward surfaces 166A", 168A", 172A" could also interact with hook 162 in a similar manner to help prevent pivotal motion of panel 130A with respect to panel 130B in a direction opposite that of arrow 177. In the FIG. 7D configuration, the angle è between the inward facing surfaces 131A of panel 130A and panel 130B may be in a range of 105-150.

Figure 7E:
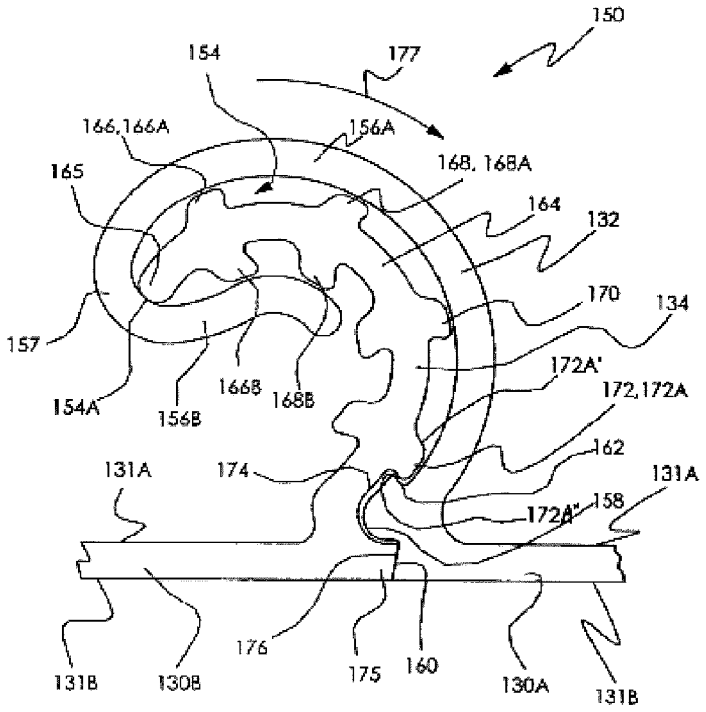

The user continues to effect relative pivotal (or quasi-pivotal) motion between panel 130A and panel 130B as shown by arrow 177 (e.g. about an axis oriented in longitudinal direction 19) until panels 130A and 130B reach the configuration of FIG. 7E. In the configuration of FIG. 7E, the inward facing surfaces 131A and outward facing surfaces 131B of panels 130A, 130B are generally parallel (i.e. the angle between inward facing surfaces 131A of panels 130A, 130B is at or near 180. As prong 164 continues to project into receptacle 154, there may be contact between distal lobe 172A and protrusion 158. Such contact may cause the deformation of proximate arm 156A and/or prong 164. The angle (greater than 90) of forward surface 172A' of distal lobe 172A may facilitate this deformation as forward surface 172A' contacts protrusion 158. In addition, once protrusion 158 has cleared distal lobe 172A, protrusion 158 may snap (e.g by restorative deformation force) into receptacle 174. In the illustrated embodiment, a portion of receptacle 174 comprises rearward surface 172A" of distal lobe 172A. Once received in receptacle 174, rearward surface 172A" of distal lobe 172A interacts with hook 162 of protrusion 158 to lock connector components 132, 134 to one another. More particularly, the angle (less than 90) between rearward surface 172A" and the surface of prong 164 and the angle ø (less than 90) of hook 162 tend to prevent pivotal motion of panel 130A with respect to panel 130B in a direction opposite that of arrow 177. In addition, receptacle 174 comprises a depression into the distal surface of prong 164. The "snapping" (e.g by restorative deformation force) of protrusion 158 into the depression of receptacle 174 tends to help prevent pivotal motion of panel 130A with respect to panel 130B in a direction opposite that of arrow 177.

In the FIG. 7E configuration, there is preferably contact between a plurality of distal lobes (e.g. distal lobes 166A, 168A) and proximate arm 156A within receptacle 154 and there is preferably contact between a plurality of proximate lobes (e.g. proximate lobes 166B, 168B) and distal arm 156B. For clarity, this contact is not explicitly shown in the FIG. 7E illustration. Such contact may cause deformation of arm 156A, arm 156B and/or prong 164. In this manner, restorative deformation forces tend to force proximate arm 156A against distal lobes 166A, 168A and distal arm 156B against proximate lobes 166B, 168B. In some embodiments, projections 166, 168 and arms 156A, 156B are dimensioned such that contact between projection 166 and arms 156A, 156B and contact between projection 168 and arms 156A, 156B occur at approximately the same relative orientation of panels 130A, 130B. In particular embodiments, the restorative deformation forces at the points of contact between projection 166 and arms 156A, 156B and the restorative deformation forces at the points of contact between projection 168 and arms 156A, 156B are approximately equal or within 20% of one another.

In the illustrated embodiment, there is also contact between end 165 of prong 164 and the end 154A of curved receptacle 154 (i.e. in bight 157 between arms 156A, 156B). The contact between projections 166, 168 and arms 156A, 156B, between the end 165 of prong 164 and the end 154A of curved receptacle 154 and between protrusion 158 and receptacle 174 may provide a seal that is impermeable to liquids (e.g. water) or gasses (e.g. air). In some embodiments, the surfaces of arms 156A, 156B, projections 166, 168, 170, 172, protrusion 158 and/or receptacle 174 may be coated with suitable material(s) which may increase this impermeability. Non-limiting examples of such material(s) include silicone, urethane, neoprene, polyurethane, food grade plastics and the like. In addition to being coated with suitable coating materials, the contact surfaces between arms 156A, 156B and projections 166, 168 may be provided with friction enhancing surface textures (e.g. ridges having saw-tooth shapes or other shapes), which may help to prevent pivotal motion of panel 130A with respect to panel 130B in a direction opposite that of arrow 177.

In the configuration of FIG. 7E, beveled surface 176 of male connector component 134 abuts against beveled surface 160 of female connector component 132. As discussed above, the respective angles ö, á of beveled surface 160, 176 with respect to outward facing surfaces 131B of their corresponding panels 130A, 130B are selected such that beveled surfaces 160, 176 abut against one another when connector components 132, 134 are in the FIG. 7E configuration (i.e. when panels 130A, 130B are generally parallel to one another). Beveled surfaces 160, 176 may also be coated with suitable coating materials or provided with friction enhancing surface textures to improve the impermeability or increase the friction of the abutment joint therebetween. It will be appreciated that connecting panels 130A, 130B to form connection 150 need not proceed through all of the steps shown in FIGS. 7A-7E. Panels 130A, 130B may start in a configuration similar to that of FIG. 7C and then proceed through the configurations of 7D and 7E, for example.

Figure 7F:
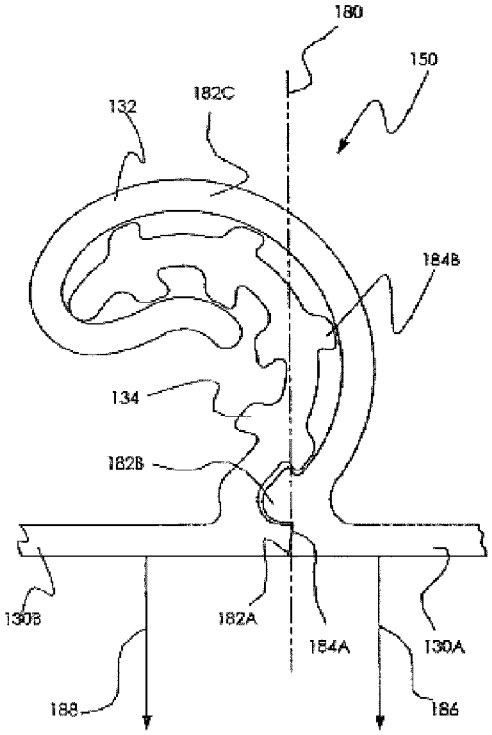
FIG. 7F is a magnified partial plan view of the connector components for implementing edge-to-edge connections between edge-adjacent panels of the forms of FIGS. 3, 4, 5A and 5B which shows the interleaved protrusions between the connector components.

FIG. 7F is another schematic view of connection 150 between connector components 132, 134 of panels 130A, 130B which shows a transverse midplane 180 of connection 150. It can be seen from FIG. 7F that connector component 132 comprises a plurality of projecting elements 182A, 182B, 182C which project transversely from one side of midplane 180 (i.e. the side of panel 130A) to the opposing side of midplane 180. Similarly, connector component 134 comprises a plurality of projecting elements 184A, 184B which project transversely from one side of midplane 180 (i.e. the side of panel 130B) to the opposing side of midplane 180. These projecting elements 182A, 182B, 182C, 184A, 184B interleave with one another to provide multiple points of contact (abutments) which tend to prevent connection 150 from unzipping. More particularly, as shown in FIGS. 7E and 7F, projecting element 182A corresponds to the abutment between beveled surfaces 176, 160, projecting element 184A corresponds to the abutment of protrusion 158 and thumb 175, projecting element 182B corresponds to the abutment of hook 162 of protrusion 158 and rearward surface 172A" of projection 172A and projecting elements 184B, 182C correspond to the interaction between projections 166, 168, 170 on prong 164 and arms 156A, 156B.

Interleaved projecting elements 182A, 182B, 182C, 184A, 184B tend to prevent connection 150 from unzipping. More particularly, if a disproportionately large amount of outward force 186 is applied to panel 130A (relative to panel 130B), then the contact between protrusion 158 and thumb 175 and the contact between proximate arm 156A and prong 164 both tend to prevent unzipping of connection 150. Similarly, if a disproportionately large amount of outward force 188 is applied to panel 130B (relative to panel 130A), then the contact between beveled surfaces 160, 176, the contact between rearward surface 172A" of distal lobe 172A and hook 162 of protrusion 158 and the contact between prong 164 and distal arm 156B all tend to prevent unzipping of connection 150.

In addition, when connection 150 formed by interleaved projecting elements 182A, 182B, 182C, 184A, 184B is encased in concrete and the concrete is allowed to solidify, the solid concrete may exert forces that tend to compress interleaved projecting elements 182A, 182B, 182C, 184A, 184B toward one another.

In the FIG. 3 embodiment, form 128 comprises support members 136 which extend between wall segments 127, 129. Support members 136 are also shown in FIG. 6B. Support members 136 comprise connector components 142 at their edges for connecting to corresponding connector components 138 on inward surfaces 131A of panels 130. Support members 136 may brace opposing panels 130 and connect wall segments 127, 129 to one another.

In the illustrated embodiment, connector components 138 on inward surfaces 131A of panels 130 are male T-shaped connector components 138 which slide into the receptacles of female C-shaped connector components 142 at the edges of support members 136. This is not necessary. In general, where form 128 includes support members 136, connector components 138,142 may comprise any suitable complementary pair of connector components and may be coupled to one another by sliding, by deformation of one or both connector components or by any other suitable coupling technique. By way of non-limiting example, connector components 138 on panels 130 may comprise female C-shaped connectors and connector components 142 on support members 136 may comprise male T-shaped connectors which may be slidably coupled to one another.

In the illustrated embodiment of FIG. 3, each panel 130 comprises three connector components 138 between its transverse edges 115, 117 (i.e. between connector components 132, 134), which facilitate the connection of up to three support members 136 to each panel 130. This is not necessary. In general, panels 130 may be provided with any suitable number of connector components 138 to enable the connection of a corresponding number of support members 136, as may be necessary for the particular strength requirements of a given application. In addition, the mere presence of connector components 138 on panels 130 does not necessitate that support members 136 are connected to each such connector component 138. In general, the spacing of support members 136 may be determined as necessary for the particular strength requirements of a given application and to minimize undesirably excessive use of material.

Support members 136 may be apertured (see apertures 119 of FIG. 6B) to allow liquid concrete to flow in the transverse directions between wall segments 127, 129. Although not explicitly shown in the illustrated views, reinforcement bars (commonly referred to as rebar) may also be inserted into form 128 prior to pouring the liquid concrete. Where required or otherwise desired, transversely extending rebar can be inserted so as to extend through apertures 119 in support members 136. If desired, longitudinally extending rebar can then be coupled to the transversely extending rebar.

Figure 4:
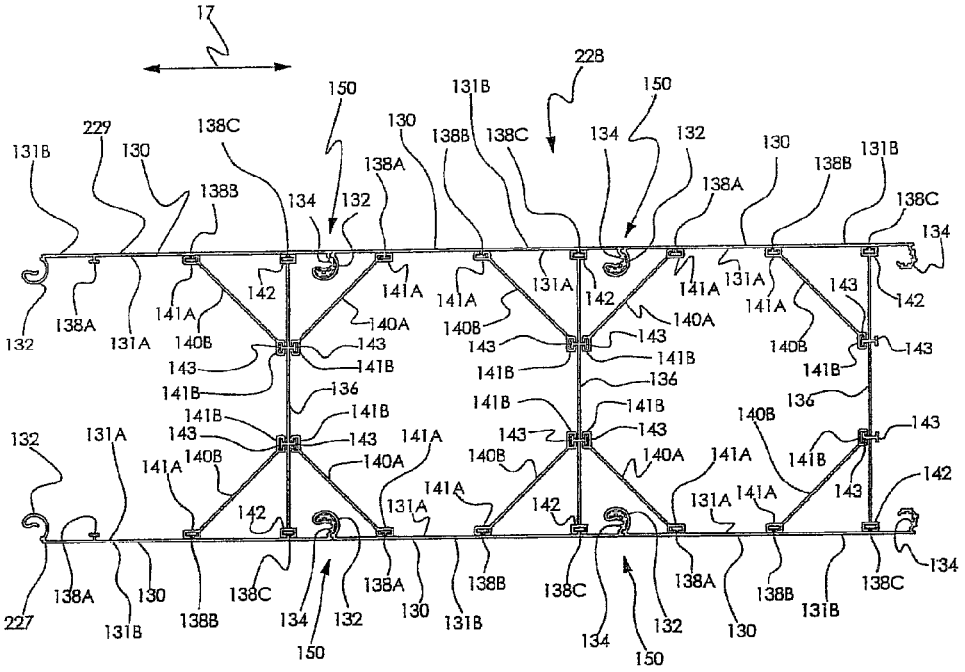
FIG. 4 is a plan view of a modular stay-in-place form according to another particular embodiment of the invention.

FIG. 4 is a partial plan view of a modular stay-in-place form 228 according to another particular embodiment of the invention which may be used to form a wall of a building or other structure. Form 228 of FIG. 4 incorporates panels 130 and support members 136 which are substantially identical to panels 130 and support members 136 of form 128 and similar reference numbers are used to refer to the similar features of panels 130 and support members 136. Panels 130 are connected as described above (at connections 150) in edge-adjacent relationship to provide wall segments 227, 229. Form 228 differs from form 128 in relation to the spacing in the transverse direction (arrow 17) between adjacent support members 136. Form 228 also incorporates tensioning members 140A, 140B (collectively, tensioning members 140) which are not present in form 128. Tensioning members 140 are also illustrated in FIG. 6C.

In the FIG. 4 embodiment, connector components 138 on inward surfaces 131A of panels 130 are referred to individually using reference numerals 138A, 138B, 138C. Connector component 138A is most proximate to first, generally female connector component 132 on transverse edge 115 (FIG. 6A) of panel 130, connector component 138C is most proximate to second, generally male connector component 134 on transverse edge 117 (FIG. 6A) of panel 130 and connector component 138B is located between connector components 138A, 138C. In the illustrated embodiment of FIG. 4, support members 136 extend between every third connector component 138 to provide one support member 136 per panel 130. More particularly, in the FIG. 4 embodiment, support members 136 extend between connector components 138C of opposing panels 130 on wall segments 227 and 229. The connection between connector components 142 of support members 136 (which, in the illustrated embodiment are female C-shaped connector components) and connector components 138C of panels 130 (which in the illustrated embodiment are male T-shaped connector components) may be substantially similar to the connections discussed above for form 128. However, this is not necessary. In general, connector components 138 and 142 may be any complementary pairs of connector components and may be coupled to one another by sliding, by deformation of one or both connector components or by any other suitable coupling technique.

Form 228 incorporates tensioning members 140 which extend angularly between support members 136 and panels 130. In the illustrated embodiment, tensioning members 140 comprise connector components 141A, 141B at their opposing edges. Connector components 141A are complementary to connector components 138A, 138B on inward surfaces 131A of panels 130 and connector components 141B are complementary to connector components 143 on support members 136. In the illustrated embodiment, connector components 138A, 138B of panels 130 and connector components 143 of support members 136 are male T-shaped connector components which slide into the receptacles of female C-shaped connector components 141A, 141B of tensioning members 140. However, this is not necessary. In general, connector components 138 and 141A and connector components 143 and 141B may be any complementary pairs of connector components and may be coupled to one another by sliding, by deformation of one or both connector components or by any other suitable coupling technique.

Figure 6C:
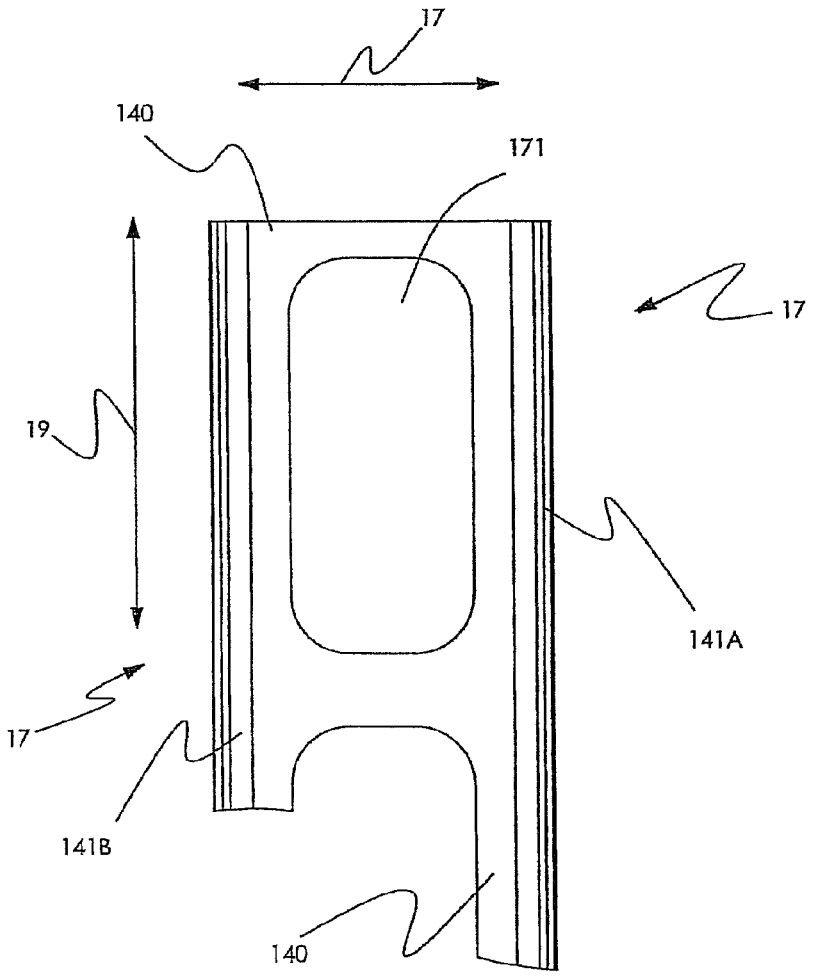

Tensioning members 140 may comprise apertures 171 which allow concrete flow and for the transverse extension of rebar therethrough (see FIG. 6C).

As mentioned above, in the illustrated embodiment, support members 136 extend between connector components 138C of opposing panels 130 of wall segment 229 and wall segment 227. With this configuration of support members 136 relative to panels 130, one tensioning member 140A out of every pair of tensioning members 140 can be made to reinforce connections 150 between panels 130. More particularly, tensioning members 140A may extend at an angle from support member 136 (i.e. at the connection between connector components 141B, 143) on one transverse side of connection 150 to panel 130 (i.e. at the connection between connector components 141A, 138A) on the opposing transverse side of connection 150. The other tensioning member 140B of each pair of tensioning members 140 may extend at an angle between support member 136 (i.e. at the connection between connector components 141B, 143) to panel 130 (i.e. at the connection between connector components 141A, 138B).

Tensioning members 140A, which span from one transverse side of connections 150 to the opposing transverse side of connections 150, add to the strength of connections 150 and help to prevent unzipping of connections 150. However, it is not necessary that tensioning members 140A span connections 150 in this manner. In other embodiments, support members 136 may extend between wall segments 227, 229 at different connector components. By way of non-limiting example, support members 136 may extend between wall segments 227, 229 at the midpoint of each panel 130, such that connector components 142 of support members 136 are coupled to connector components 138B of panels 130. With this configuration of support members 136 relative to panels 130, tensioning members 140 may extend at angles between support members 136 (i.e. a connection between connector components 141A, 143 and a connection between connector components 141B, 143) and panels 130 (i.e. a connection between connector components 141A, 138A and a connection between connector components 141A, 138C).

In some embodiments, tensioning members 140 are not necessary. Tensioning members 140 need not generally be used in pairs. By way of non-limiting example, some forms may use only tensioning members 140A which may or may not be configured to span connections 150. In some embodiments, support members 136 and/or tensioning members 140 may be employed at different spacings within a particular form. Form 228 incorporates components (i.e. panels 130 and support members 136) which are substantially similar to the components of form 128 described herein. In various different embodiments, form 228 may be modified as discussed herein for any of the modifications described for form 128.

In operation, forms 128, 228 may be used to fabricate a wall by pivotally connecting panels 130 to make connections 150 between edge-adjacent panels 130 and by slidably connecting connector components 142 of support members 136 to connector components 138 of panels 130 to connect wall segments 127, 129 to one another. If it is desired to include tensioning members 140, tensioning members 140 may then be attached between connector components 143 of support members 136 and connector components 138 of panels 130. Panels 130 and support members 136 may be connected to one another in any orientation and may then be placed in a desired orientation after such connection. Walls and other structures fabricated from panels 130 generally extend in two dimensions (referred to herein as the longitudinal dimension (see arrow 19 of FIGS. 6A and 6B) and the transverse dimension (see arrow 17 of FIG. 3)). However, it will be appreciated that walls and other structures fabricated using forms 128, 228 can be made to extend in any desired orientation and, as such, the terms "longitudinal", "transverse" and similar terms as used herein should be understood to describe relative directions (i.e. directions relative to one another). In some embodiments, longitudinal directions are generally vertical and transverse directions are generally horizontal, but this is not strictly necessary. In some embodiments, panels 130 may be deformed or may be prefabricated such that their transverse extension has some curvature.

If necessary or otherwise desired, transversely extending rebar and/or longitudinally extending rebar can then be inserted into form 128, 228. After the insertion of rebar, liquid concrete may be poured into form 128, 228. When the liquid concrete solidifies, the result is a wall or other structure that has two of its surfaces covered by stay-in-place form 128, 228.

Figure 8A:
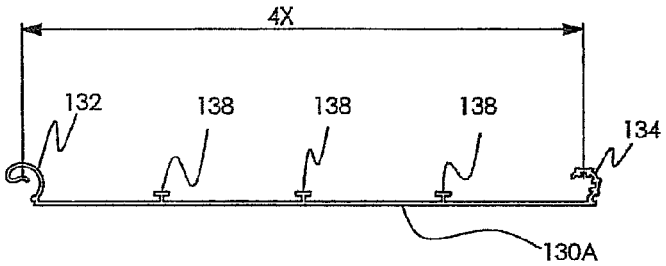
FIGS. 8A-8D are plan views showing modular panels used in the forms of FIGS. 3 and 4 and having different transverse dimensions.
Figure 8B:
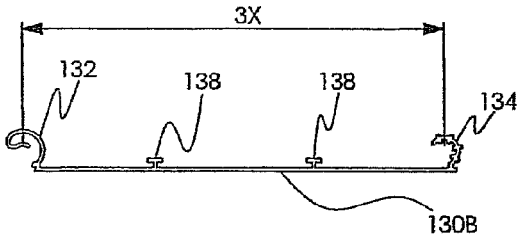
Figure 8C:
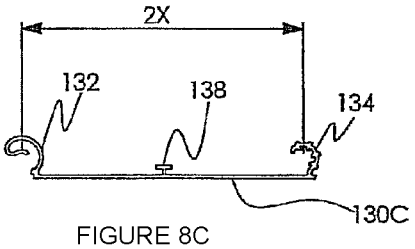
Figure 8D:
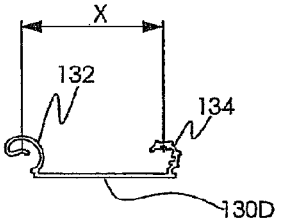

Panels 130 of forms 128, 228 may be provided in modular units with different transverse dimensions as shown in FIGS. 8A-8D. Panel 130D of FIG. 8D has a transverse dimension X between connector components 132, 134 and has no connector components 138 for connection to support members 136 or tensioning members 140. Panel 130D may be referred to as a single-unit panel. Panel 130C of FIG. 8C is a double-unit panel, with a transverse dimension 2X between connection components 132, 134 and a single connector component 138 for possible connection to a support member 136 or a tensioning members 140. Similarly, panels 130B, 130A of FIGS. 8B, 8A are triple and quadruple-unit panels, with transverse dimensions 3X, 4X between connector components 132, 134 and two and three connector components 138 respectively for possible connection to support members 136 or tensioning members 140.

Figure 9A:
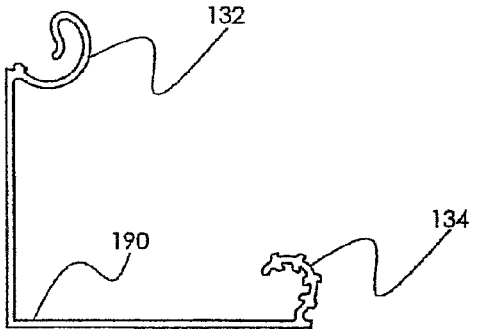
FIGS. 9A and 9B are plan views of an inside corner element and an outside corner element suitable for use with the forms of FIGS. 3 and 4.
Figure 9B:
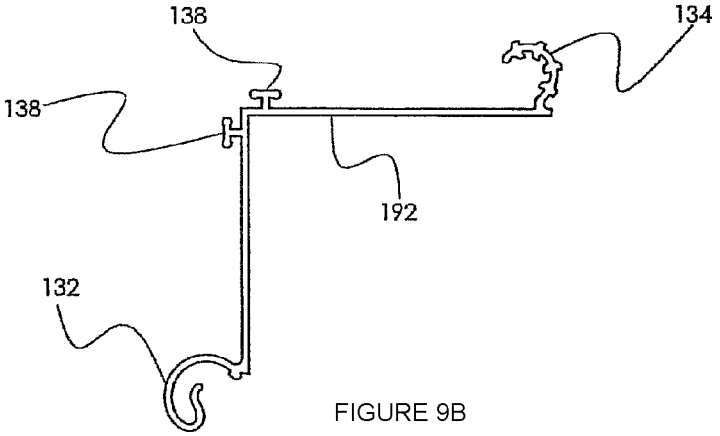
Figure 9C:
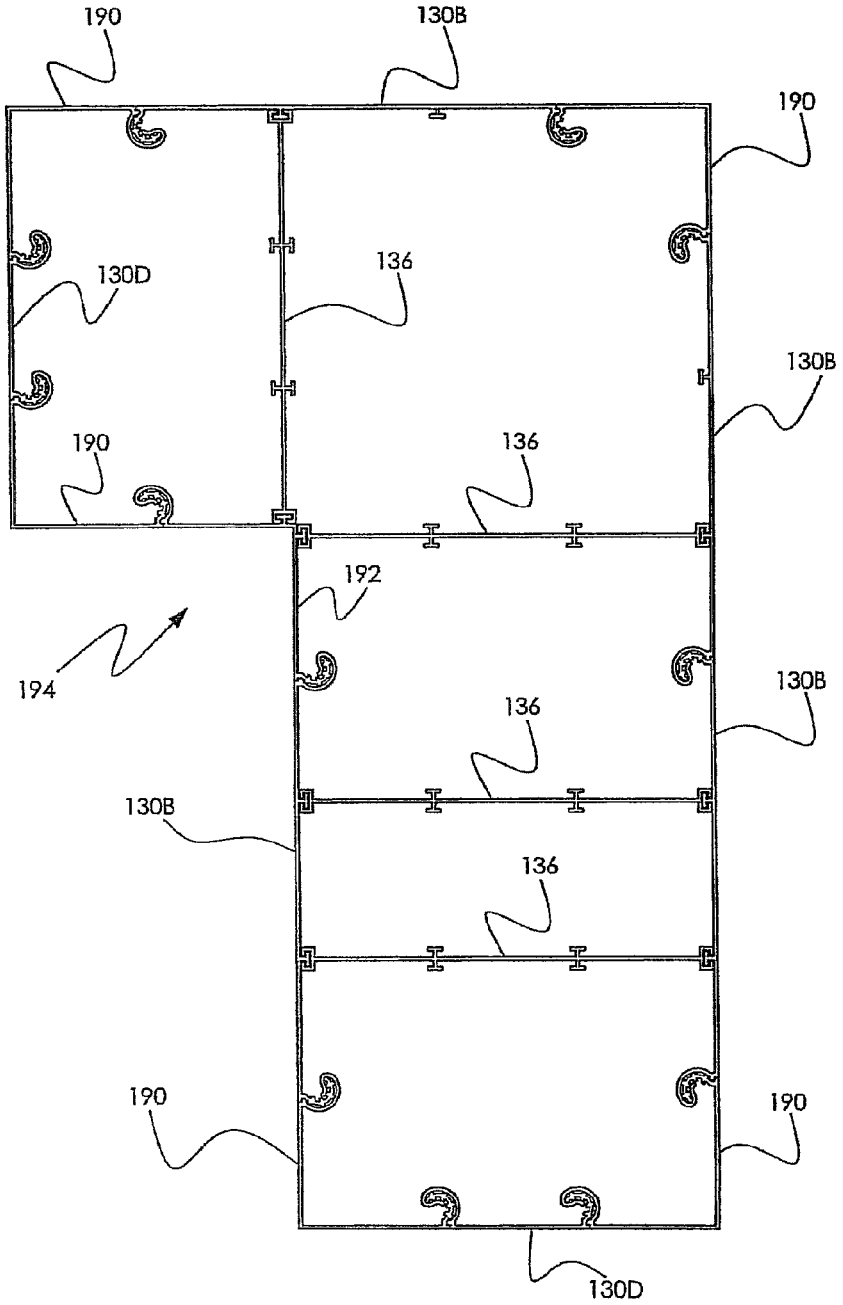
FIG. 9C is a plan view of a complete wall form incorporating the inside and outside corner elements of FIGS. 9A and 9B.

FIGS. 9A and 9B are plan views of an inside 90 corner element 190 and an outside 90 corner element 192 suitable for use with the forms of FIGS. 3 and 4 and FIG. 9C is a plan view of a complete wall form 194 incorporating the inside and outside corner elements 190, 192 of FIGS. 9A and 9B. In the illustrated embodiment, inside corner element 190 comprises a generally female curved connector component 132 at one of its edges and a generally male curved connector component 134 at is opposing edge. Similarly, the illustrated embodiment of outside corner element 192 comprises a generally female curved connector component 132 at one of its edges and a generally female curved connector component 134 at its opposing edge. Connector components 132, 134 are substantially similar to connector components 132, 134 on panels 130 and are used in a manner similar to that described above to connect corner components 190, 192 to panels 130 or to other corner components 190, 192. In the illustrated embodiment, outside corner element 192 also comprises a pair of connector components 138 for connection to support members 136 or tensioning members 140.

FIG. 9C schematically illustrates a complete wall form 194 fabricated using a series of panels 130, inside and outside corner components 190, 192 and support members 136. In the particular example form 194 of FIG. 9C, panels 130 include single-unit panels 130D and triple-unit panels 130B. It will be appreciated that wall form 194 of FIG. 9C represents only one particular embodiment of a wall form assembled according to the invention and that wall forms having a wide variety of other shapes and sizes could be assembled using the components described herein. In the illustrated example of FIG. 9C, wall form 194 is assembled without tensioning members 140. In other embodiments, tensioning members 140 may be used as described above.

Figure 5A:
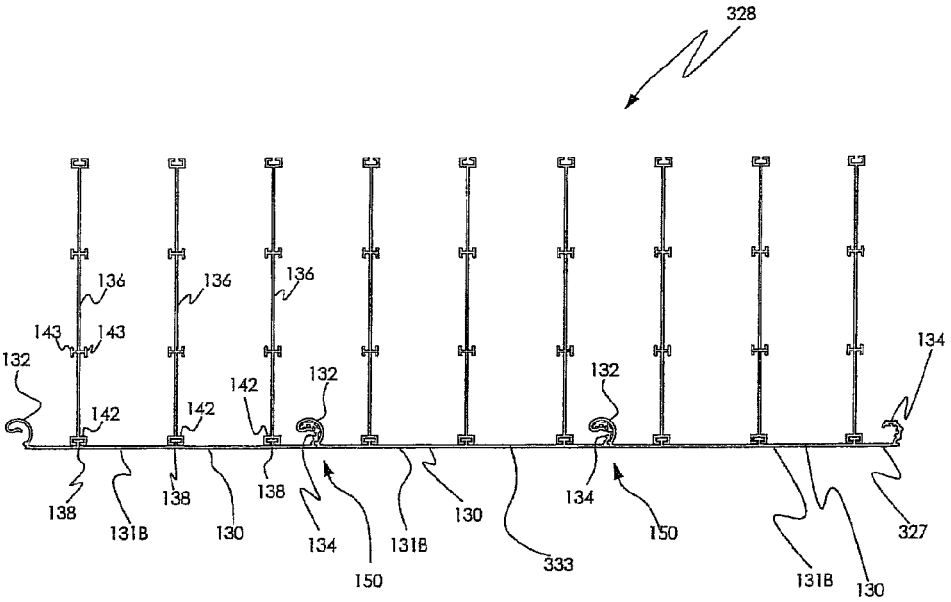
FIGS. 5A and 5B are plan views of modular stay-in-place forms which may be used to fabricate a tilt-up wall according to other particular embodiments of the invention.
Figure 5B:
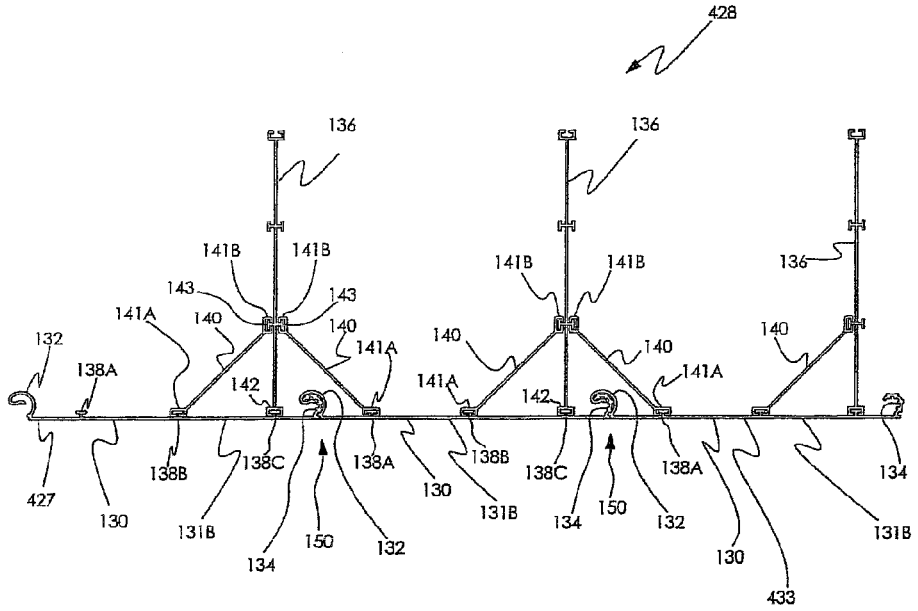

FIGS. 5A and 5B respectively represent modular stay-in-place forms 328, 428 which may be used to fabricate tilt-up walls according to other particular embodiments of the invention. The modular components of form 328 (FIG. 5A) and their operability are similar in many respects to the modular components of form 128 (FIG. 3). In particular, form 328 (FIG. 5A) incorporates panels 130 and support members 136 which are similar to panels 130 and support members 136 of form 128 and are connected to one another as described above to form a single wall segment 327 that is substantially similar to wall segment 127 of form 128. Form 328 differs from form 128 in that form 328 does not include panels 130 to form a wall segment that opposes wall segment 327 (i.e. form 328 comprises a single-sided form and does not include an opposing wall segment like wall segment 129 of form 128).

The modular components of form 428 (FIG. 5B) and their operability are similar in many respects to the modular components of form 228 (FIG. 4). In particular, form 428 (FIG. 5B) incorporates panels 130, support members 136 and tensioning members 140 which are similar to panels 130, support members 136 and tensioning members 140 of form 228 and are connected to one another as described above to form a single wall segment 427 that is substantially similar to wall segment 227 of form 228. Form 428 differs from form 228 in that form 428 does not include panels 130 to form a wall segment that opposes wall segment 427 (i.e. form 428 comprises a single-sided form and does not include an opposing wall segment like wall segment 229 of form 228). In addition, form 428 differs from form 228 in that form 428 only includes tensioning members 140 that connect to wall segment 427 (i.e. form 428 does not include tensioning members 140 that attach to an opposing wall segment like wall segment 229 of form 228).

In operation, forms 328, 428 are assembled by coupling connector components 132, 134 of panels 130 together as described above to fabricate a single wall segment 327, 427. In form 328, support members 136 are then coupled to panels 130 as described above for form 128, except that the coupling between connector components 142 and connector components 138 is made at one side only. In form 428, support members 136 and tensioning members 140 are then coupled to panels 130 as described above for form 228, except that the coupling between connector components 142 and connector components 138C is made at one side only and tensioning members 140 are coupled to support members 136 (at connector components 141B, 143) and to panels 130 (at connector components 141A, 138B, 138A) at one side only.

Forms 328, 428 may be assembled on, or otherwise moved onto, a generally horizontal table or the like, such that outward facing surfaces 131B of panels 130 are facing downward and the longitudinal and transverse extension of panels 130 is in the generally horizontal plane of the table. The table may be a vibrating table. In some embodiments a table is not required and a suitable, generally horizontal surface may be used in place of a table. If required, rebar may be inserted into form 328, 428 while the form is horizontally oriented. Transversely extending rebar may project through apertures 119 of support members 136 and apertures 171 of tensioning members 140. Edges (not shown) of form 328, 428 may be fabricated on the table in any suitable manner, such as using conventional wood form-work. Concrete is then poured into form 328, 428 and allowed to flow through apertures 119 of support members 136 and through apertures 171 of tensioning members 140. The liquid concrete spreads to level itself (perhaps with the assistance of a vibrating table) in form 328, 428.

The concrete is then allowed to solidify. Once solidified, the resultant wall is tilted into a vertical orientation. The result is a concrete wall segment (or other structure) that is coated on one side with the panels 130 of form 328, 428. Panels 130 are anchored into the concrete wall by support members 136 and tensioning members 140. Structures (e.g. building walls and the like) may be formed by tilting up a plurality of wall segments in place. Advantageously, the outward facing surfaces 131B of panels 130 provide one surface of the resultant wall made using forms 328, 428. Outward facing surfaces 131B of panels 130 may provide a finished wall surface 333, 433. In some applications, such as in warehouses and box stores for example, it may be desirable to have finished wall surface 333, 433 on the exterior of a building, whereas the finish of the interior wall surface is relatively less important. In such applications, wall segments fabricated using form 328, 428 can be tilted up such that panels 130 have outward facing surfaces 131B oriented toward the exterior of the building. In other applications, such as where hygiene of the interior of a building is important (e.g. food storage), it may be desirable to have finished wall surface 333,433 on the interior of a building, whereas the finish of the exterior wall surface is relatively less important. In such applications, wall segments fabricated using form 328, 428 can be tilted up such that panels 130 have outward facing surfaces 131B oriented toward the interior of the building.

The use of forms 328, 428 to fabricate tilt-up walls may involve the same or similar procedures (suitably modified where desirable) as those described for the fabrication of tilt-up walls or lined concrete structures using modular stay-in-place forms in the co-owned PCT application No. PCT/CA2008/000608 filed 2 Apr. 2008 and entitled "METHODS AND APPARATUS FOR PROVIDING LININGS ON CONCRETE STRUCTURES" (the "Structure-Lining PCT Application"), which is hereby incorporated herein by reference. Form 328 may be anchored to the concrete by support members 136, by connector components 138 and by connector components 132, 134 of connections 150. Similarly, form 428 may be anchored to the concrete by support members 136, by connector components 138, by connector components 132, 134 of connections 150 and by tensioning members 140. Other anchoring components similar to any of the anchoring components disclosed in the Structure-Lining PCT Application may additionally or alternatively be used.

Figure 11:
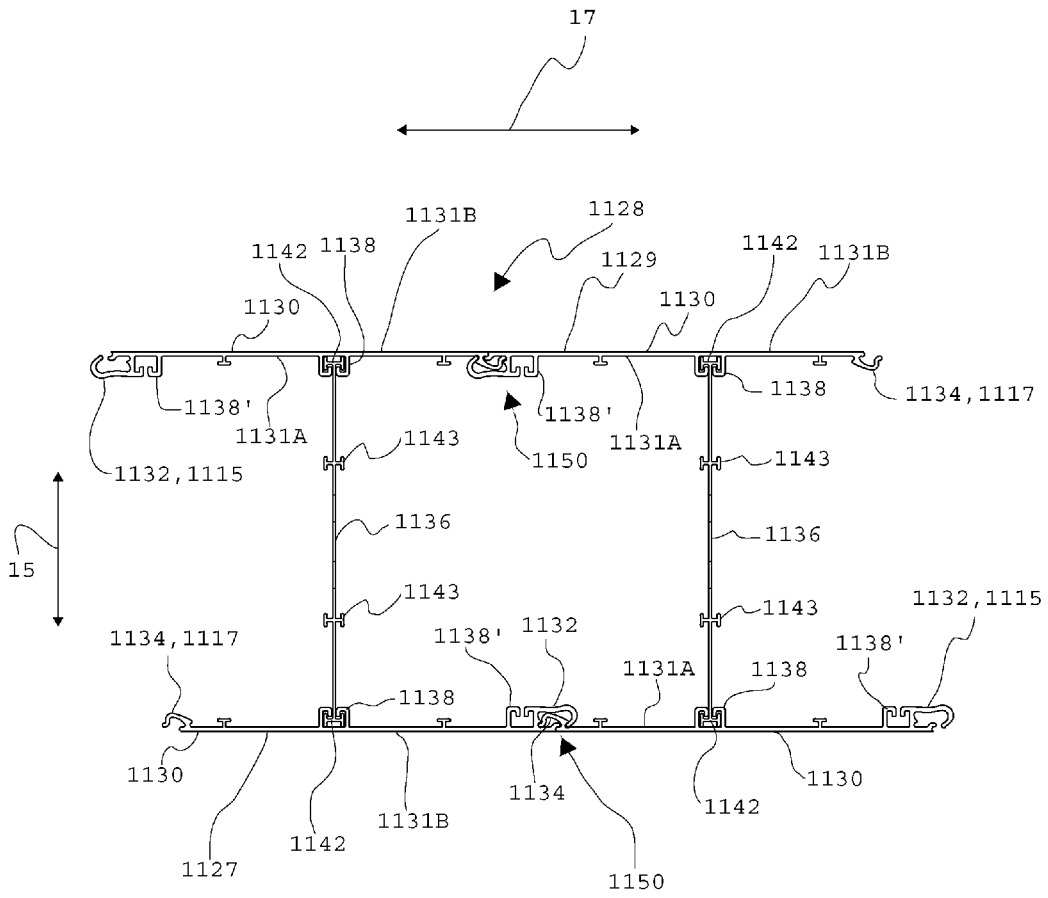
FIG. 11 is a plan view of a modular stay-in-place form according to another particular embodiment of the invention.

FIG. 11 is a partial plan view of a modular stay-in-place form 1128 according to a particular embodiment of the invention which may be used to fabricate a portion of a wall, a building structure (e.g. a wall, floor foundation or ceiling) or some other structure. In the illustrated embodiment, form 1128 is used to form a portion of a wall. Form 1128 of the FIG. 11 embodiment includes panels 1130 and support members 1136. The components of form 1128 (i.e. panels 1130 and support members 1136) may be fabricated from any of the materials and using any of the procedures described above for form 128 (FIG. 3).

Figure 14A:
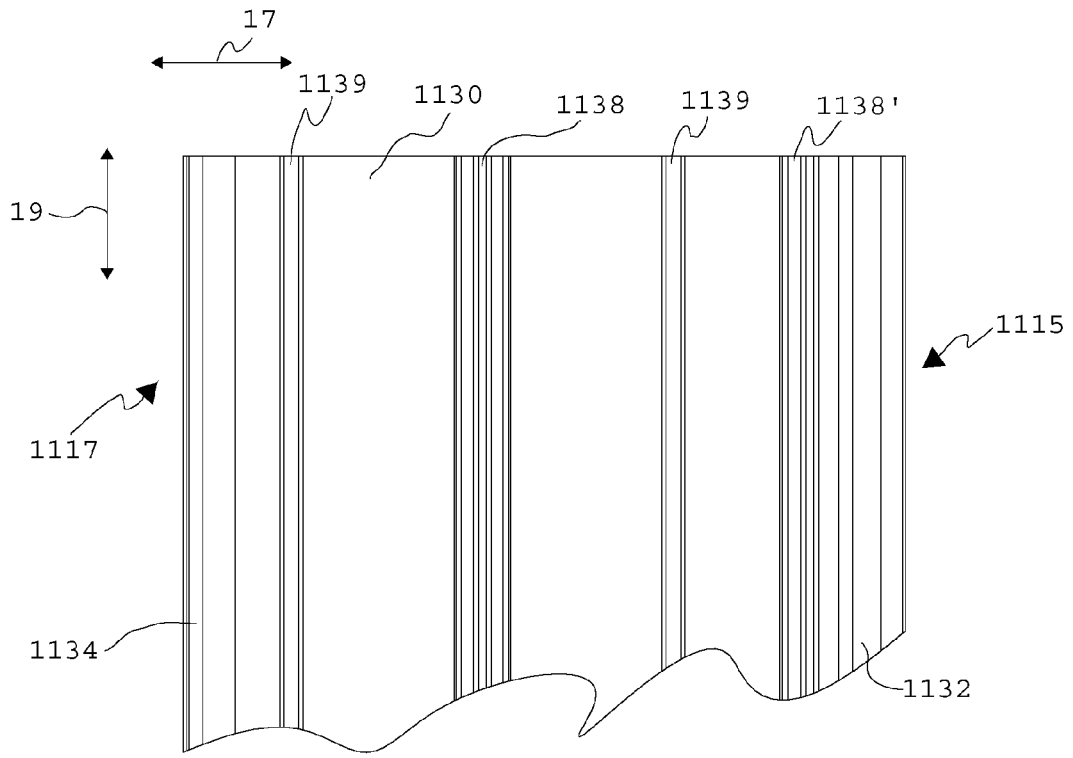
FIGS. 14A, 14B and 14C represent partial side plan views of the panels and the support members of the forms of FIGS. 11, 12 and 13 and of the tensioning components of the FIG. 12 and FIG. 13 forms.
Figure 14B:
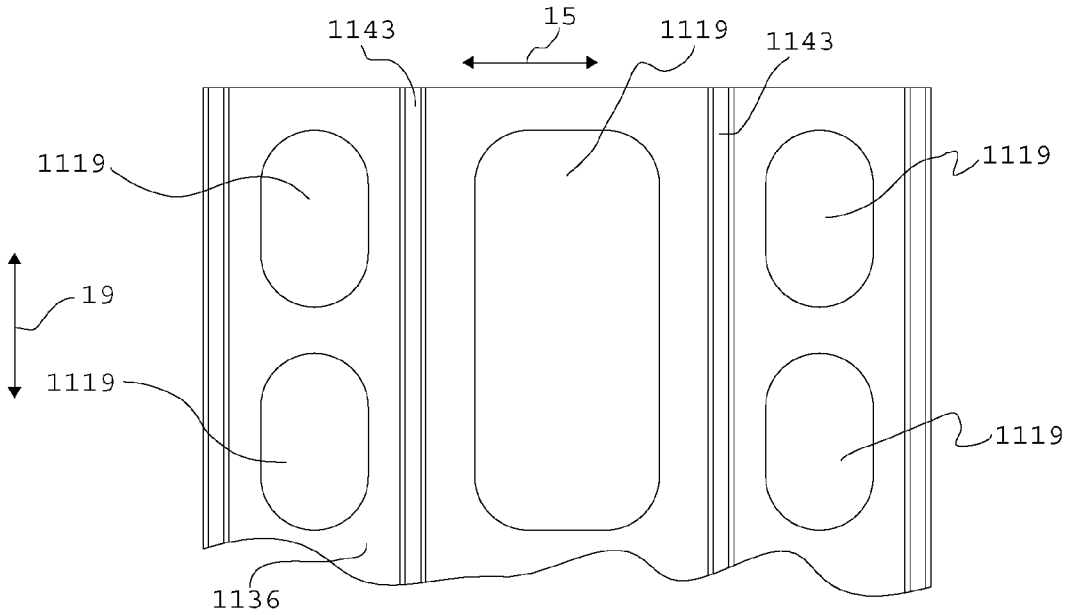

Form 1128 comprises a plurality of panels 1130 which are elongated in the longitudinal direction (i.e. the direction into and out of the page of FIG. 11 and the direction of double-headed arrow 19 of FIGS. 14A and 14B). Panels 1130 comprise inward facing surfaces 1131A and outward facing surfaces 1131B. In the FIG. 11 embodiment, all panels 1130 are identical to one another, but this is not necessary. In general, panels 1130 may have a number of features which differ from one another as explained in more particular detail below. As shown in FIGS. 11 and 15C-15G, panels 1130 incorporate first, generally female, contoured connector components 1132 at one of their transverse edges 1115 and second, generally male, contoured connector components 1134 at their opposing transverse edges 1117. In the illustrated embodiment, panels 1130 (including first and second connector components 1132, 1134) have a substantially uniform cross-section along their entire longitudinal length, although this is not necessary.

In some embodiments, panels 1130 are prefabricated to have different longitudinal dimensions. In other embodiments, the longitudinal dimensions of panels 1130 may be cut to desired length(s). Preferably, panels 1130 are relatively thin in the inward-outward direction (shown by double-headed arrow 15 of FIG. 11) in comparison to the inward-outward dimension of the resultant structures fabricated using form 1128. In some embodiments, the ratio of the inward-outward dimension of a structure formed by form 1128 to the inward-outward dimension of a panel 1130 is in a range of 10-600. In some embodiments, the ratio of the inward-outward dimension of a structure formed by form 1128 to the inward-outward dimension of a panel 1130 is in a range of 20-300.

As shown in FIG. 11 and explained further below, connector components 1132, 1134 may be joined together to form connections 1150 at transverse edges 1115, 1117 of panels 1130. Panels 1130 may thereby be connected in edge-adjacent relationship to form wall segments 1127, 1129. In the FIG. 11 embodiment, form 1128 comprises a pair of wall segments 1127, 1129 which extend in the longitudinal direction 19 and in the transverse direction (shown by double headed arrows 17 in FIGS. 11 and 14A). In some embodiments, the longitudinal direction is generally vertical and the transverse direction is generally horizontal, although this is not necessary. As explained in more particular detail below, one-sided forms according to the invention (the type used for tilt-up walls, for example) comprise only a single wall segment. In addition, structures fabricated using forms according to the invention are not limited to walls. In such embodiments, groups of edge-adjacent panels 1130 connected in edge-to-edge relationship at connections 1150 may be more generally referred to as form segments instead of wall segments. In the illustrated embodiment, wall segments 1127, 1129 are spaced apart from one another in the inward-outward direction 15 by an amount that is relatively constant, such that wall segments 1127, 1129 are generally parallel. This is not necessary. In some embodiments, wall segments 1127, 1129 need not be parallel to one another and different portions of forms according to the invention may have different inward-outward dimensions.

FIGS. 15A-15G schematically illustrate various magnified views of the connector components 1132, 1134 for implementing connections 1150 between edge-adjacent panels 1130A, 1130B of form 1128 and a method of coupling connector components 1132, 1134 to form such edge-to-edge connections 1150. Generally speaking, to form a connection 1150 between connector components 1132, 1134, edge-adjacent connector components 1132, 1134 (or panels 1130A, 1130B) are moved relative to one another such that connector components 1132, 1134 engage one another in an intermediate loose-fit connection and then edge-adjacent connector components 1132, 1134 (or panels 1130A, 1130B) are pivoted relative to one another (e.g. about an axis oriented in longitudinal direction 19) to lock connector components 1132, 1134 to one another in a snap-together fitting via restorative deformation forces. The movement of connector components 1132, 1134 (or panels 1130A, 1130B) relative to one another to form the intermediate loose-fit connection may involve: slidable movement of panels 1130A, 1130B relative to one another in longitudinal direction 19, a combination of moving panels 1130A, 1130B toward one another in transverse direction 17 with relative pivotal movement (e.g. about an axis oriented in longitudinal direction 19) and/or any other suitable relative movement of panels 1130A, 1130B (or connector components 1132, 1134) which achieves the loose-fit connection as described in more detail below. Once the loose-fit connection is achieved, edge-adjacent connector components 1132, 1134 (and/or panels 1130A, 1130B) are pivoted relative to one another (e.g. about an axis extending in longitudinal direction 19) to deform portions of connector components 1132, 1134, such that restorative forces tend to lock connector components 1132, 1134 to one another (e.g. providing a snap-together fitting) to thereby form connection 1150.

The loose-fit connection between connector components 1132, 1134 may be made by partially inserting a principal protrusion 1158 of connector component 1134 into a principal receptacle or recess 1154 of connector component 1132 (e.g. by relative sliding of panels 1130A, 1130B in a longitudinal direction 19, by a combination of relative movement of panels 1130A, 1130B in transverse directions 17 and relative pivotal movement of panels 1130A, 1130B and/or any other suitable technique). If relative sliding between panels 1130A, 1130B is used to make the loose-fit connection, the loose-fit connection may be made without substantial deformation of connector components 1132, 1134 and/or without substantial friction therebetween. Relative slidable movement between panels 1130A, 1130B is not the only way to make the loose-fit connection between connector components 1132, 1134. In some circumstances, the loose-fit connection may be made using other techniques which may or may not involve deforming portions of connector components 1132, 1134 to partially insert generally male connector component 1134 loosely into generally female connector component 1132. Once the loose-fit connection is made, connector components 1132, 1134 (or panels 1130A, 1130B) may be pivoted to resiliently deform one or more parts of connector components 132, 134 and eventually to reach a relative orientation where restorative deformation forces lock connector components 1132, 1134 to one another (e.g. in a snap-together fitting). In the loose-fit connection, connector components 1132, 1134 partially engage one another. The partial engagement of connector components 1132, 1134 may retain principal protrusion 1158 of connector component 1134 in recess 1154 of connector component 1132 such that connector components 1132, 1134 may be prevented from separating under the application of limited forces and/or under the application of force in a limited range of directions. By way of non-limiting example, in particular embodiments, once engaged in a loose-fit connection, connector components 1132, 1134 cannot be separated by the force of gravity acting on one of two panels 1130A, 1130B. In some embodiments such as that illustrated in FIGS. 11 and 15A-15G, once engaged in a loose-fit connection, connector components 1132, 1134 cannot easily be separated by forces applied to panels 1130A, 1130B in generally transverse opposing directions 17.

Figures 15A, 15B:
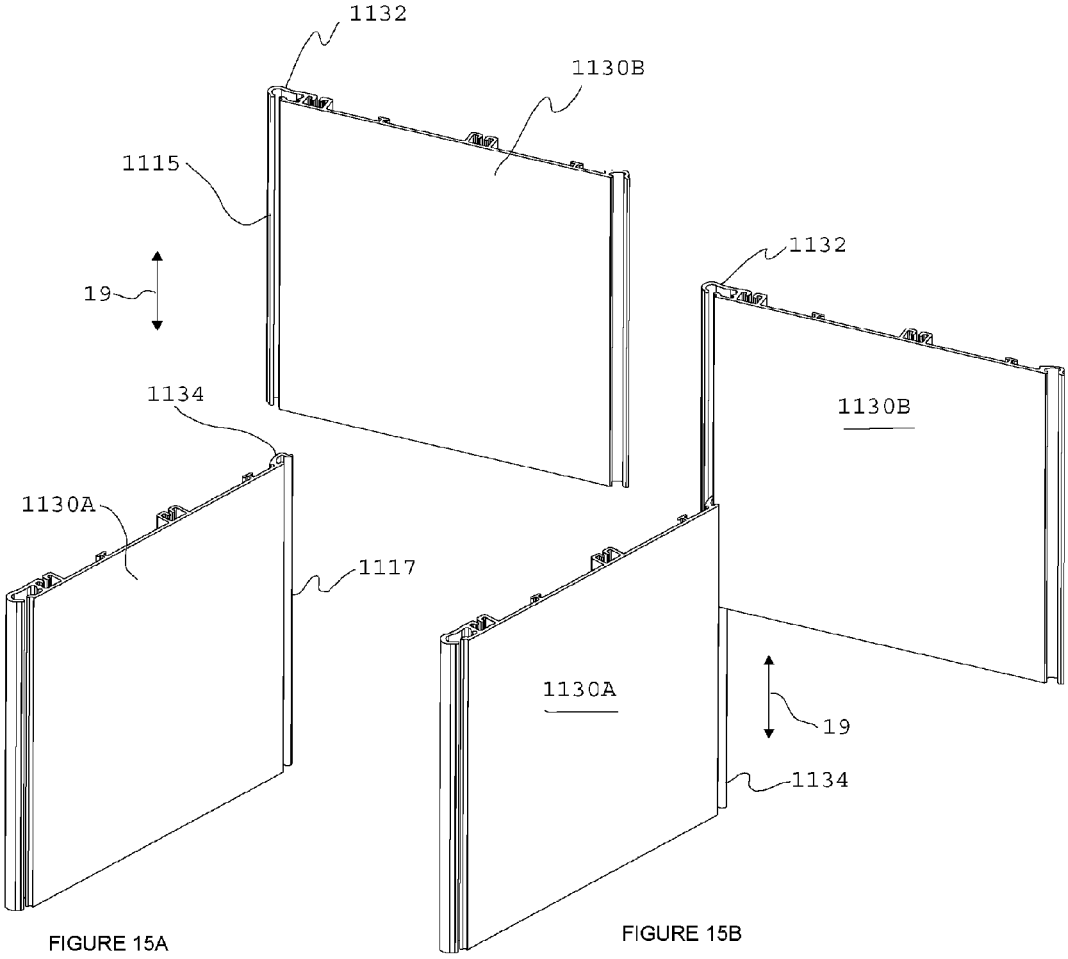
FIGS. 15A-15G represent various magnified views of the connector components for implementing the edge-to-edge connections between edge-adjacent panels of the forms of FIGS. 11, 12 and 13 and a method of coupling the connector components to form such edge-to-edge connections.
Figure 15C:
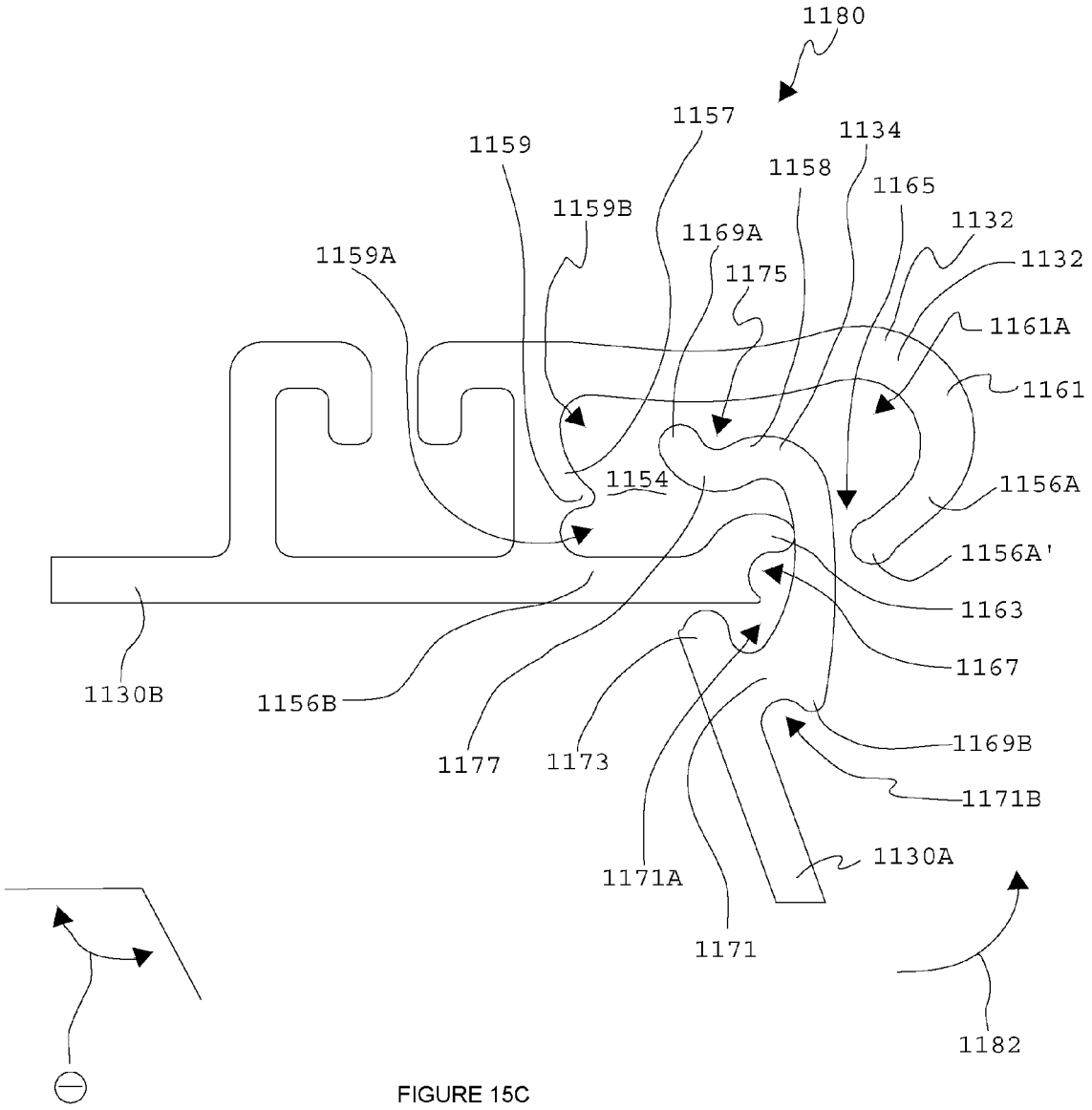

The features of connector components 1132, 1134 are shown best in FIG. 15C. Connector component 1132 is a part of (i.e. integrally formed with) panel 1130B and includes a pair of contoured arms 1156A, 1156B which join one another in region 1157 but are spaced apart from one another at their opposing ends to form principal recess 1154. Region 1157 may be referred to as bight 1157. In the illustrated embodiment, bight 1157 comprises a projection 1159 which projects into principal recess 1154 to define a pair of secondary recesses 1159A, 1159B within principal recess 1154 and contoured arm 1156 comprises a concave region 1161 which defines a third secondary recess 1161A within principal recess 1154. Contoured arm 1156B comprises a thumb 1163 at its distal end. Thumb 1163 projects toward a distal end 1156A' of contoured arm 1156A to define an opening 1165 to principal recess 1154 between the distal ends of arms 1156A, 1156B. In the illustrated embodiment, thumb 1163 is shaped to provide a fourth secondary recess 1167 located outside of primary recess 1154.

Connector component 1134 is a part of (i.e. integrally formed with) panel 1130A and includes a principal protrusion 1158 and a thumb 1173. Principal protrusion 1158 is contoured and, in the illustrated embodiment, principal protrusion 1158 comprises a pair of secondary protrusions 1169A, 1169B and a neck section 1171. Neck section 1171, thumb 1173 and a remainder of panel 1130A define a pair of opposing concavities 1171A, 1171B. Secondary protrusion 1169A is curved in a direction opposing the curvature of the remainder of principal protrusion 1158 to define a third concavity 1175.

The coupling of connector components 1132, 1134 to one another to form connection 1150 between panels 1130A, 1130B is now described with reference to FIGS. 15A-15G. Initially, as shown in FIG. 15A, panels 1130A, 1130B are separated from one another. A user brings panels 1130A, 1130B toward one another such that edge 1117 and connector component 1134 of panel 1130A are adjacent edge 1115 and connector component 1132 of panel 1130B. In some embodiments, as shown in FIG. 15A, panels 1130A, 1130B may be spaced from one another in longitudinal direction 19. Then, as shown in FIGS. 15B and 15C, a distal portion 1177 of principal protrusion 1158 may be inserted into principal recess 1154 (FIG. 15C) and panels 1130A, 1130B may be slid relative to one in longitudinal direction 19 (FIG. 15B) until panels 1130A, 1130B are longitudinally aligned with the desired orientation. The insertion of distal portion 1177 of principal protrusion 1158 into principal recess 1154 (FIG. 15C) may be referred to herein as a loose-fit connection 1180 between connector components 1132, 1134. In some embodiments or circumstances, loose-fit connection 1180 between connector components 1132, 1134 may be otherwise effected. For example, in some circumstances, distal portion 1177 of principal protrusion 1158 may be inserted into principal recess 1154 as shown in FIG. 15C by some combination of movement of panels 1130A, 1130B toward one another in transverse direction 17 and relative pivotal movement of panels 1130A, 1130B about an axis oriented in longitudinal direction 19. In other circumstances, other techniques may be used to achieve loose fit connection 1180 shown in FIG. 15C.

As can be appreciated from viewing FIG. 15C, when panel connector components 1132, 1134 are arranged in loose-fit connection 1180, panels 1130A, 1130B can be slid in longitudinal direction 19 (into and out of the page in FIG. 15C) without substantial friction between connector components 1132, 1134 and without substantial deformation of connector components 1132, 1134. This lack of substantial friction and deformation facilitates easy relative sliding motion between connector components 1132, 1134 in longitudinal direction 19, even where panels 1130A, 1130B are relatively long (e.g. the length of one or more stories of a building) in longitudinal direction 19. In some embodiments, as shown in FIG. 15C for example, the relative interior angle è between panels 1130A, 1130B when connector components 1132, 1134 are in loose-fit connection 1180 is in a range of 30-150. In other embodiments, this angular range between panels 1130A, 1130B when connector components 1132, 1134 are in loose-fit connection 1180 is in a range of 90-150. In still other embodiments, this angular range between panels 1130A, 1130B when connector components 1132, 1134 are in loose-fit connection 1180 is in a range of 120-150. In some embodiments, when connector components 1132, 1134 are arranged in loose-fit connection 1180 and panels 1130A, 1130B have the above-discussed angular orientations, it is not possible to separate panels 1130A, 1130B without changing their relative angular orientations or deforming connector components 1132, 1134.

Figure 15D:
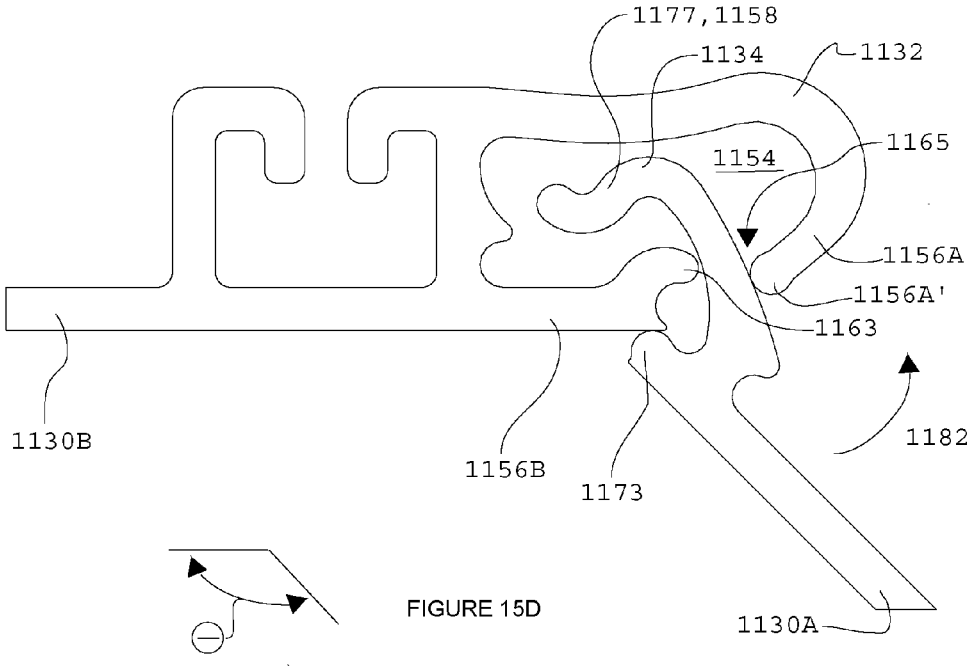

Once panels 1130A, 1130B are longitudinally aligned with the desired orientation (e.g. by sliding within loose-fit connection 1180), a user effects relative pivotal (or quasi pivotal) motion (see arrow 1182) between panels 1130A, 1130B (or, more particularly, connector components 1132, 1134) until connector components 1132, 1134 achieve the configuration of FIG. 15D. This relative pivotal motion may be about an axis that is oriented in longitudinal direction 19. In the configuration of FIG. 15D, the relative pivotal movement of panels 1130A, 1130B causes contact between one or more of: distal end 1156A' of contoured arm 1156A and principal protrusion 1158; thumb 1173 and contoured arm 1156B; and thumb 1163 and principal protrusion 1158. In the illustrated view of FIG. 15D, contact is made in at least two of these locations. This contact tends to prevent further relative pivotal motion between panels 1130A, 1130B, unless one or more parts of connector components 1132, 1134 are forced to deform. In currently preferred embodiments, the relative interior angle è between panels 1130A, 1130B when connector components 1132, 1134 begin to deform is in a range of 90-150.

Figure 15E:
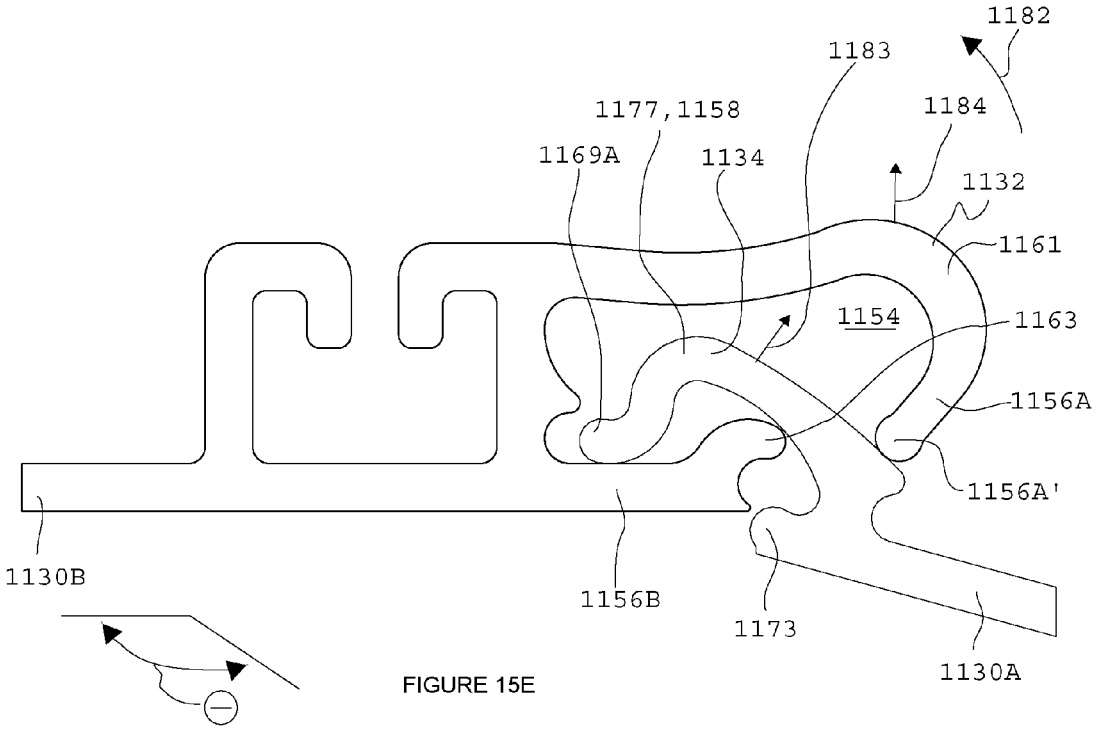

The user continues to effect relative pivotal motion (arrow 1182) between panels 1130A, 1130B (and/or between connector components 1132, 1134) such that one or more parts of connector components 1132, 1134 deforms. This deformation is shown in FIG. 15E. In the configuration of FIG. 15E, contact between principal protrusion 1158 and distal end 1156A' of contoured arm 1156A causes deformation of connector component 1132, such as deformation of concave region 1161 of contoured arm 1156A in the direction indicated by arrow 1184. In addition, contact between secondary protrusion 1169A and arm 1156B and/or contact between thumb 1163 and principal protrusion 1158 causes deformation of connector component 1134, such as deformation of principal protrusion 1158 in the direction indicated by arrow 1183. In currently preferred embodiments, the relative interior angle è between panels 1130A, 1130B when connector components 1132, 1134 have deformed as shown in FIG. 15E is in a range of 130-170.

Figure 15F:
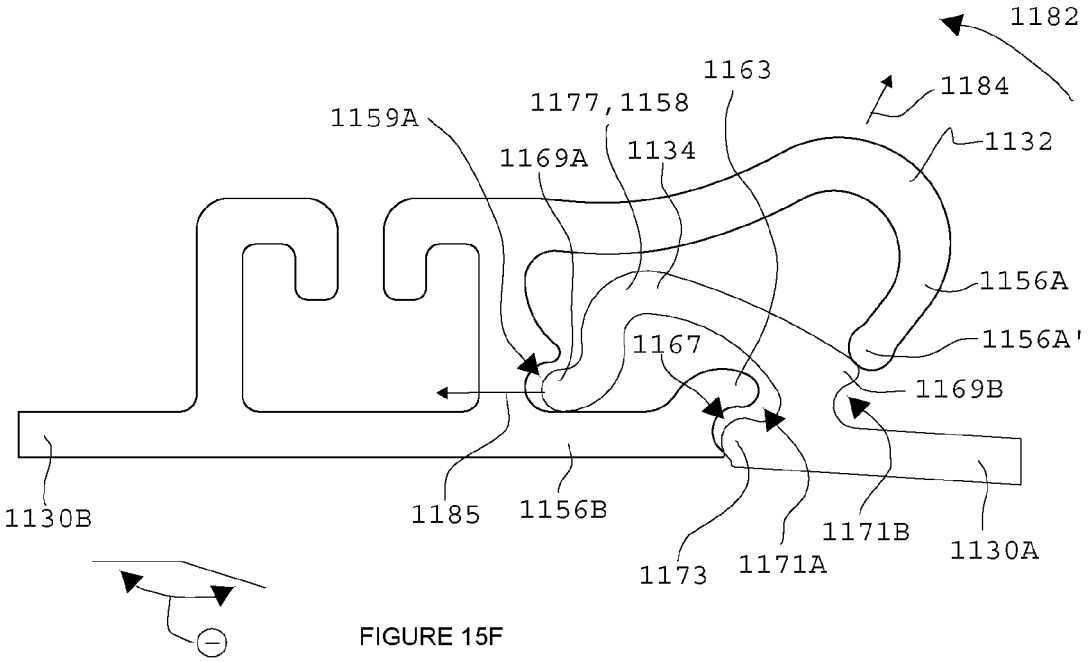

Deformation of connector components 1132, 1134 continues as the user continues to effect relative pivotal motion between panels 1130A, 1130B (and/or connector components 1132, 1134) in direction 1182. In the illustrated view of FIG. 15F, distal end 1156A' of arm 1156A is abutting against secondary protrusion 1169B of connector component 1134 to cause maximal deformation of arm 1156A of connector component 1132 in direction 1184. Also, as shown in FIG. 15F, principal protrusion 1158 deforms such that secondary protrusion 1169A tends to slide along arm 1156B in direction 1185 toward secondary recess 1159A. With the continued pivotal motion between panels 1130A, 1130B (and connector components 1132, 1134) as shown in FIG. 15F, thumb 1173 tends to move into secondary recess 1167 and thumb 1163 tends to move into concavity 1171A. In particular embodiments, the relative interior angle è between panels 1130A, 1130B when connector components 1132, 1134 have deformed as shown in FIG. 15F is in a range of 160-178.

Figure 15G:
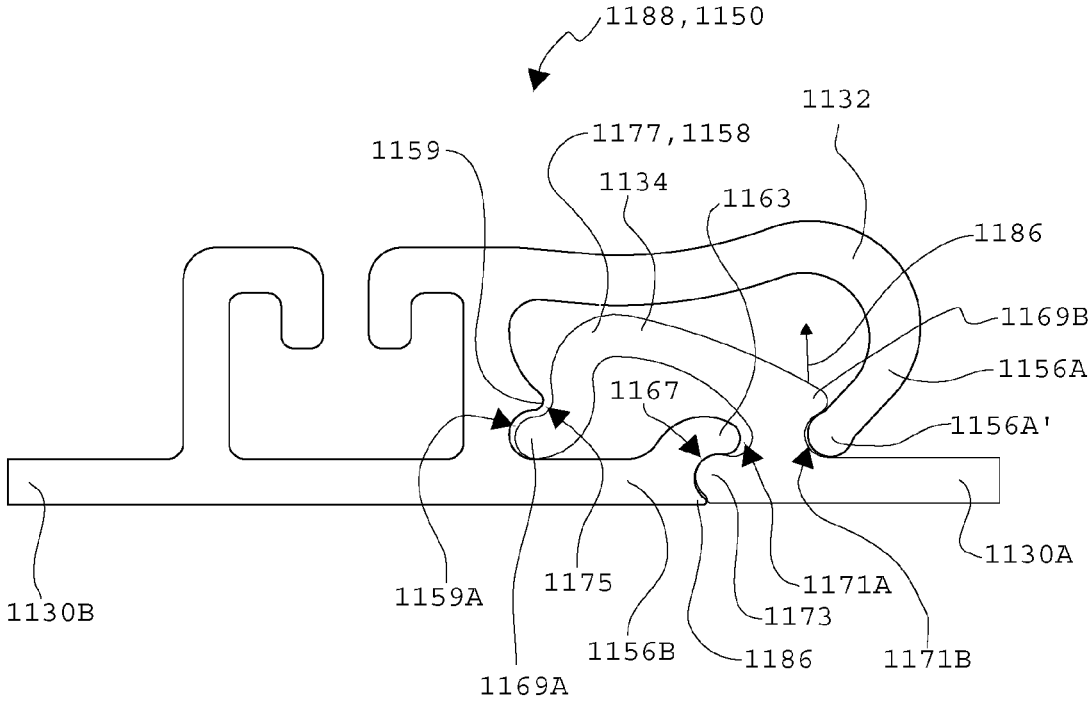

The user continues to effect relative pivotal motion between panels 1130A, 1130B (and/or connector components 1132, 1134) as shown by arrow 1182 until distal end 1156A' of arm 1156A passes secondary protrusion 1169B as shown in FIG. 15G. Having regard to both FIGS. 15F and 15G, when distal end 1156A' of arm 1156A is pivoted past secondary protrusion 1169B, distal end 1156A' of arm 1156A is permitted to move into concavity 1171B. Because of the above-described deformation of arm 1156A of connector component 1132 during relative pivotal motion of panels 1130A, 1130B, restorative deformation forces (i.e. the forces that tend to restore connector component 1132 to its original non-deformed configuration) tend to force distal end 1156A' of arm 1156A into concavity 1171B—i.e. to provide a snap-together fitting.

As distal end 1156A' of arm 1156A moves into concavity 1171B, this allows principal protrusion 1158 to move into principal recess 1154 in the direction shown by arrow 1186. Because of the above-described deformation of principal protrusion 1158 of connector component 1134 during relative pivotal motion between panels 1130A, 1130B, restorative deformation forces associated with connector component 1134 tend to force secondary protrusion 1169A into secondary recess 1159A—i.e. to provide a snap-together fitting.

At substantially the same time as the restorative deformation forces act on connector component 1132 to force distal end 1156A' of arm 1156A into concavity 1171B and on connector component 1134 to force secondary protrusion 1169A into secondary recess 1159A, thumb 1173 tends to move into secondary recess 1167 and thumb 1163 tends to move into concavity 1171A.

With this movement, connector components 1132, 1134 (and panel 1130A, 1130B) achieve the locked configuration 1188 shown in FIG. 15G where the relative interior angle è between panels 1130A, 1130B is approximately 180. In some embodiments, the relative interior angle è between panels 1130A, 1130B is in a range of 175-185 when connector components 1132, 1134 achieve the locked configuration 1188. Locked configuration 1188 may be referred to as a connection 1150 between connector components 1132, 1134. Between the configuration of FIG. 15F and locked configuration 1188 of FIG. 15G, there may be a limited relative linear motion of panels 1130A, 1130B (e.g. in the direction of arrow 1185 (FIG. 15F)) as the various aforementioned parts of connector components 1132, 1134 move into locked configuration 1188.

When connector components 1132, 1134 are in locked configuration 1188, connector components 1132, 1134 may still be slightly deformed from their nominal states, such that restorative deformation forces continue to force one or more of: distal end 1156A' of arm 1156A into concavity 1171B; secondary protrusion 1169A into secondary recess 1159A; thumb 1173 into secondary recess 1167; and thumb 1163 into concavity 1171A. However, preferably, the strain on these parts of connector components 1132, 1134 is not sufficient to degrade the integrity of connector components 1132, 1134.

When connector components 1132, 1134 are in locked configuration 1188, connector components 1132, 1134 are shaped to provide several interleaving parts. For example, as can be seen from FIG. 15G:

- when secondary protrusion 1169A projects into secondary recess 1159A, secondary protrusion is interleaved between contoured arm 1156B and projection 1159;
- when projection 1159 extends into concavity 1175, projection 1159 is interleaved between secondary protrusion 1169A and a remainder of principal protrusion 1158;
- when thumb 1163 projects into concavity 1171A, thumb 1163 is interleaved between thumb 1173 and principal protrusion 1158;
- when thumb 1173 projects into secondary recess 1167, thumb 1173 is interleaved between thumb 1163 and projection 1189; and
- when distal end 1159A' of contoured arm 1156A projects into concavity 1171B, distal end 1159A' is interleaved between secondary projection 1169B and the remainder of panel 1130A.

The interleaving parts of components 1132, 1134 may provide connection 1150 with a resistance to unzipping and may prevent or minimize leakage of fluids (e.g. liquids and, in some instances, gases) through connector 1150.

In some embodiments, a sealing material (not shown) may be provided on some surfaces of connector components 1132, 1134. Such sealing material may be relatively soft (e.g. elastomeric) when compared to the material from which the remainder of panel 1130 is formed. Such sealing materials may be provided using a co-extrusion process or coated onto connector components 132, 1134 after fabrication of panels 1130, for example, and may help to make connection 1150 impermeable to liquids or gasses. By way of non-limiting example, such sealing materials may be provided: on distal end 1156A' of arm 1156A; in concavity 1171B; on secondary protrusion 1169A; in secondary recess 1159A; on thumb 1173; in secondary recess 1167; on thumb 1163; and/or in concavity 1171A. Suitable surface textures (as described above) may also be applied to these or other surfaces of connector components 1132, 1134 as described above to enhance the seal or the friction between components 1132, 1134.

Referring back to FIG. 11, in the illustrated embodiment, form 1128 comprises support members 1136 which extend between wall segments 1127, 1129. Support members 1136 are also shown in FIG. 14B. Support members 1136 comprise connector components 1142 at their edges for connecting to corresponding connector components 1138 on inward surfaces 1131A of panels 1130. Support members 1136 may brace opposing panels 1130 and connect wall segments 1127, 1129 to one another.

In the illustrated embodiment, connector components 1138 on inward surfaces 1131A of panels 1130 comprise a pair of J-shaped legs (not specifically enumerated) which together provide a female shape for slidably receiving H-shaped male connector components 1142 of support members 1136. This is not necessary. In general, where form 1128 includes support members 1136, connector components 1138,1142 may comprise any suitable complementary pair of connector components and may be coupled to one another by sliding, by deformation of one or both connector components or by any other suitable coupling technique. By way of non-limiting example, connector components 1138, 1142 may comprise male T-shaped connectors and female C-shaped connectors which may be slidably coupled to one another as with connectors 138, 142 of form 128 (FIG. 3) described above.

In the illustrated embodiment of FIG. 11, each panel 1130 comprises a generally centrally located connector component 1138. Connector components 1138 facilitate connection to support members 1136 as discussed above. In the illustrated embodiment, each panel 1130 also comprises an additional optional connector component 1138' located adjacent to, and in the illustrated embodiment immediately adjacent to and sharing parts with, connector component 1132. As shown in FIG. 11, connector component 1138' are substantially similar in shape to connector components 1138. Accordingly, in some embodiments, where it is desired to provide form 1128 with additional strength or to increase the strength of form 1128 in the regions of connections 1150, support members 1136 may be coupled between opposing wall segments 1127, 1129 at connector components 1138' in addition to, or in the alternative to, connector components 1138. Connector components 1138' are optional. In some embodiments, connector components 1138' are not present. In the remainder of this description, except where specifically noted, connector components 1138 and connector components 1138' will be referred to collectively as connector components 1138.

In general, panels 1130 may be provided with any suitable number of connector components 1138 to enable the connection of a corresponding number of support members 1136, as may be necessary for the particular strength requirements of a given application. In addition, the mere presence of connector components 1138 on panels 1130 does not necessitate that support members 1136 are connected to each such connector component 1138. In general, the spacing of support members 1136 may be determined as necessary for the particular strength requirements of a given application and to minimize undesirably excessive use of material.

Support members 1136 may be apertured (see apertures 1119 of FIG. 14B) to allow liquid concrete to flow in transverse directions 17 between wall segments 1127, 1129. Although not explicitly shown in the illustrated views, rebar may also be inserted into form 1128 prior to placing liquid concrete in form 1128. Where required or otherwise desired, transversely extending rebar can be inserted to extend through apertures 1119 in support members 1136. If desired, longitudinally extending rebar can then be coupled to the transversely extending rebar.

Figure 12:
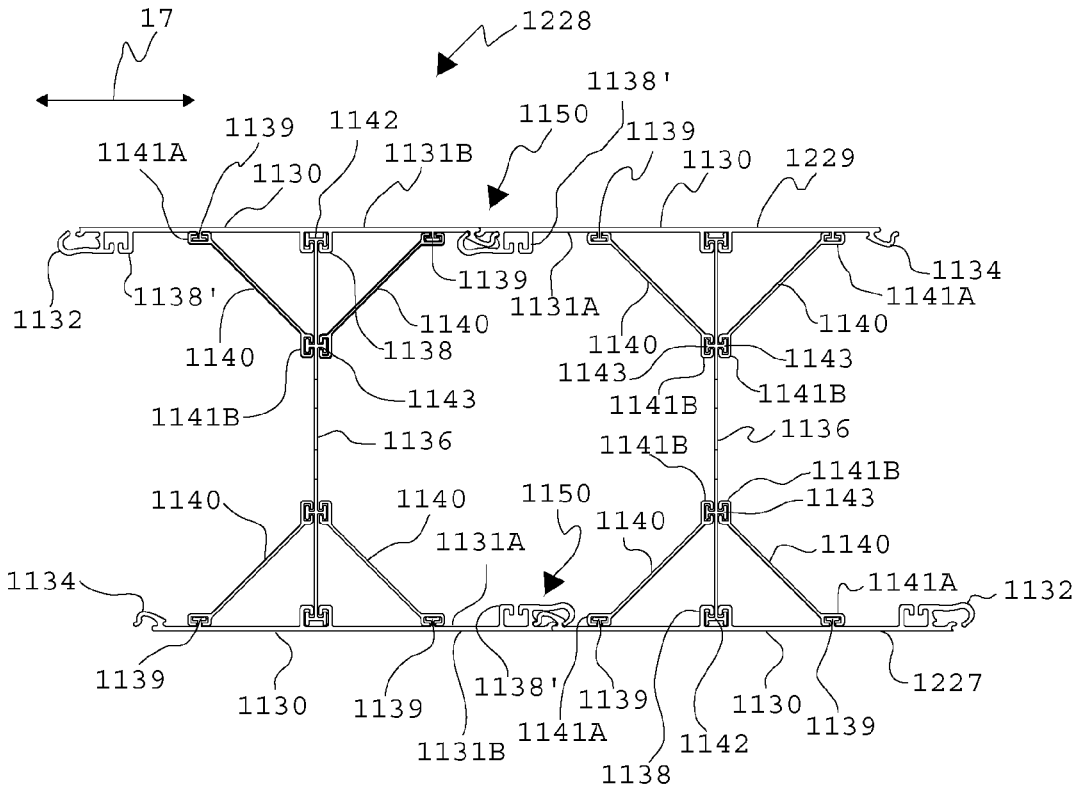
FIG. 12 is a plan view of a modular stay-in-place form according to yet another particular embodiment of the invention.
Figure 14C:
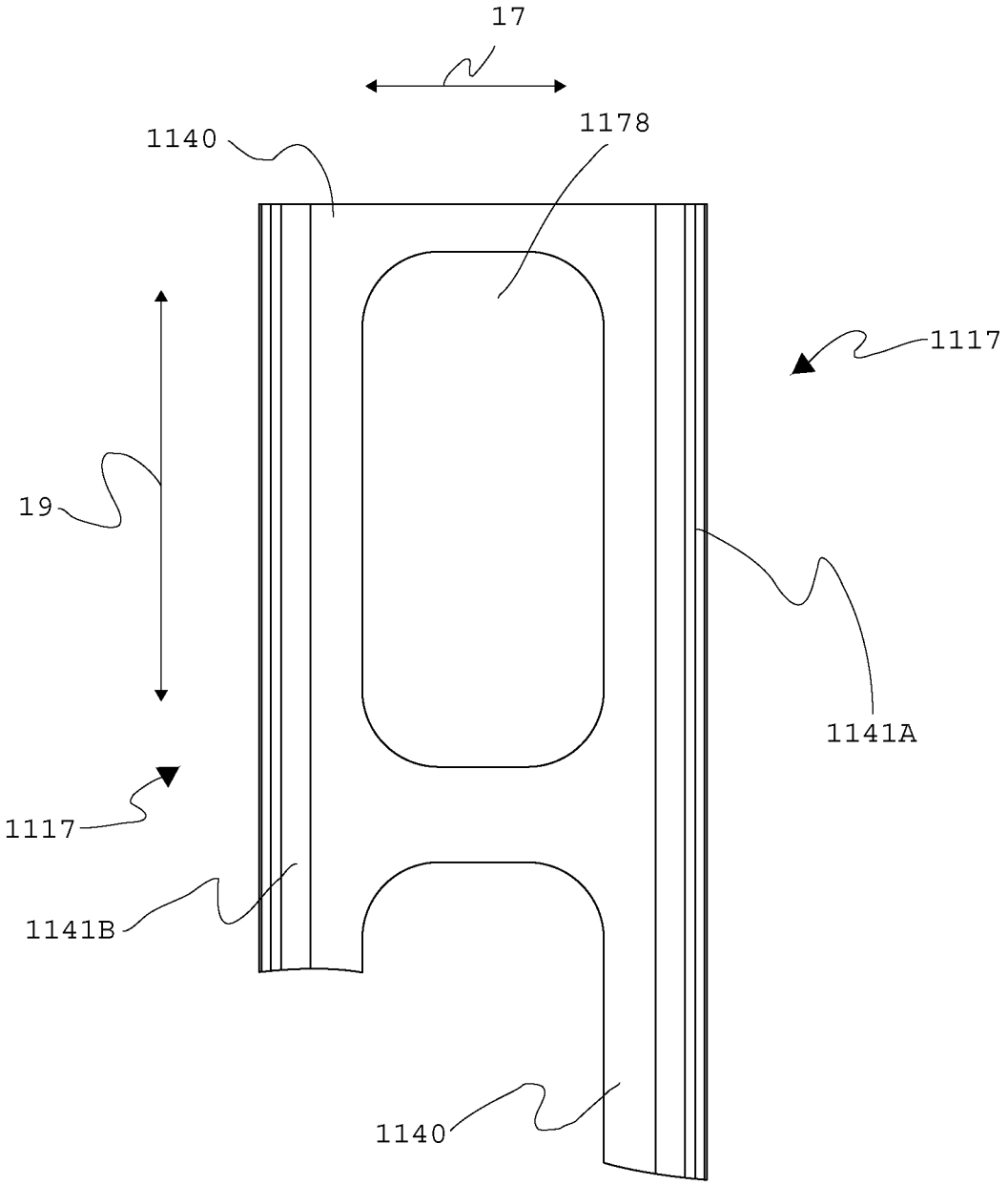

FIG. 12 is a partial plan view of a modular stay-in-place form 1228 according to another particular embodiment of the invention which may be used to form a wall of a building or other structure. Form 1228 of FIG. 12 incorporates panels 1130 and support members 1136 which are substantially identical to panels 1130 and support members 1136 of form 1128 and similar reference numbers are used to refer to the similar features of panels 1130 and support members 1136. Panels 1130 are connected as described above (at connections 1150) in edge-adjacent relationship to provide wall segments 1227, 1229. Form 1228 differs from form 1128 in that form 1228 incorporates tensioning members 1140 which are not present in form 1128. Tensioning members 1140 are also illustrated in FIG. 14C. Tensioning members 1140 extend at an angle between support members 1136 and panels 1130 and may provide form 1228 with increased strength and may help to prevent pillowing of panels 1130 when form 1228 is filled with concrete.

Tensioning members 1140 incorporate connector components 1141A, 1141B at their respective ends for connection to complementary connector components 1139 on inward surfaces 1131A of panels 1130 and complementary connector components 1143 on transverse surfaces of support members 1136. In the FIG. 12 embodiment, connector components 1141A, 1141B on tensioning members 1140 are provided with a female C-shape for slidably receiving T-shaped male connector components 1139, 1143 of panels 1130 and support members 1136. This is not necessary. In general, where form 1128 includes tensioning members 1140, connector components 1141A, 1139 and connector components 1141B, 1143 may comprise any suitable complementary pairs of connector components and may be coupled to one another by sliding, by deformation of one or both connector components or by any other suitable coupling technique.

Tensioning members 1140 may comprise apertures 1178 which allow concrete flow and for the transverse extension of rebar therethrough (see FIG. 14C).

As mentioned above, support members 1136 may be connected between connector components 1138' on opposing wall segments 1227, 1229. Since connector components 1138' are closer to connections 1150 (relative to centrally located connector components 1138), the provision of support members 1136 between connector components 1138' acts to reinforce connections 1150. Although not explicitly shown, where support members 1136 are connected between connector components 1138' and tensioning members 1140 are provided to extend between connector components 1139 on panels 1130 and connector components 1143 on support member 1136, tensioning members 1140 may extend transversely across connection 1150—i.e. from connector component 1139 on a first panel 1130 on one transverse side of connection 1150 across connection 1150 to a connector component 1143 on support member 1136 on the opposing transverse side of connection 1150 in a manner similar to tensioning members 140 of form 228 (FIG. 4). In this manner, tensioning members 1140 can be made to reinforce connections 1150 between panels 1130 and help to prevent unzipping of connections 1150.

In some embodiments, tensioning members 1140 are not necessary. Tensioning members 1140 need not generally be used in pairs. By way of non-limiting example, some forms may use only tensioning members 1140 which are configured to span connections 1150. In some embodiments, support members 1136 and/or tensioning members 1140 may be employed at different spacings within a particular form. Form 1228 incorporates components (i.e. panels 1130 and support members 1136) which are substantially similar to the components of form 1128 described herein. In various different embodiments, form 1228 may be modified as discussed herein for form 1128.

In operation, forms 1128, 1228 may be used to fabricate a wall or other structure by moving panels 1130 relative to one another as discussed above to form loose-fit connections 1180 between connector components 1132, 1134 and then pivoting panels 1130 (and connector components 132, 134) relative to one another to put connector components 1132, 1134 into their locked configuration 1188, thereby forming connections 1150 between edge-adjacent panels 1130. Once, panels 1130 are assembled into wall segments 1127, 1129 or 1227, 1229, support members 1136 may be added by slidably connecting connector components 1142 of support members 1136 to connector components 1138 of panels 1130. Support members 1136 connect wall segments 1127, 1129 or 1227, 1229 to one another. If it is desired to include tensioning members 1140, tensioning members 1140 may then be attached between connector components 1143 of support members 1136 and connector components 1139 of panels 1130. Panels 1130, support members 1136 and tensioning members 1140 (if present) may be connected to one another in any orientation and may then be placed in a desired orientation after such connection. Walls and other structures fabricated from panels 1130 generally extend in two dimensions (referred to herein as the longitudinal dimension (see arrow 19 of FIGS. 14A and 14B) and the transverse dimension (see arrow 17 of FIG. 11)). However, it will be appreciated that walls and other structures fabricated using forms 1128, 1228 can be made to extend in any desired orientation and, as such, the terms "longitudinal", "transverse" and similar terms as used herein should be understood to describe relative directions (i.e. directions relative to one another). In some embodiments, longitudinal directions are generally vertical and transverse directions are generally horizontal, but this is not strictly necessary. In some embodiments, panels 1130 may be deformed or may be prefabricated such that their transverse extension has some curvature.

If necessary or otherwise desired, transversely extending rebar and/or longitudinally extending rebar can then be inserted into any of the forms described herein, including forms 1128, 1228. After the insertion of rebar, liquid concrete may be placed into form 1128, 1228. When the liquid concrete cures, the result is a structure (e.g. a wall) that has two of its surfaces covered by stay-in-place form 1128, 1228.

Figure 16A:
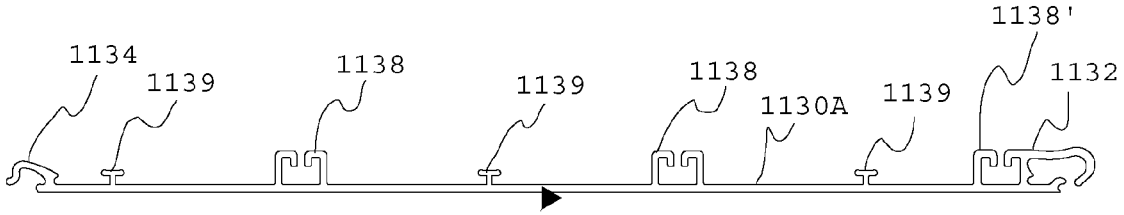
FIGS. 16A-16C are plan views showing modular panels of the type used in the forms of FIGS. 11, 12 and 13 and having different transverse dimensions.
Figure 16B:
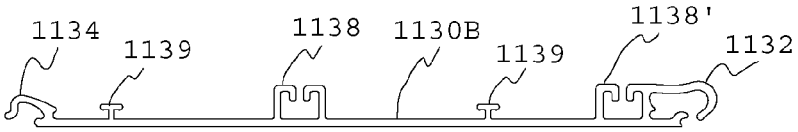
Figure 16C:
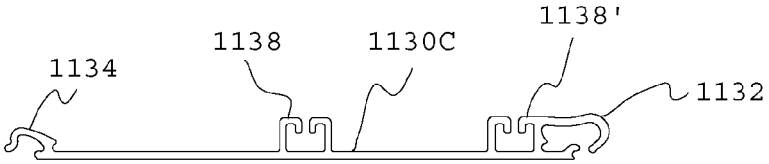

Panels 1130 of forms 1128, 1228 may be provided in modular units with different transverse dimensions as shown in FIGS. 16A-16C. Panel 1130B of FIG. 16B represents panel 1130 shown in the illustrated embodiments of forms 1128, 1228 (FIGS. 11 and 12). However, panels 1130 may be provided with smaller transverse dimensions (as shown in panel 1130C of FIG. 16C) or with larger transverse dimensions (as shown in panel 1130A of FIG. 16A). In the illustrated embodiment, large panel 1130A comprises an additional connector component 1138 and an additional connector component 1139 when compared to panel 1130B. This is not necessary. In some embodiments, larger panel 1130A may be made larger without additional connector components. In other embodiments, panels may be fabricated with transverse dimensions greater than that of panel 1130A and, optionally, with more connector components 1138 and/or connector components 1139. In the illustrated embodiment, small panel 1130C has had connector components 1139 removed. This is not necessary. In some embodiments, smaller panel 1130C may be made smaller without removing connector components 1139. In some embodiments, panels may be fabricated with transverse dimensions less than that of panel 1130C.

Figure 17A:
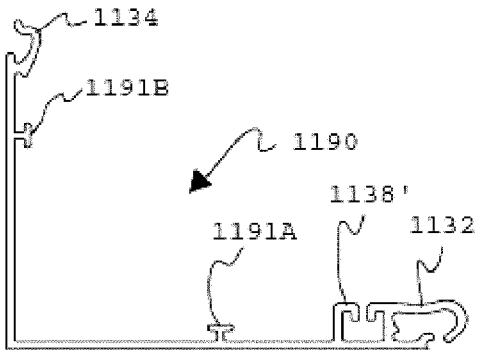
FIGS. 17A and 17B are plan views of an outside corner element and an inside corner element suitable for use with the forms of FIGS. 11 and 12.
Figure 17B:
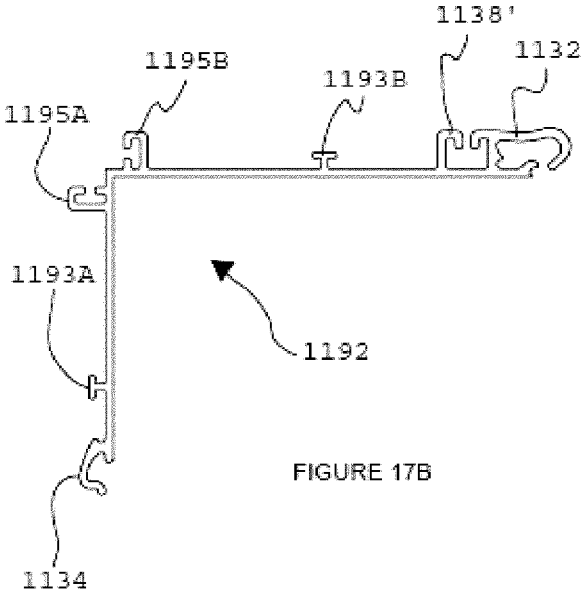
Figure 17C:
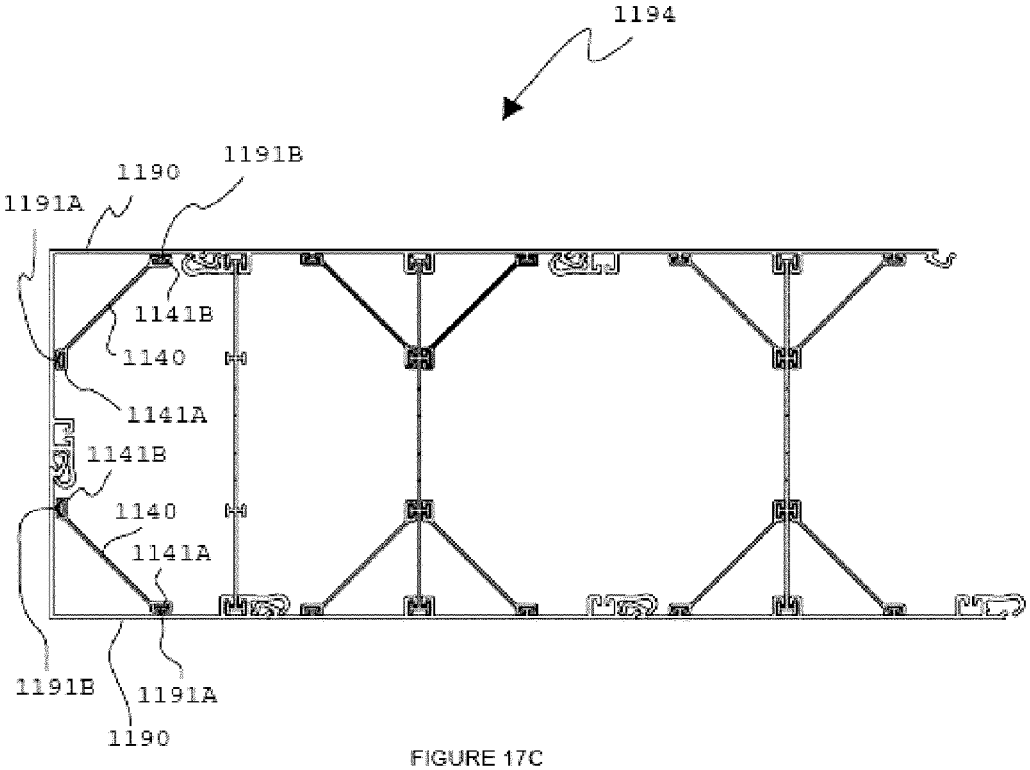
FIG. 17C is a plan view of a wall end incorporating a pair of FIG. 17A outside corner elements.
Figure 17D:
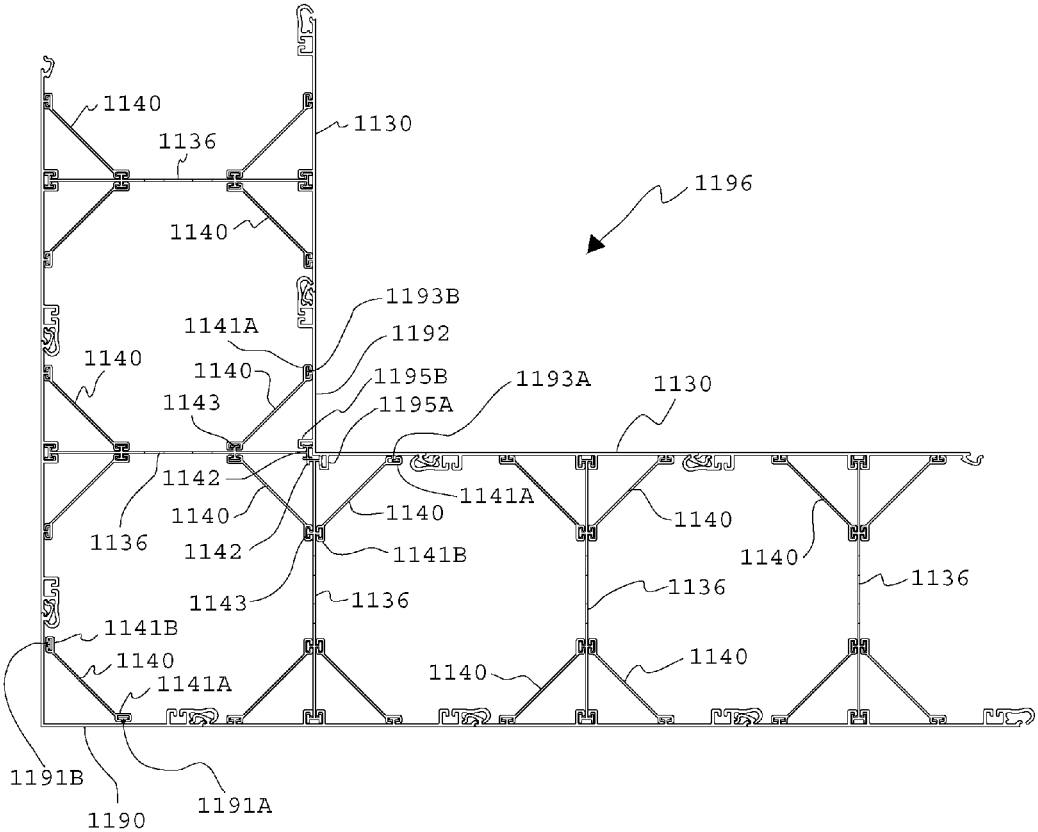
FIG. 17D is a plan view of a form incorporating the outside and inside corner elements of FIGS. 17A and 17B.

FIGS. 17A and 17B are plan views of an outside 90 corner element 1190 and an inside 90 corner element 1192 suitable for use with the forms of FIGS. 11 and 14. FIG. 17C is a partial plan view of a form 1194 which incorporates a pair of outside corner elements 1190 to provide the end of a wall and FIG. 17D is a partial plan view of a form 1196 incorporating an outside corner element 1190 and an inside corner element 1192 to provide a 90 corner in a wall.

In the illustrated embodiment, outside corner element 1190 comprises a connector component 1132 at one of its edges and a connector component 1134 at its opposing edge. Similarly, the illustrated embodiment, inside corner element 1192 comprises a connector component 1132 at one of its edges and a connector component 1134 at its opposing edge. Connector components 1132, 1134 are substantially similar to connector components 1132, 1134 on panels 1130 and are used in a manner similar to that described above to connect corner components 1190, 1192 to panels 1130 or to other corner components 1190, 1192. Outside corner element 1190 also comprises a pair of connector components 1191A, 1191B for connection to corresponding connector components 1141A, 1141B of tensioning members 1140. As shown in FIGS. 17C and 17D, a tensioning member 1140 may optionally be connected between connector components 1191A, 1191B to provide increased strength to outside corner element 1190. In the illustrated embodiment connector components 1191A, 1191B are T-shaped male connector components for slidably engaging C-shaped female connector components 1141A, 1141B of tensioning members 1140. In general, however, connector components 1191A, 1191B, 1141A, 1141B may comprise any suitable complementary pairs of connector components and may be coupled to one another by sliding, by deformation of one or both connector components or by any other suitable coupling technique.

Inside corner element 1192 may comprise a pair of connector components 1193A, 1193B for connection to corresponding connector components 1141A of tensioning members 1140 and connector components 1195A, 1195B for connection to corresponding connector components 1142 of support members 1136. As shown in FIG. 17D, an inside corner may be formed by: connecting a pair of support members 1136 between connector components 1195A, 1195B and corresponding connector components 1138 on outside panels 1130; connecting a pair of tensioning members 1140 between connector components 1193A, 1193B and connector components 1143 of the pair of support members 1316; and connecting a tensioning member 1140 between connector components 1143 of the pair of support members 1136. It should be noted that in the illustrated embodiment, connector components 1195A, 1195B are C-shaped female connector components which receive only one of the two halves of H-shaped male connector components 1142 of support members 1136. In the illustrated embodiment, connector components 1193A, 1193B, 1195A, 1195B, 1141, 1142 are slidably engaging connector components. In general, however, connector components 1193A, 1193B, 1195A, 1195B, 1141, 1142 may comprise any suitable complementary pairs of connector components and may be coupled to one another by sliding, by deformation of one or both connector components or by any other suitable coupling technique.

Figure 13:
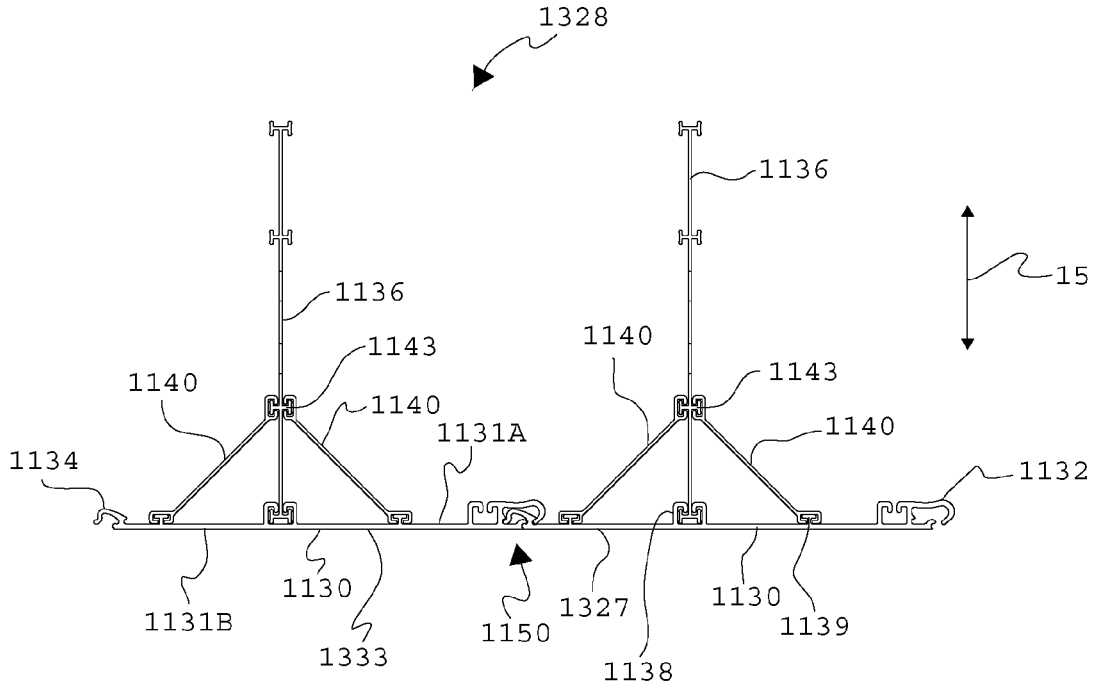
FIG. 13 is a plan view of a modular stay-in-place one-sided form which may be used to fabricate a tilt-up wall according to another embodiment of the invention.

FIG. 13 shows a one-sided modular stay-in-place form 1328 according to a particular embodiment of the invention which may be used to fabricate structures cladded on one side by stay-in-place form. One-sided forms, such as form 1328, may be used to fabricate tilt-up walls, for example. The modular components of form 1328 (FIG. 13) and their operability are similar in many respects to the modular components of form 1228 (FIG. 12). In particular, in the illustrated embodiment, form 1328 incorporates panels 1130, support members 1136 and tensioning members 1140 which are similar to panels 1130, support members 1136 and tensioning members 1140 of form 1228 and are connected to one another as described above to form a single wall segment 1327 that is substantially similar to wall segment 1227 of form 1228. Form 1328 differs from form 1228 in that form 1328 does not include panels 1130 to form a wall segment that opposes wall segment 1327 (i.e. form 1328 comprises a single-sided form and does not include an opposing wall segment like wall segment 1229 of form 1228). In addition, form 1328 differs from form 1228 in that form 1328 only includes tensioning members 1140 that connect to wall segment 1327 (i.e. form 1328 does not include tensioning members 1140 that attach to an opposing wall segment like wall segment 1229 of form 1228).

In operation, form 1328 is assembled by coupling connector components 1132, 1134 of panels 1130 together as described above to provide connections 1150 and to fabricate a single wall segment 1327. In form 1328, support members 1136 and tensioning members 1140 are then coupled to panels 1130 as described above for form 1228, except that the coupling between connector components 1142 and connector components 1138 is made at one side only and tensioning members 1140 are coupled to support members 1136 (at connector components 1141B, 1143) and to panels 1130 (at connector components 1141A, 1139) at one side only.

Form 1328 may be assembled on or otherwise moved onto a generally horizontal table or the like, such that outward facing surfaces 1131B of panels 1130 are facing downward and the longitudinal and transverse extension of panels 1130 is in the generally horizontal plane of the table. The table may be a vibrating table. In some embodiments, a table is not required and a suitable, generally horizontal surface may be used in place of a table. If required, rebar may be inserted into form 1328 while the form is horizontally oriented. Transversely extending rebar may project through apertures 1119 of support members 1136 and apertures 1178 of tensioning members 1140. Edges (not shown) of form 1328 may be fabricated on the table in any suitable manner, such as using conventional wood form. Concrete is then poured into form 1328 and allowed to flow through apertures 1119 of support members 1136 and through apertures 1178 of tensioning members 1140. The liquid concrete spreads to level itself (perhaps with the assistance of a vibrating table) in form 1328.

The concrete is then allowed to cure. Once cured, the resultant structure may be tilted into any desired orientation (e.g. to a vertical orientation in the case of a tilt-up wall). The result is a concrete wall segment (or other structure) that is cladded on one side with the panels 1130 of form 1328. Panels 1130 are anchored into the concrete wall by support members 1136 and tensioning members 1140. Structures (e.g. building walls and the like) may be formed by tilting up a plurality of wall segments in place. Advantageously, the outward facing surfaces 1131B panels 1130 provide one surface of the resultant wall made using form 1328 which may provide a finished wall surface 1333 on the exterior of a building or on the interior of a building, for example.

The use of form 1328 to fabricate tilt-up walls may involve the same or similar procedures (suitably modified as necessary) as those described for the fabrication of tilt-up walls using modular stay-in-place forms in the Structure-Lining PCT Application. Form 1328 may be anchored to the concrete by support members 1136, by connector components 1138, 1139, by connector components 1132, 1134 of connections 1150 and by tensioning members 1140. Other anchoring components similar to any of the anchoring components disclosed in the Structure-Lining PCT Application may also be used.

As discussed above, form 1328 represents a one-sided form that incorporates components (e.g. panels 1130, support members 1136 and tensioning members 1140) similar to form 1228 (FIG. 12). It will be appreciated that one-sided forms may be made using components of any of the other two-sided forms described herein. By way of non-limiting example, a one-sided form may be constructed using the components of form 1128 (FIG. 11)—i.e. without tensioning members 1140. Any such one-sided forms may be used to construct tilt-up walls and other structures cladded on one side with panels as described above for form 1328.

Figure 18A:
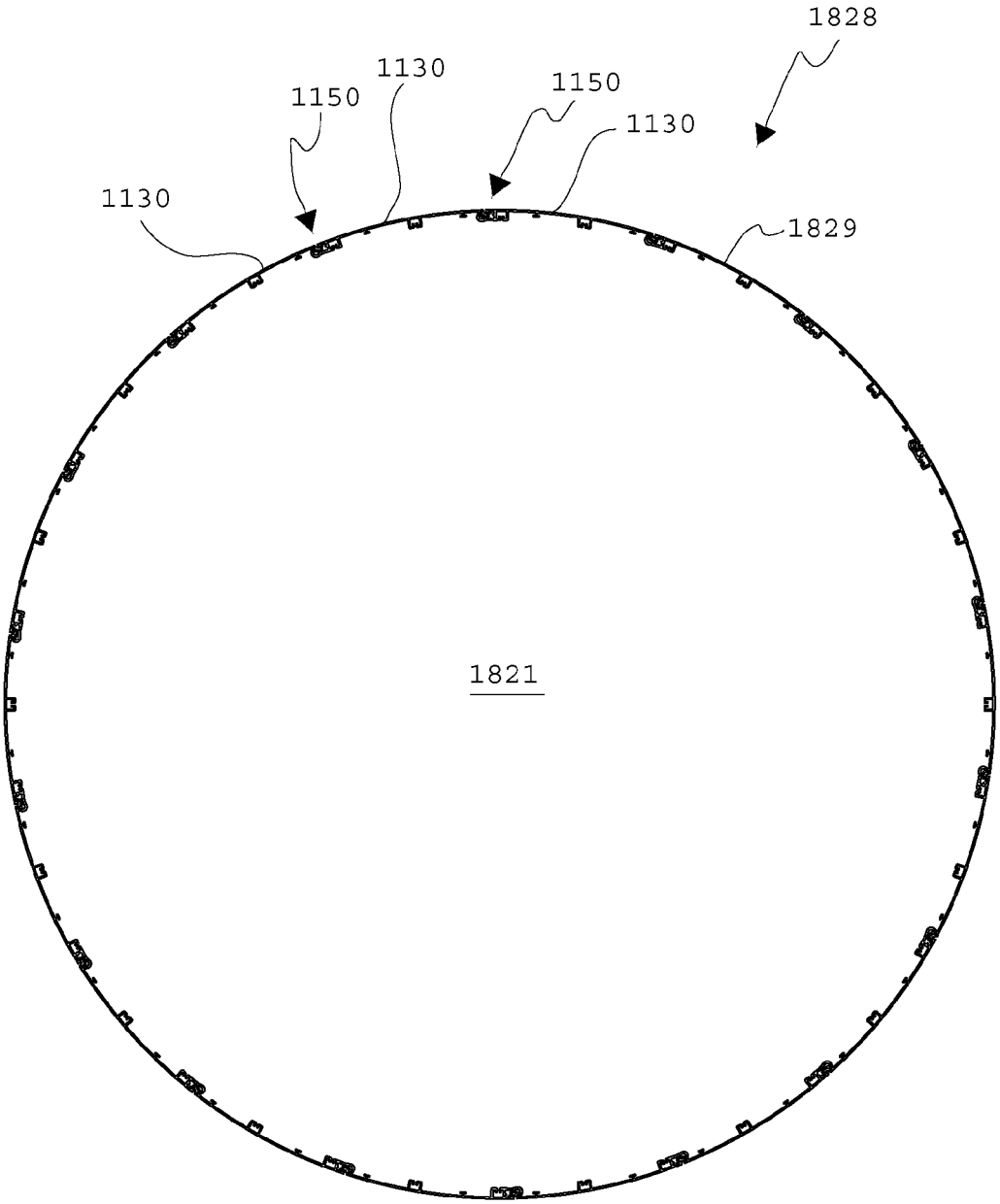
FIG. 18A is a plan view of a form used to form a cylindrical column according to a particular embodiment of the invention.

FIG. 18A schematically depicts a form 1828 according to another embodiment of the invention. Form 1828 comprises a plurality of panels 1130 which are substantially similar to panels 1130 of form 1128 (FIG. 11) and which are used to fabricate a curved wall segment 1829. Panels 1130 are connected to one another in edge to edge relationship at connections 1150 (i.e. using connector components 1132, 1134 (not explicitly enumerated in FIG. 18A) in a manner similar to that described above). More particularly, panels 1130 are moved relative to one another such that a portion of connector component 1134 of a first panel 1130 is inserted into connector component 1132 of an edge-adjacent panel 1130 to form a loose-fit connection and then relative pivotal motion is effected between connector components 1132, 1134 to deform one or more parts of connector components 1132, 1134 and to thereby establish a locked snap-together connection.

Figure 18B:
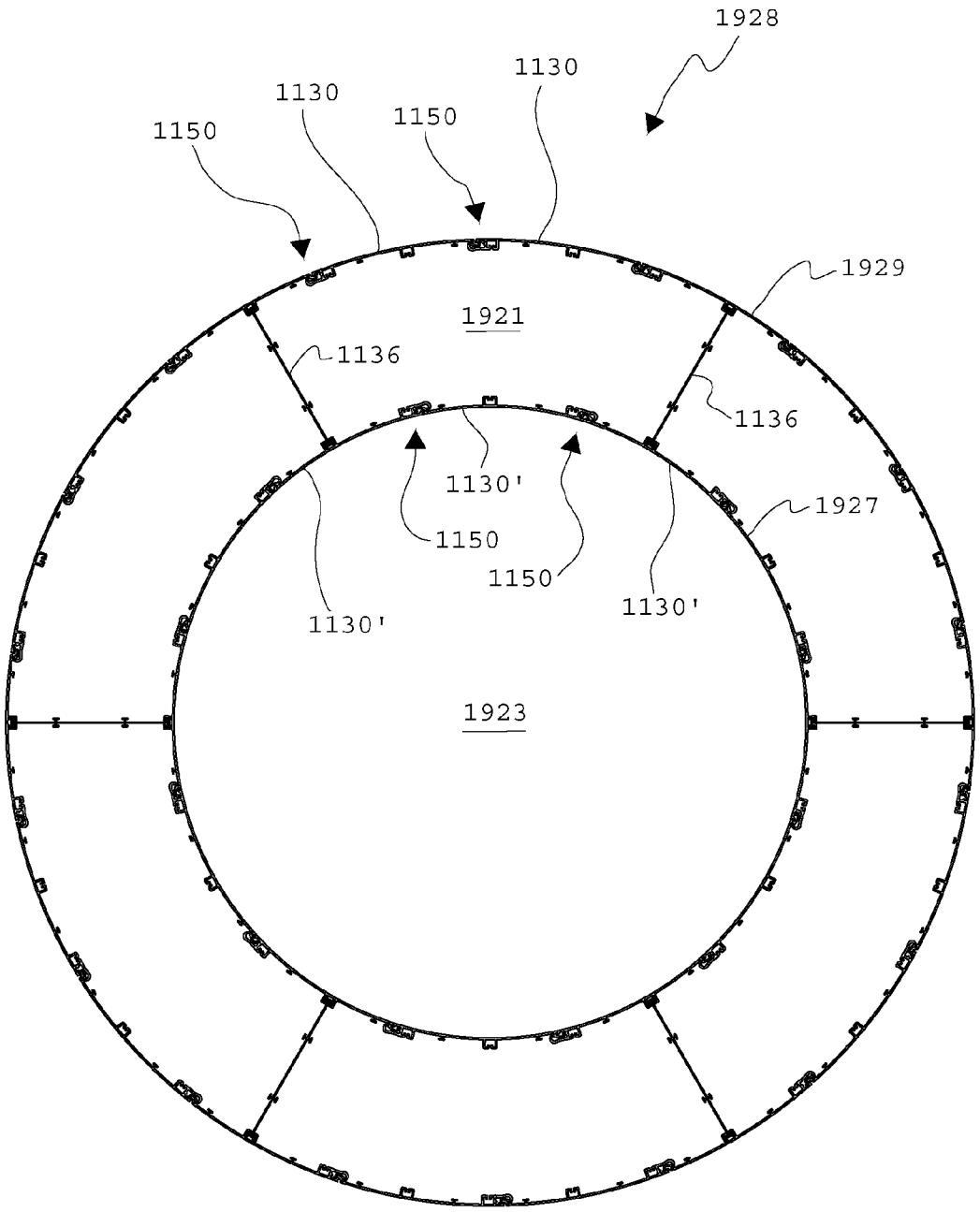
FIG. 18B is a plan view of a form used to form a hollow annular column according to a particular embodiment of the invention.

In form 1828, panels 1130 are curved to provide form 1828 with the round cross-section of wall segment 1829 shown in the illustrated view. An interior 1821 of form 1828 may be filled with concrete or the like and used to fabricate a solid cylindrical column, for example. Such columns may be reinforced with traditional reinforcement bars or with suitably modified support members. Panels 1130 may be fabricated with, or may be deformed to provide, the illustrated curvature. In other embodiments, forms similar to form 1828 may incorporate other FIG. 18B schematically depicts a form 1928 according to another embodiment of the invention. Form 1928 comprises a plurality of exterior panels 1130, a plurality of interior panels 1130' and a plurality of support members 1136. Panels 130, 1130' may be similar to panels 1130 of form 1128 (FIG. 11) and support members 1136 may be similar to support members 1136 of form 1128 (FIG. 11). In form 1928, panels 1130, 1130' and support members 1136 are used to fabricate a pair of curved wall segment 1927, 1929. Panels 1130 of exterior wall segment 1929 and panels 1130' of interior wall segment 1927 are connected to one another in edge to edge relationship at connections 1150 (i.e. using connector components 1132, 1134 (not explicitly enumerated in FIG. 18B) in a manner similar to that described above). More particularly, panels 1130, 1130' are moved relative to one another such that a portion of connector component 1134 of a first panel 1130, 1130' is inserted into connector component 1132 of an edge-adjacent panel 1130, 1130' to form a loose-fit connection and then relative pivotal motion is effected between connector components 1132, 1134 to deform one or more parts of connector components 1132, 1134 and to establish a snap-together locked connection. Support members 1136 are connected between panels 1130, 1130' of opposing interior and exterior wall segments 1927, 1929 in a manner similar to that of support members 1136 and panels 1130 described above.

In form 1928, panels 1130 are curved to provide the round cross-section of interior and exterior wall segments 1927, 1929 shown in the illustrated view. Panels 1130' may be smaller than panels 1130 (e.g. in their transverse or circumferential directions) so as to permit interior and exterior wall segments 1927, 1929 to have different radii of curvature. It will be appreciated that the difference in transverse or circumferential dimensions between panels 1130, 1130' will depend on desired concrete thickness (i.e. the different radii of interior and exterior wall segments 1927, 1929). An interior 1921 of form 1928 may be filled with concrete or the like and used to fabricate an annular column with a hollow bore in region 1923, for example. Such columns may be reinforced with traditional reinforcement bars or with suitably modified support members. Panels 1130, 1130' may be fabricated with, or may be deformed to provide, the illustrated curvature. In other embodiments, forms similar to form 1928 may incorporate other curved panels to provide other columns or the like having any desired shape and having hollow bores therethrough.

Figure 19A:
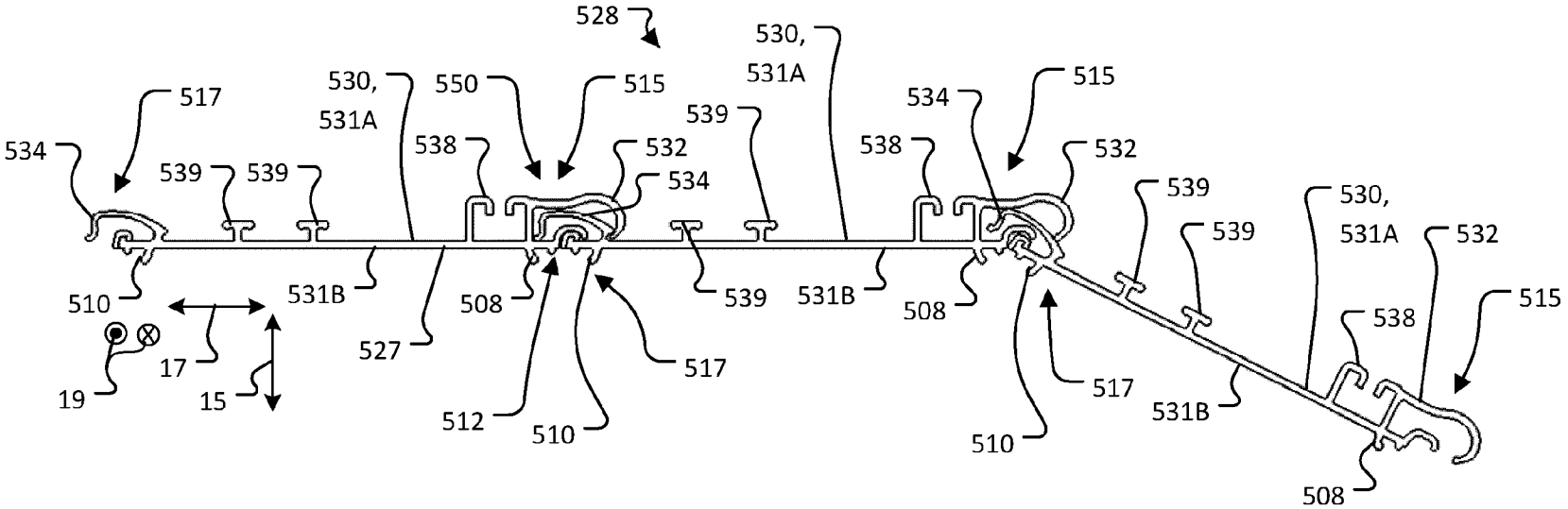
FIG. 19A is a plan view of a number of panels of a modular stay-in-place form according to another particular embodiment of the invention.

FIG. 19A is a plan view of a number of panels 530 of a form 528 according to another embodiment of the invention. FIG. 19A shows only a number of panels 530 of form 528 to permit focus on particular features of panels 530. Panels 530 are similar in many respects to panels 130, 1130 disclosed herein and, like panels 130, 1130, panels 530 may be used to fabricate walls, portions of walls, and/or portions of other structures (e.g. support structures for other structures (e.g. bridges), building foundations, columns, tanks and/or the like). Panels 530 may be fabricated from or may otherwise comprise of the materials described herein for panels 130, 1130 and may be fabricated using any of the procedures described herein for panels 130, 1130. Like panels 130, 1130, panels 530 may have substantially uniform cross-sections along their longitudinal length and may comprise: inward facing surfaces 531A and outward facing surfaces 531B, generally female connector components 532 at one of their transverse edges 515 and generally male connector components 534 at their opposing transverse edges 517.

Inward surfaces 531A of panels 530 of the FIG. 19A embodiment comprise connector components 539 which may be similar to connector components 138 of panels 130 and/or connector components 1139 of panels 1130 and which may be used to connect to support members (not shown) similar to support members 136 and/or to tensioning members (not shown) similar to tensioning members 140, 1140. Inward surfaces 531A of panels 530 of the FIG. 19A embodiment also comprise connector components 538 which may be similar to connector components 1138 of panels 1130 and which may be used to connect to support members (not shown) similar to support members 1136. In some embodiments, the number and/or transverse locations of connector components 539, 538 on panels 530 may vary and such locations may depend on the transverse width of panels 530.

Figure 19B:
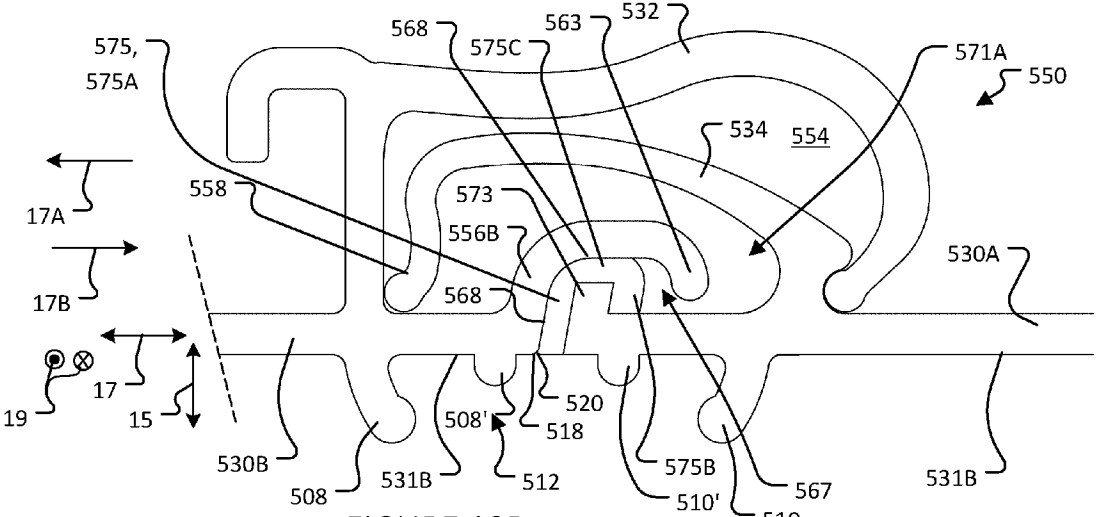
FIGS. 19B, 19C, 19D and 19F are magnified plan views of connections between edge-adjacent panels of the FIG. 19A form.
Figure 19C:
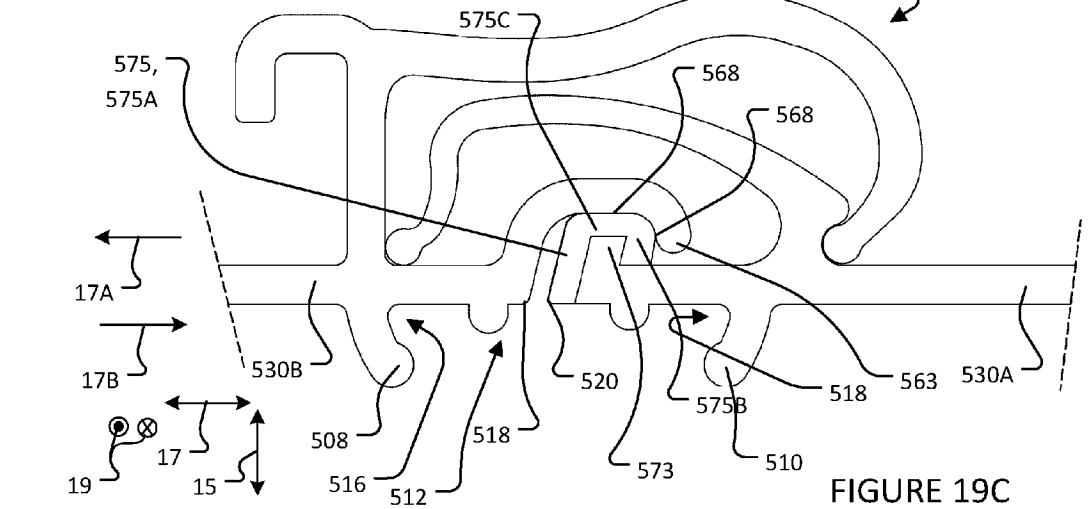

Generally female connector components 532 and generally male connector components 534 of panels 530 are similar to connector components 1132 and 1134 of panels 1130 and may be joined together to form connections 550 at transverse edges 515, 517 of panels 530 and corresponding form segments or wall segments 527. FIGS. 19B and 19C are magnified views of connections 550 between the male connector component 534 of a first panel 530A and the female connector component 532 of a second panel 530B. Forming connections 550 between connector components 532, 534 of edge-adjacent panels 530A, 530B may be similar to that described for panels 1130 and connector components 1132, 1134 (see FIGS. 15A-15G) and may involve extending a protrusion 558 of generally male connector component 534 into a receptacle 554 of generally female connector component 532.

Such extension of protrusion 558 into receptacle 554 may comprise effecting relative pivotal movement of panels 530A, 530B (e.g. about an axis that extends in longitudinal direction 19). Such extension of protrusion 558 into receptacle 554 (e.g. by relative pivotal movement or otherwise) may comprise causing protrusion 558 (or some other part of male connector component 534) to bear on a surface of receptacle 554 (or some other part of female connector component 532) to cause deformation of one or both of connector components 532, 534. Restorative deformation forces associated with such deformation may at least partially restore this deformation to retain connector components 532, 534 in a locked configuration (e.g. a snap-together connection) when connection 550 is made. In some embodiments, this restoration is only partial, so that there remains restorative deformation forces between bearing surfaces of connector components 532, 534, which tend to force these bearing surfaces toward one another. Such restorative deformation forces may help to prevent or minimize the leakage of fluids through connections 550. In some embodiments, forming connection 550 between connector components 532, 534 may involve forming a loose-fit connection similar to that described above for connector components 1132, 1134, although this is not necessary.

Connector components 532, 534 comprise a number of features that are different in some respects from those of connector components 1132, 1134. As shown in FIGS. 19B and 19C, thumb 563 of arm 556B (which is somewhat analogous to thumb 1163 of arm 1156B) is shaped to extend onto both transverse sides of thumb 573 (which is somewhat analogous to thumb 1173) when thumb 563 extends into concavity 571A (which is somewhat analogous to concavity 1171A) and connection 550 is formed and thumb 573 is shaped to extend inwardly into secondary recess 567 (which is somewhat analogous to secondary recess 1167).

Further, FIGS. 19B and 19C expressly show a sealing member 575 (e.g. a flexible, elastomeric and/or polyolefin sealing member 575) which coats thumb 573 on an inside and on both transverse sides thereof (see first and second transverse side portions 575A, 575B and inside portion 575C of sealing member 575). In some embodiments, sealing member 575 may be co-extruded with panels 530 onto thumb 573. In some embodiments, sealing member 575 (or an additional sealing member) may be co-extruded onto the surface of thumb 563 which defines secondary recess 567. In other embodiments, sealing member 575 may be bonded to at least a surface of thumb 573 or a surface of thumb 563. For example, the bonds may comprise adhesive bonds, chemical bonds or bonds which involve melting and re-solidifying portions of thumbs 563, 573 and/or the first and second panels.

These shapes of thumb 563, secondary recess 567, thumb 573 and sealing member 575 provide a contact joint 568 which may help to prevent or minimize the leakage of fluids even in the face of thermal expansion, concrete degradation (e.g. cracking), over-stretching of the form (e.g. due to too much concrete), ground settling, seismic events and/or other conditions which may tend to force panels 530A, 530B transversely toward one another or transversely away from one another. In particular, in the case of the illustration shown in FIG. 19B, panels 530A, 530B may be forced transversely toward one another, and contact joint 568 is provided by contact between thumb 563 and a first transverse portion 575A of sealing member 575 on a first transverse side of thumb 573 and by contact between thumb 563 and an inside portion 575C of sealing member 575 on an inside of thumb 573. In the case of the illustration shown in FIG. 19C, panels 530A, 530B may be forced transversely away from one another and contact joint 568 is provided by contact between thumb 563 and a second transverse portion 575B of sealing member 575 on a second transverse surface of thumb 573 and by contact between thumb 563 and inside portion 575C of sealing member 575 on the inside of thumb 573.

As best illustrated in FIGS. 19B and 19C, inside portion 575C of sealing member 575 may contact (or be affixed to) an inwardly facing surface of thumb 573, first transverse portion 575A of sealing member 575 may contact (or be affixed to) a first transverse-facing surface of thumb 573 and second transverse portion 575B of sealing member 575 may contact (or be affixed to) a second transverse-facing surface of thumb 573.

Thumb 563 may define a recess 567. In particular, recess 567 may be defined by a first transverse-facing surface of thumb 563, a second transverse-facing surface of thumb 563 and an outwardly-facing surface of thumb 563. In some embodiments, a transverse dimension of recess 567 is greater than a transverse dimension of thumb 573 and sealing member 575. This feature allows thumbs 563, 573 to move transversely relative to each other.

As can be seen by comparing FIGS. 19B and 19C, by deforming connector components 532, 534, thumbs 563 and 573 may move between a first configuration, as illustrated in FIG. 19B, and a second configuration, as illustrated in FIG. 19C. In the first configuration, the second configuration and during movement therebetween, inside portion 575C of sealing member 575 maintains contact with thumb 563 at contact joint 568. In the first configuration, thumb 573 is located in a first transverse location relative to thumb 563 and first transverse portion 575A of sealing member 575 contacts thumb 563. In particular, first transverse portion 575A contacts the first transverse-facing surface of thumb 563 and second transverse portion 575B is spaced apart from the second transverse facing surface of thumb 563. In the second configuration, thumb 573 is located in a second location relative to thumb 563 and second transverse portion 575B of sealing member 575 contacts thumb 563. In particular, second transverse portion 575B contacts the second transverse-facing surface of thumb 563 and the first transverse portion 575B is spaced apart from the first transverse-facing surface of thumb 563. While moving between the first configuration and the second configuration, it is possible that neither of first transverse portion 575A and second transverse portion 575B of sealing member 575 contact thumb 563. In the illustrated embodiment, the thumbs 563, 573 are spaced apart by sealing member 575. In particular, the surfaces of thumb 563 are spaced apart from the surfaces of thumb 573 by sealing member 575.

In some embodiments, thumbs 563, 573 project from locations spaced transversely apart from the transverse edges of panels 530A, 530B. In other embodiments, thumbs 563, 573 project from the transverse edges of panels 530A, 530B.

In other embodiments (not illustrated), inside portion 575C of sealing member 575 may contact (or be affixed to) an outwardly facing surface of thumb 563, first transverse portion 575A of sealing member 575 may contact (or be affixed to) a first transverse-facing surface of thumb 563 and second transverse portion 575B of sealing member 575 may contact (or be affixed to) a second transverse-facing surface of thumb 563. In such embodiments, by deforming connector components 532, 534, thumbs 563 and 573 may move between a first configuration, and a second configuration. In the first configuration, the second configuration and during movement therebetween, inside portion 575C of sealing member 575 maintains contact with thumb 573 at contact joint 568. In the first configuration, thumb 573 is located in a first transverse location relative to thumb 563 and first transverse portion 575A of sealing member 575 contacts thumb 573. In particular, first transverse portion 575A contacts the first transverse-facing surface of thumb 573 and second transverse portion 575B is spaced apart from the second transverse-facing surface of thumb 573. In the second configuration, thumb 573 is located in a second location relative to thumb 563 and second transverse portion 575A of sealing member 575 contacts thumb 573. In particular, second transverse portion 575B contacts the second transverse-facing surface of thumb 573 and first transverse portion 575A is spaced apart from the first transverse-facing surface of thumb 573. While moving between the first configuration and the second configuration, it is possible that neither of first transverse portion 575A and second transverse portion 575B of sealing member 575 contact thumb 573.

It will be appreciated that connections 150 between connector components 132, 134 of panels 130 described herein may also comprise contact joints between corresponding portions of connector components 132, 134 of edge-connected panels 130. For example, such contact joints may be provided between beveled surfaces 160, 176 and/or between protrusion 158 and secondary receptacle 174. One or more of these contact surfaces (or any other contact surfaces) that provide the contact joints between connector components 132, 134 of panels 130 may be coated with a sealing member which may be co-extruded to help prevent or minimize leakage through the contact joint(s). Similarly, connections 1150 between connector components 1132, 1134 of panels 1130 described herein may also comprise contact joints between corresponding portions of connector components 1132, 1134 of edge-connected panels 1130. For example, such contact joints may be provided between thumbs 1163, 1173. The surface of thumb 1163 and/or thumb 1173 (or any other contact surfaces of connector components 1132, 1134 which provide contact joints) may be bevelled, planar and/or coated with a sealing member which may be co-extruded to help prevent or minimize leakage through the contact joint(s).

Panels 530 and connections 550 between edge-adjacent panels 530 may comprise other features that are not shown in the illustrated embodiments of panels 130, 1130 and connections 150, 1150 formed between edge-adjacent panels 130, 1130. More particularly, as shown in FIGS. 19B and 19C, panels 530 of the illustrated embodiment comprise first and second seal-retaining projections 508, 510. This is not necessary. As can be seen in FIGS. 19H-19K, some embodiments do not include first and second seal-retaining projections 508, 510. In the illustrated embodiment of FIGS. 19B and 19C, first seal-retaining projection 508 extends in longitudinal direction 19 and also extends outwardly from outer surface 531B of panel 530 at a location that is close to, but spaced in a first transverse direction 17A apart from, a first outer-surface transverse edge 518 of panel 530 (i.e. where first outer-surface transverse edge 518 comprises a first transverse extremity of the generally planar outer surface 531B of panel 530). In the illustrated embodiment of FIGS. 19B and 19C, second seal-retaining projection 510 extends in longitudinal direction 19 and also extends outwardly from outer surface 531B of panel 530 at a location that is close to, but spaced in a second transverse direction 17B (opposite the first transverse direction 17A) apart from, a second outer-surface transverse edge 520 of panel 530 (i.e. where second outer-surface transverse edge 520 comprises a second transverse extremity of the generally planar outer surface 531B of panel 530).

Seal-retaining projections 508, 510 are located relative to panels 530, such that when a connection 550 is formed between edge-adjacent panels 530A, 530B (as shown in FIGS. 19B and 19C), first seal-retaining projection 508 is transversely spaced apart from first outer-surface transverse edge 518 of panel 530B in a first transverse direction 17A and second seal-retaining projection 510 is transversely spaced apart from second outer-surface transverse edge 520 in of panel 530A in a second transverse direction 17B opposite to first transverse direction 17A. Because of the location and shape of seal-retaining projections 508, 510, when a connection 550 is formed between edge-adjacent panels 530A, 530B, seal-retaining projections 508, 510, together with the portions of outer surfaces 531B of panels 530A, 530B located between projection 508 of first panel 530B and projection 510 of second panel 530A, define at least a portion of seal-receiving concavity 512. As shown in FIGS. 19B and 19C, seal-receiving concavity 512 opens outwardly from form 528. Seal-receiving concavity 512 also has an extension in longitudinal direction 19 which is commensurate with the longitudinal extension of seal-retaining projections 508, 510. In circumstances like that shown in FIG. 19C (e.g. where forces tend to pull edge-adjacent panels 530A, 530B away from one another, a portion of seal-receiving concavity 512 may be defined by portions of connector components 532, 534 located between first and second outer-surface transverse edges 518, 520 and contact joint 568. For example, in case of the illustrated embodiment, a portion of seal-receiving concavity may be defined by a portion of connector component 532 (e.g. arm 556B) between first outer-surface transverse edge 518 and contact joint 568 and a portion of seal-receiving concavity may be defined by a portion of connector component 534 (e.g. transverse portion 575A of sealing member 575) between second outer-surface transverse edge 520 and contact joint 568.

Figure 19E:
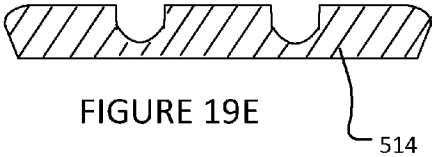
FIGS. 19E and 19G are plan views of seals that may be used to help seal the connections of the FIG. 19A form according to particular embodiments.
Figure 19G:
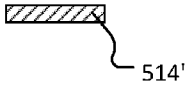
Figure 19D:
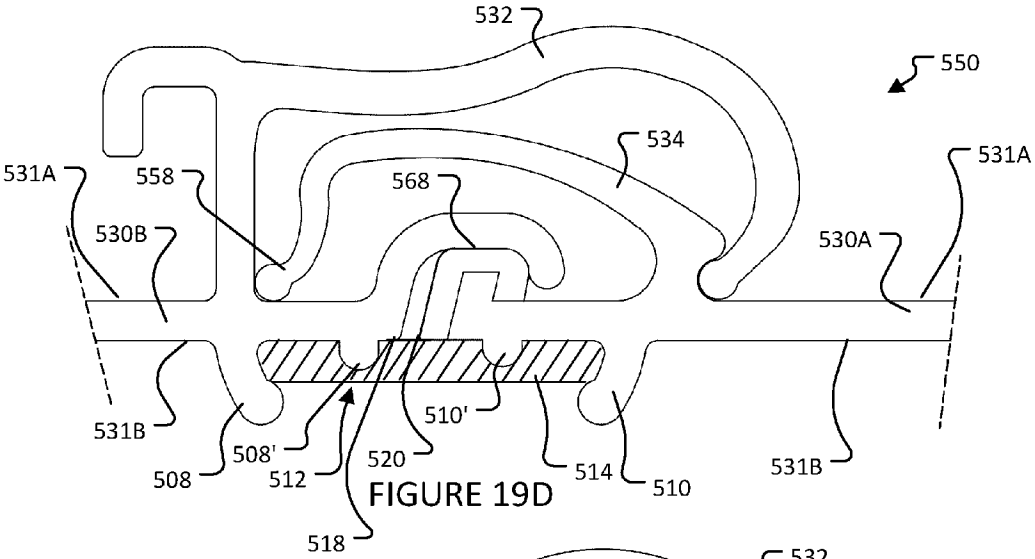

As shown in FIG. 19D, an elastic or viscoelastic (e.g. flexible) seal 514 may be inserted into seal-receiving concavity 512 to help seal connection 550 and prevent or minimize the leakage of fluids (e.g. liquids or gasses) through connection 550. In some embodiments, seal 514 may be provided by a curable material (e.g. silicone, caulking, glue, a curable elastomer, a curable polyolefin and/or the like) which may be inserted into seal-receiving concavity 512 and may then be permitted to cure in concavity 512. Such a curable seal 514 may bond (e.g. an adhesive bond, a bond involving a chemical reaction, a bond involving melting and re-solidifying a portion of panels 530 and/or the like) to one or more of the surfaces that define seal-receiving concavity 512 (e.g. to one or more of seal-retaining projection 508, seal-retaining projection 510, the portion of outer surface 531B of panel 530A between seal-retaining projection 510 and second outer-surface transverse edge 520, the portion of outer surface 531B of panel 530B between seal-retaining projection 508 and first outer-surface transverse edge 518 and the portions of connector components 532, 534 located between first and second outer-surface transverse edges 518, 520 and contact joint 568). Such a curable seal 514 may bond to one or more of such surfaces on each of edge-adjacent panels 530A, 530B that provide connection 550 so as to help seal contact joint 568. In some embodiments, seal 514 may be fabricated from a material that itself bonds to the surfaces of panels 530. In some embodiments, it may be desirable to interpose a primer, a bonding adhesive and/or the like between seal 514 and the surface(s) which define seal-receiving concavity 512 to make and/or to enhance the bond therebetween.

When a seal 514 comprising a curable material is inserted into seal-receiving concavity 512, seal-retaining projections 508, 510 may conveniently contain the sealant material in seal-receiving concavity 512 until seal 514 is permitted to cure, thereby minimizing the amount of sealant that is applied to panels 530 at locations transversely spaced apart from first and second outer-surface transverse edges 518, 520 by distances so far as to render the sealant ineffective for mitigating fluid leakage through connection 550 and contact joint 568. This containment of sealant material may minimize the wastage of sealant material, may improve the appearance of the outer surface of form 528 and may minimize the mess associated with errant application of sealant material.

It is not necessary that seal 514 be provided by a curable material. In some embodiments, seal 514 may be provided by a suitably shaped solid flexible seal 514. Such a solid flexible seal may comprise elastomeric material, polyolefin material or any other suitable material. In some embodiments, such a solid seal may be bonded (e.g. an adhesive bond, a bond involving a chemical reaction, a bond involving melting and re-solidifying a portion of panels 530 and/or the like) to one or more of the surfaces that define seal-receiving concavity 512 (e.g. to one or more of seal-retaining projection 508, seal-retaining projection 510, the portion of outer surface 531B of panel 530A between seal-retaining projection 510 and second outer-surface transverse edge 520 and the portion of outer surface 531B of panel 530B between seal-retaining projection 508 and first outer-surface transverse edge 518). Such a solid flexible seal 514 may be bonded to one or more of such surfaces on each of edge-adjacent panels 530A, 530B that provide connection 550 so as to help seal contact joint 568.

In some embodiments, such a solid seal may be deformably compressed for insertion into seal-receiving concavity 512. An exemplary embodiment of such a solid flexible seal 514 is shown in FIG. 19E. In the illustrated embodiment of FIGS. 19D and 19E, seal 514 is generally shaped to conform to the surfaces of seal-receiving concavity 512, but seal 514 is generally larger than seal-receiving concavity 512. Seal 514 may be compressed or otherwise deformed for insertion into seal-receiving concavity 512. When seal 514 is deformed for insertion into seal-receiving concavity 512, such deformation of seal 514 may cause seal 514 to exert restorative deformation forces against one or more of the surfaces that define seal-receiving concavity 512 (e.g. against one or more of seal-retaining projection 508, seal-retaining projection 510, the portion of outer surface 531B of panel 530A between seal-retaining projection 510 and second outer-surface transverse edge 520 and the portion of outer surface 531B of panel 530B between seal-retaining projection 508 and first outer-surface transverse edge 518). Seal 514 may be shaped and/or sized such that such restorative deformation forces may be exerted against one or more of such surfaces on each of edge-adjacent panels 530A, 530B that provide connection 550 so as to help seal contact joint 568.

Seal-retaining projections 508, 510 may be shaped to help retain seal 514 in seal-receiving concavity 512 and/or to help maintain the deformation of seal 514. In some embodiments, first seal-retaining projection 508 (or a portion thereof) is shaped to extend transversely toward first outer-surface transverse edge 518 and/or second seal-retaining projection 510 (or a portion thereof) is shaped to extend transversely toward second outer-surface transverse edge 520. In some embodiments, when connection 550 is made between connector components 532, 534, first and second seal-retaining projections 508, 510 (or portions thereof) may extend transversely toward one another. In the illustrated embodiment of FIGS. 19A-19D, projections 508, 510 (or portions thereof) extend both outwardly and transversely (i.e. projections 508, 510 (or portions thereof) extend transversely as they extend outwardly). In some embodiments, seal-retaining projections 508, 510 are shaped such that a transverse dimension of an outer opening of seal-receiving concavity 512 is smaller than a transverse dimension at an interior of seal-receiving concavity 512. This shape of seal-retaining projections 508, 510 may define (together with the outer surfaces 531B of panels 530) transversely-opening secondary seal-receiving concavities 516, 518 (shown best in FIG. 19C). As shown in FIG. 19C, a first transversely-opening secondary seal-receiving concavity 516 (defined by first seal-retaining projection 508 and outer surface 531B of panel 530B) may open transversely toward second seal-retaining projection 510. Similarly, a second transversely-opening secondary seal-receiving concavity 518 (defined by second seal-retaining projection 510 and outer surface 531B of panel 530A) may open transversely toward first seal-retaining projection 508.

Some or all of these features of the shapes of seal-retaining projections 508, 510 may help to retain seal 514 in seal-receiving concavity 512 and/or may help maintain the deformation of seal 514. By way of non-limiting example, the extension of seal-retaining projections 508, 510 toward one another as they extend outwardly from outer surface 531B of panels 530B, 530A may tend to maintain the compression of seal 514 against outer surfaces 531B of panels 530B, 530B and may tend to maintain corresponding restorative deformation forces of seal 514 against outer surfaces 531B of panels 530B, 530A and the surfaces of projections 508, 510.

In currently preferred embodiments, the transverse thickness of seal-retaining projections 508, 510 is comparable to the inward-outward thickness of panels 530 between inner surfaces 531A and outer surfaces 530B. In some embodiments, the transverse thickness of seal-retaining projections 508, 510 is in a range of 0.8-1.2 times the inward-outward thickness of panels 530 between inner surfaces 531A and outer surfaces 530B.

Figure 19F:
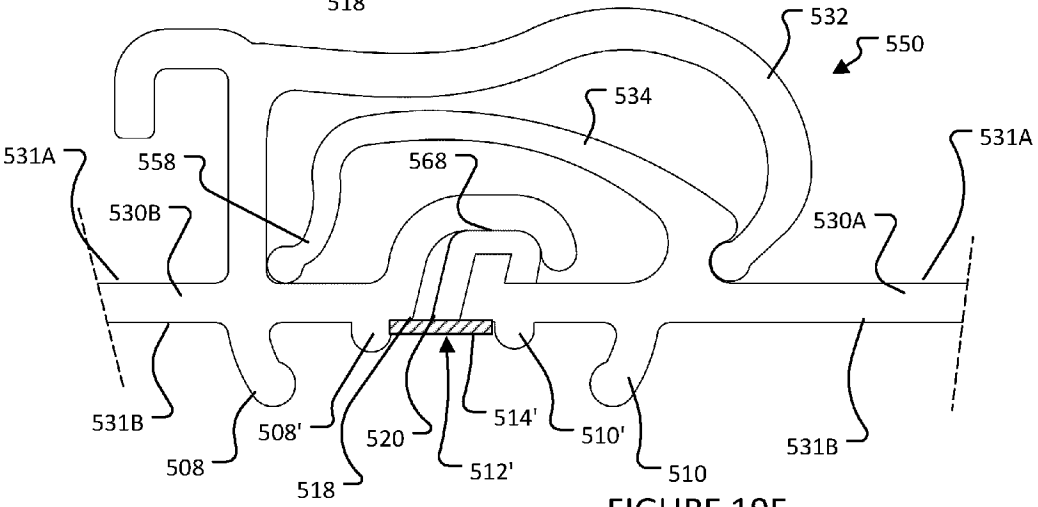
Figure 19H:
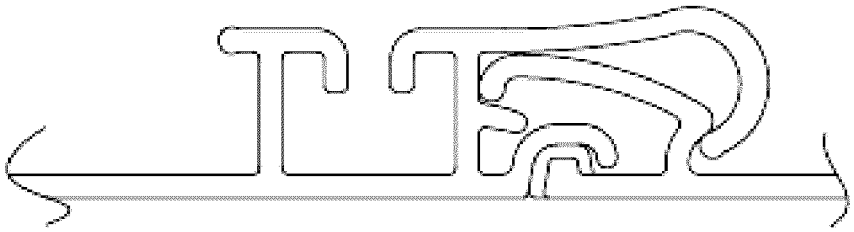
FIGS. 19H-19K are magnified plan views of connections between edge-adjacent panels of forms according to other embodiments of the invention.
Figure 19I:
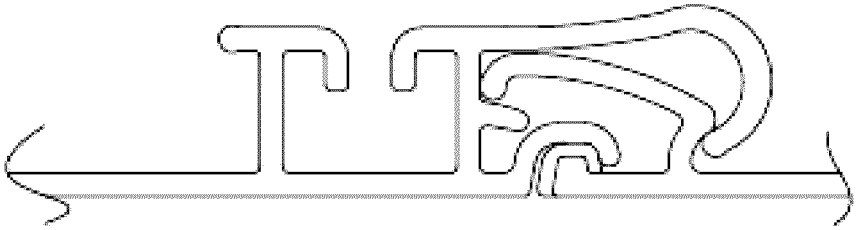
Figure 19J:
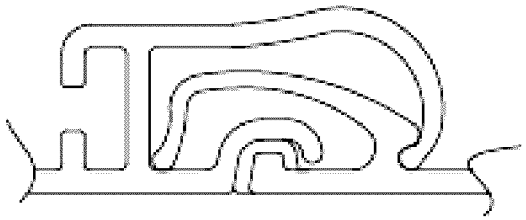
Figure 19K:
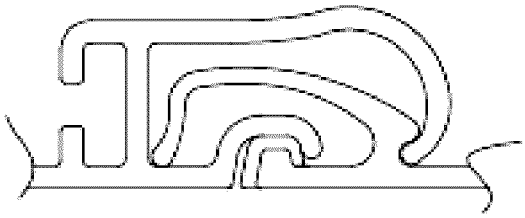

In the illustrated embodiment of FIGS. 19A-19D, panels 530 also comprise optional secondary seal-retaining projections 508', 510'. In some embodiments, secondary seal-retaining projections 508', 510' need not be present. For example, FIGS. 19H-19K depict embodiments without secondary seal-retaining projections 508', 510'. Secondary seal-retaining projections 508', 510' may have characteristics similar to, and provide functionality similar to, those of seal-retaining projections 508, 510 described herein. Secondary seal-retaining projections 508', 510' of the illustrated embodiment differ from seal-retaining projections 508, 510 because secondary seal-retaining projections 508', 510' are respectively located transversely closer to first and second outer-surface transverse edge 518, 520 so that, when connection 550 is formed, secondary seal-retaining projections 508', 510' (together with the portions of outer surfaces 531B of panels 530B, 530A therebetween) define a transversely narrower secondary seal-receiving concavity 512'. Secondary seal-receiving concavity 512' may receive a seal 514' (an exemplary embodiment of which is shown in FIGS. 19F and 19G) which may have characteristics similar to seal 514 described above, except that seal 514' may be transversely narrower than seal 514.

In the illustrated embodiment, the surfaces of secondary seal-retaining projections 508', 510' that define secondary seal-receiving concavity 512' extend directly outwardly from outer surfaces 531B of panels 530B, 530A (i.e. rather than extending transversely toward one another like seal-retaining projections 508, 510). This is not necessary. Where present, secondary seal-retaining projections 508', 510' may have shapes that exhibit the characteristics of any of seal-retaining projections 508, 510 described herein. Secondary seal-retaining projections 508', 510' may permit smaller seals 514' and may therefore save material relative to seal-retaining projections 508, 510. Secondary seal-retaining projections 508', 510' are not necessary. In some embodiments, secondary seal-retaining projections 508', 510' are omitted. Where secondary seal-retaining projections 508', 510' are omitted, solid seals (e.g. seal 514 shown in FIG. 19E) may be fabricated without corresponding concavities shaped to conform to the shape of secondary seal-retaining projections 508', 510'.

FIGS. 19H-19K show various connections between edge-adjacent panels according to other exemplary embodiments. FIGS. 19H-19K differ primarily in that they do not include seal retaining projections (e.g. seal-retaining projections 508, 510) or secondary seal retaining projections (e.g. secondary seal-retaining projections 508', 510'). In other respects, the connector components of FIGS. 19H-19K are similar to those of FIG. 19A and have features similar to those of FIG. 19A.

Figure 20C:
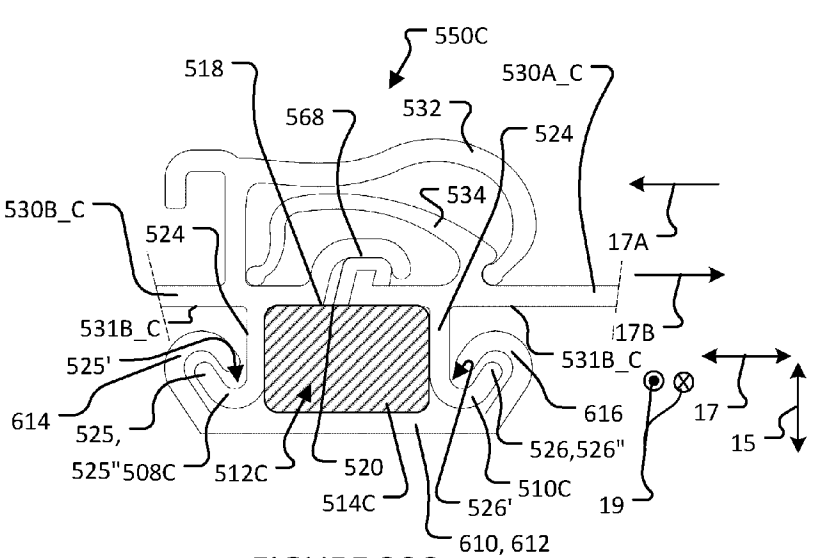
FIGS. 20A-20E are magnified plan views of connections between edge-adjacent panels of forms according to other embodiments of the invention.
Figure 20D:
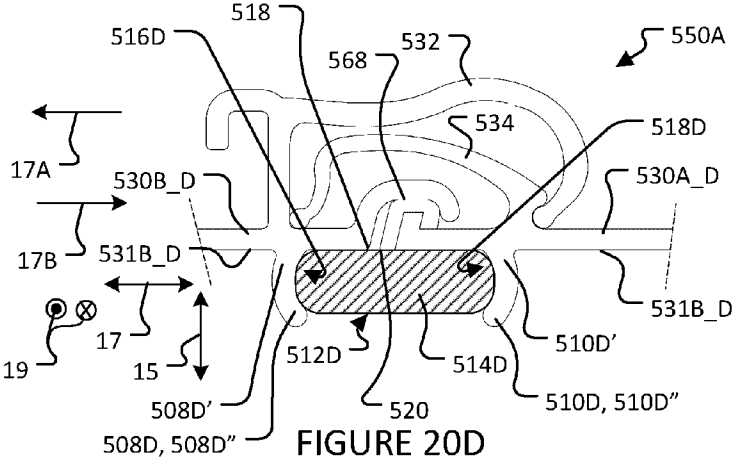
Figure 20A:
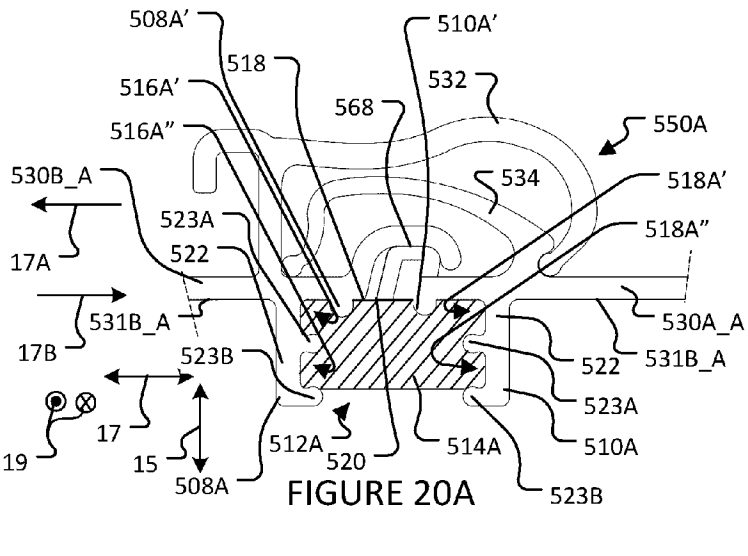

FIGS. 20A-20E show various connections 550A-550E between edge-adjacent panels 530A_A-530A_E, 530B_A-530B_E according to other exemplary embodiments. Connections 550A-550E between edge-adjacent panels 530A_A-530A_E, 530B_A-530B_E are similar to connection 550 between edge-adjacent panels 530A, 530B shown in FIGS. 19A-19D and described herein, but connections 550A-550E and panels 530A_A-530A_E, 530B_A-530B_E comprise variations of seal-retaining projections 508A-508E, 510A-510E and seal-receiving concavities 512A-512E which differ in some respects from seal-retaining projections 508, 510 and seal-receiving concavity 512. In each of connections 550A-550E of FIGS. 20A-20E, connector components 532, 534 and contact joint 568 are substantially similar to those of connections 550 of FIGS. 19A-19D. Also, in many respects, first seal-retaining projections 508A-508E, second seal-retaining projections 510A-510E and seal-receiving concavities 512A-512E are generally similar to first seal-retaining projections 508, second seal-retaining projections 510 and seal-receiving concavity 512 described herein. For brevity, the differences in first seal-retaining projections 508A-508E, second seal-retaining projections 510A-510E and seal-receiving concavities 512A-512E are the focus of the description here, it being understood that other features of panels 530A_A-530A_E, 530B_A-530B_E may be similar to those of FIG. 20A shows a connection 550A between edge-adjacent panels 530A_A, 530B_A according to a particular embodiment. First and second seal-retaining projections 508A, 510A of FIG. 20A differ from first and second seal-retaining projections 508, 510 of the embodiment shown in FIGS. 19A-19D in that first and second seal-retaining projections 508A, 510A extend in longitudinal direction 19 but comprise outwardly-extending portions 522 which extend generally straight outwardly (i.e. in inward-outward direction 15) with transversely extending portions 523A, 523B which extend generally transversely toward their respective first and second outer-surface transverse edges 518, 520 at locations spaced outwardly apart from the outer surfaces 531B_A, 531B_B of panels 530A_A, 530B_A. In the illustrated embodiment, transversely extending portions 523B are located further outwardly apart from outer surfaces 531B_A of panels 530A_A, 530B_A than transversely extending portions 523A.

In some embodiments, transversely extending portions 523A, 523B of first seal-retaining projection 508A extend generally transversely toward second seal-retaining projection 510A and transversely extending portions 523A, 523B of second seal-retaining projection 510A extend generally transversely toward first seal-retaining projection 508A. As is the case with seal-receiving concavity 512 discussed above, seal-retaining projections 508A, 510A are shaped such that seal-receiving concavity 512A of the FIG. 20A embodiment has an outermost opening which has a transverse dimension that is smaller than a transverse dimension of seal-receiving concavity 512A at an interior thereof (i.e. where the interior of seal-receiving concavity 512A is closer to outer surfaces 531B_A of panels 530A_A, 530B_A than the outermost opening). In the illustrated embodiment, the transverse extension of transversely extending portions 523A, 523B is generally equal. This is not necessary, however, and in some embodiments the transverse extension of outer transversely extending portions 523B is greater than that of inner transversely extending portions 523A or vice versa. In some embodiments, each seal-retaining projection 508A, 510A comprises a different number (e.g. one or three or more) of transversely extending portions.

The shape of seal-retaining projections 508A, 510A in the illustrated embodiment of FIG. 20A provides seal-receiving concavity 512A with a plurality of transversely-opening secondary seal-receiving concavities 516A', 516A", 518A', 518A". In the illustrated embodiments, these transversely-opening secondary seal-receiving concavities 516N, 516A", 518A', 518A" include a plurality of transversely-opening secondary seal-receiving concavities 516A', 516A" defined by seal-retaining projection 508A and outer surface 531B_A of its corresponding panel 530B_A which open toward seal-retaining projection 510A when seal 550A is made and a plurality of transversely-opening secondary seal-receiving concavities 518A', 518A" defined by seal-retaining projection 510A and outer surface 531B_A of its corresponding panel 530A_A which open toward seal-retaining projection 508A when seal 550A is made.

Because of the differences in the shape of seal-retaining projections 508A, 510A and seal-receiving concavity 512A (relative to seal-retaining projections 508, 510 and seal-receiving concavity 512), seal 514A of the FIG. 20A embodiment has a shape that is different from seal 514 of the FIG. 19A-19D embodiment. In some embodiments, seal 514A may be inserted inwardly of outer transversely extending portions 523B to extend into all of the transversely-opening secondary seal-receiving concavities 516N, 516A", 518A', 518A" as shown in the illustrated embodiment of FIG. 20A. This is not necessary. In some embodiments, seal 514A may be inserted inwardly of a subset of the transversely extending portions of seal-retaining projections 508A, 510A to extend into a subset of the transversely-opening secondary seal-receiving concavities. For example, in the case of FIG. 20A, seal 514A may be inserted inwardly of inner transversely extending portions 523A to extend into inner transversely-opening secondary seal-receiving concavities 516A', 518A'.

As is the case with panels 530A, 530B of connection 550 shown in the illustrated embodiment of FIGS. 19A-19D, panels 530A_A, 530B_A are shown with optional secondary seal-retaining projections 508A', 510A'. Secondary seal-retaining projections 508A', 510A' may have features substantially similar to and may function in a manner substantially similar to secondary seal-retaining projections 508', 510' described herein. Like secondary seal-retaining projections 508', 510', secondary seal-retaining projections 508A', 510A' are optional and when removed may involve a corresponding change in the shape of seal 514A.

Figure 20B:
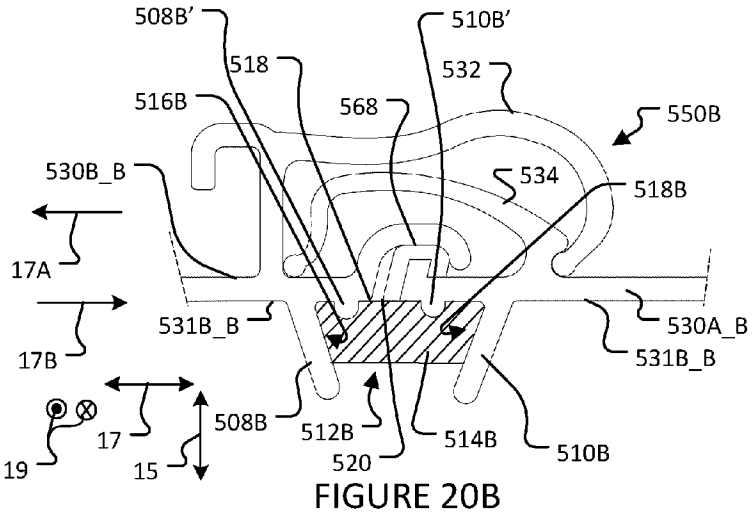

FIG. 20B shows a connection 550B between edge-adjacent panels 530A_B, 530B_B according to a particular embodiment. First and second seal-retaining projections 508B, 510B of FIG. 20B differ from first and second seal-retaining projections 508, 510 of the embodiment shown in FIGS. 19A-19D in that first and second seal-retaining projections 508B, 510B extend in longitudinal direction 19 but are generally planar in shape as they extending outwardly and transversely toward one another, whereas first and second seal-retaining projections 508, 510 have curved surface shapes. In particular, first and second seal-retaining projections 508B, 510B extend generally linearly both outwardly away from outer surfaces 531B_B of their corresponding panels 530B_B, 530A_B and in transverse directions 17. In the illustrated embodiment, first seal-retaining projection 508B extends transversely toward first outer-surface transverse edge 518 (and toward seal-retaining projection 510B, when connection 550B is made) and second seal-retaining projection 510B extends transversely toward second outer-surface transverse edge 520 (and toward seal-retaining projection 508A).

The shape of seal-retaining projections 508B, 510B provide seal-receiving concavity 512B and seal 514B with different shapes than seal-receiving concavity 512 and seal 514. As is the case with seal-receiving concavity 512 discussed above, seal-retaining projections 508B, 510B are shaped such that seal-receiving concavity 512B of the FIG. 20B embodiment has an outermost opening which has a transverse dimension that is smaller than a transverse dimension of seal-receiving concavity 512B at an interior thereof (i.e. where the interior of seal-receiving concavity 512B is closer to outer surfaces 531B_B of panels 530A_B, 530B_B than the outermost opening). The shape of seal-retaining projections 508B, 510B provides seal-receiving concavity 512B with transversely-opening secondary seal-receiving concavities 516B, 518B which are similar to transversely-opening secondary seal-receiving concavities 516, 518 (FIG. 19C).

As is the case with panels 530A, 530B of connection 550 shown in the illustrated embodiment of FIGS. 19A-19D, panels 530A_B, 530B_B are shown with optional secondary seal-retaining projections 508B', 510B'. Secondary seal-retaining projections 508B', 510B' may have features substantially similar to and may function in a manner substantially similar to secondary seal-retaining projections 508', 510' described herein. Like secondary seal-retaining projections 508', 510', secondary seal-retaining projections 508B', 510B' are optional and when removed may involve a corresponding change in the shape of seal 514B.

FIG. 20D shows a connection 550D between edge-adjacent panels 530A_D, 530B_D according to another embodiment. First and second seal-retaining projections 508D, 510D of FIG. 20D differ from first and second seal-retaining projections 508, 510 of the embodiment illustrated in FIGS. 19A-19D in that first and second seal-retaining projections 508D, 510D extend in longitudinal direction 19 but comprise: first portions 508D', 510D' which extend transversely away from their respective first and second outer-surface transverse edges 518, 520 (and transversely away from the other one of seal-retaining projections 508D, 510D, when connection 550D is made); and second portions 508D", 510D" which extend back transversely toward their respective first and second outer-surface transverse edges 518, 520 (and transversely toward the other one of seal-retaining projections 508D, 510D, when connection 550D is made). In the illustrated embodiment of FIG. 20D, second portions 508D", 510D" of seal-retaining projection 508D, 510D are located further outwardly from outer surfaces 531B_D of their respective panels 530A_D, 530B_D than first portions 508D', 510D'.

The shape of seal-retaining projections 508D, 510D provide seal-receiving concavity 512D and seal 514D with different shapes than seal-receiving concavity 512 and seal 514. As is the case with seal-receiving concavity 512 discussed above, seal-retaining projections 508D, 510D are shaped such that seal-receiving concavity 512D of the FIG. 20D embodiment has an outermost opening which has a transverse dimension that is smaller than a transverse dimension of seal-receiving concavity 512D at an interior thereof (i.e. where the interior of seal-receiving concavity 512D is closer to outer surfaces 531B_D of panels 530A_D, 530B_D than the outermost opening). The shape of seal-retaining projections 508D, 510D provides seal-receiving concavity 512D with transversely-opening secondary seal-receiving concavities 516D, 518D which are similar to transversely-opening secondary seal-receiving concavities 516, 518 (FIG. 19C). In the case of the illustrated embodiment of FIG. 20D, transversely-opening secondary seal-receiving concavities 516D, 518D may be defined by the shape of seal-retaining projections 508D, 510D (i.e. without outer surfaces 531B_D of panels 530A_D, 530B_D), although in some embodiments transversely-opening secondary seal-receiving concavities 516D, 518D may be defined in part by outer surfaces 531B_D of panels 530A_D, 530B_D.

Panels 530A_D, 530B_D of the FIG. 20D embodiment are shown without secondary seal-retaining projections. However, in some embodiments, panels 530A_D, 530B_D may comprise secondary seal-retaining projections similar to secondary seal-retaining projections 508', 510'.

Figure 20E:
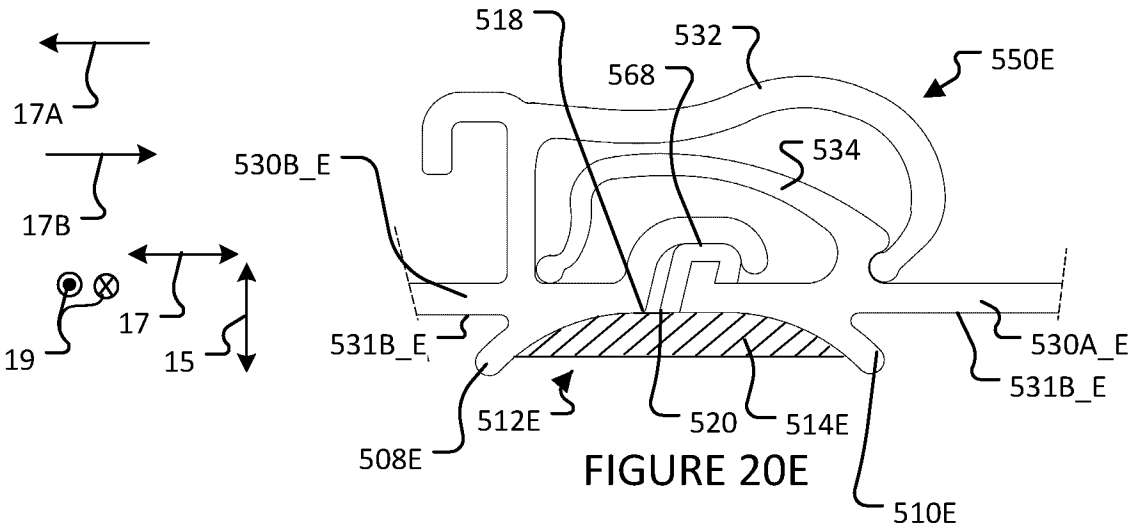

FIG. 20E shows a connection 550E between edge-adjacent panels 530A_E, 530B_E according to another embodiment. First and second seal-retaining projections 508E, 510E of FIG. 20E differ from first and second seal-retaining projections 508, 510 of the embodiment illustrated in FIGS. 19A-19D in that first and second seal-retaining projections 508E, 510E extend in longitudinal direction 19 but also extend transversely away from their respective outer-surface transverse edges 518, 520 (and transversely away from the other one of seal-retaining projections 508E, 510E, when connection 550E is made). The shape of seal-retaining projections 508E, 510E provide seal-receiving concavity 512E and seal 514E with different shapes than seal-receiving concavity 512 and seal 514. Unlike seal-receiving concavity 512 discussed above, seal-receiving concavity 512E has an outermost opening with a transverse dimension that is wider than a transverse dimension of seal-receiving concavity 512E at an interior thereof (where the interior of seal-receiving concavity 512E is closer to the outer surfaces 531B_E of panels 530A_E, 530B_E than the outermost opening). This shape of seal-retaining projections 508E, 510E and seal-receiving concavity 512E may be suited for applications where the corresponding form is used to provide a tank for retaining liquids or semi-liquid materials, such as a bio-digester tank for example, where particulate matter may accumulate in seal-receiving concavity 512E to reinforce seal 514E. Panels 530A_E, 530B_E of the FIG. 20E embodiment are shown without secondary seal-retaining projections. However, in some embodiments, panels 530A_E, 530B_E may comprise secondary seal-retaining projections similar to secondary seal-retaining projections 508', 510'.

FIG. 20C shows a connection 550C between edge-adjacent panels 530A_C, 530B_C according to another embodiment. First and second seal-retaining projections 508C, 510C of FIG. 20C differ from first and second seal-retaining projections 508, 510 of the embodiment illustrated in FIGS. 19A-19D in that first and second seal-retaining projections 508C, 510C comprise concavity-defining portions 524 which extend in longitudinal direction 19 but also extend generally straight outwardly from outer surfaces 531B_C of corresponding panels 530A_C, 530B_C. The shape of cavity-defining portions 524 of seal-retaining projections 508C, 510*c* provide seal-receiving concavity 512*c* and seal 514*c* with different shapes than seal-receiving concavity 512 and seal 514. Unlike seal-receiving concavity 512 discussed above, seal-receiving concavity 512C (and corresponding seal 514C) of the illustrated FIG. 20C embodiment are generally cuboid in shape. Panels 530A_C, 530B_C of the FIG. 20C embodiment are shown without secondary seal-retaining projections. However, in some embodiments, panels 530A_C, 530B_C may comprise secondary seal-retaining projections similar to secondary seal-retaining projections 508', 510'

Seal-retaining projections 508C, 510C also differ from seal-retaining projections 508, 510 in that seal-retaining projections 508C, 510C respectively comprise hook portions 525, 526. Hook portions 525, 526 extend in longitudinal dimension 19 and are provided at locations spaced outwardly apart from outer surfaces 531B_C of panels 530A_C, 530B_C. Hook portions 525, 526 are respectively shaped to define hook concavities 525', 526' which open inwardly toward the outer surfaces of their respective panels 530B_C, 530A_C and to comprise hook projections 525", 526" which extend inwardly toward the outer surfaces of their respective panels 530B_C, 530A_C. In the illustrated embodiment, hook projections 525", 526" are shaped to provide beveled surfaces that extend both toward the outer surfaces of their respective panels 530B_C, 530A_C and transversely away from their respective outer-surface transverse edges 518, 520.

The form (not explicitly enumerated) which includes connection 550C also comprises a cap 610 which connects to hook portions 525, 526 of seal-retaining projections 508C, 510C. Cap 610 extends in longitudinal direction 19 and comprises a base 612 which extends in transverse direction 17 between hook portions 614, 616. Hook portions 614, 616 may be shaped to be complementary to or to otherwise engage hook portions 525, 526 of seal-retaining projections 508C, 510C. Hook portions 614, 616 of cap 610 may comprise hook projections (not explicitly enumerated) which project into hook concavities 525', 526' and may be shaped to define hook concavities (not explicitly enumerated) which receive hook projections 525", 526", when cap 610 is connected to hook portions 525, 526. Cap 610 may be connected to hook portions 525, 526 of seal-retaining projections 508C, 510C by locating cap 610 outwardly of connection 550C and then pressing cap inwardly toward outer surfaces 531B_C of panels 530A_C, 530B_C. Connecting cap 610 to hook portions 525, 526 may involve deformation of cap 610 (e.g. hook portions 614, 616 may deform transversely as they contact the beveled surfaces provided by hook projections 525", 526"). Restorative deformation forces associated with this deformation may partially or fully restore cap 610 to its non-deformed state when the connection is made to thereby provide "snap-together" connection between cap 610 and hook portions 525, 526 of seal-retaining projections 508C, 510C.

Cap 610 may be connected to hook portions 525, 526 of seal-retaining projections 508C, 510C after the insertion of seal 514C into seal-receiving concavity 512C. In some embodiments, cap 610 may deform seal 514C when cap 610 is connected to hook portions 525, 526. Such deformation of seal 514C may further improve the bonding and/or restorative deformation force that seal exerts against corresponding outer surfaces 531B_C of panels 530A_C, 530B_C, seal-retaining projections 508C, 510C and/or other surfaces to improve the sealing effect of seal 514C. Caps 610 may also protect and maintain seal 514C once seal 514C is inserted into seal-receiving concavity 512C.

In the illustrated embodiment, hook portions 525, 526 of seal-retaining projections 508C, 510C are provided transversely outside of seal-receiving concavity 512C. This is not necessary. In some embodiments, hook portions 525, 526 of seal-retaining projections 508C, 510C may be located within seal-receiving concavity 512C.

Hook portions like hook portions 525, 526 of panels 530A_C, 530B_C and hook portions 614, 616 of cap 610 are not limited to the embodiment shown in FIG. 20C. Any of the other panel-retaining projections described herein (e.g. in any of FIGS. 19A-19D and/or 20A, 20B, 20D, 20E) may be provided with hook portions similar to hook portions 525, 526 for connecting to corresponding hook portion of caps similar to caps 610. Any of the other forms described herein may comprise caps similar to caps 610.

In some embodiments, hook-portions 525, 526 of panels 530A_C, 530B_C and hook portions 614, 616 of cap 610 may be replaced with other additional or alternative types of connector components on panels 530A_C, 530B_C and complementary connector components on cap 610. Such complementary connector components on panels 530A_C, 530B_C and cap 610 may generally comprise any suitable type of connector components. In some embodiments, such complementary connector components on panels 530A_C, 530B_C and cap 610 may be deformed during connection therebetween, such that restorative deformation forces associated with this deformation may partially or fully restore the connector components to their non-deformed states when the connection is made to thereby provide "snap-together" connection between panels 530A_C, 530B_C and cap 610. Any of the other panel-retaining projections described herein (e.g. in any of FIGS. 19A-19D and/or 20A, 20B, 20D, 20E) may be provided with suitable connector components for connecting to complementary connector components on caps 610. Any of the other forms described herein may comprise caps similar to caps 610 with connector components suitable for making connections with complementary connector components on such panels.

The embodiments of FIGS. 20A-20E comprise seals 514A-514E which have different shapes than seals 514 described above. Apart from their shapes and any other features of seals 514A-514E described above with reference to FIGS. 20A-20E, seals 514A-514E may comprise features similar to those of seals 514 described herein. By way of non-limiting example, seals 514A-514E may be fabricated from materials similar to seals 514, may bond or be forced against surfaces of panels in a manner similar to seals 514 may be inserted into seal-receiving concavities in a manner similar to seals 514 and/or the like.

FIGS. 19A-19G and 20A-20E show seal-retaining projections, seal-receiving concavities, seals and caps (in the case of FIG. 20C). Seal-retaining projections, seal-receiving concavities, seals and caps of any of the embodiments shown in FIGS. 19A-19G and 20A-20E could be incorporated into other panels with other connector components which form connections between edge-adjacent panels. By way of non-limiting example, any of the panels described in FIGS. 1-18 or any other form-work panels suitable for panel-to-panel connection (e.g those panels described in WO/2013/075251 and/or WO/2013/102274), which are hereby incorporated herein by reference) could be provided with seal-retaining projections comprising any of the features of the seal-retaining projections described herein to provide seal-receiving concavities comprising any of the features described herein which accommodate seals comprising any of the features described herein. Any of the forms described in FIGS. 1-18 or any other forms comprising panel-to-panel connection (e.g those forms described in WO/2013/075251 and/or WO/2013/102274) could comprise caps similar to caps 610 described herein to enclose their corresponding seals.

Figure 10:
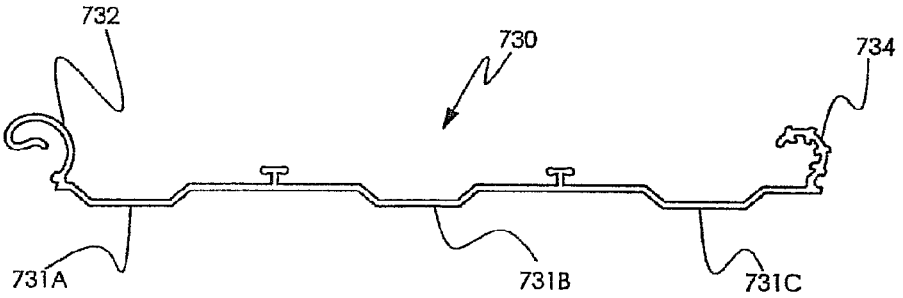
FIG. 10 is a plan view of a corrugated panel according to another embodiment of the invention.

Panels 530, 530A-530E and corresponding forms may comprise or be modified to comprise any of the features and/or modifications described herein for panels 130, 1130 and forms comprising panels 130, 1130. FIGS. 19A-19G and 20A-20E only show panels on one side of their corresponding forms and do not show support members or tensioning members. It will be appreciated that panels 530, 530A-530E could be used to provide two-sided forms with support members but without tensioning members (e.g. similar to form 128 (FIG. 3) and/or form 1128 (FIG. 11)), two-sided forms with support members and tensioning members (e.g. similar to form 228 (FIG. 4) and/or form 1228 (FIG. 12)), one-sided forms (e.g. similar to forms 328 (FIG. 5A), 428 (FIG. 5B) and/or 1328 (FIG. 13)) and/or the like. Further, panels 530, 530A-530E could be combined with suitable corner panels similar to corner panels 190, 192 (FIGS. 9A, 9B) and/or corner panels 1190, 1192 (FIGS. 17A, 17B) to provide forms similar to form 194 (FIG. 9C), form 1194 (FIG. 17C) and/or the like. Panels 530, 530A-530E (or panels 530, 530A-530E modified by suitable curvature) may also be used to provide columnar or curved forms (e.g. similar to form 1828 (FIG. 18A), form 1928 (FIG. 18B) and/or the like). Panels 530, 530A-530E can also be modified to provide transverse modularity (e.g. similar to the modularity of panels 130A-130D (FIGS. 8A-8D), panels 1130A-1130C (FIGS. 19A-19C) and/or the like). Panels 530, 530A-530E could also be modified to provide corrugated profiles similar to that of panel 730 (FIG. 10). For brevity, these various embodiments, uses and modifications of panels 530, 530A-530E and forms incorporating such panels are not described in detail herein, it being appreciated that these embodiments, uses and modifications can be As will be apparent to those skilled in the art in the light of the foregoing disclosure, many alterations and modifications are possible in the practice of this invention without departing from the spirit or scope thereof. For example:

Any of the connector components described herein can be used in conjunction with any of the forms described herein.

Forms 328, 428, 1328 described above comprise support members 136, 1136 which are substantially similar to support members 136, 1136 of forms 128, 228, 1128, 1228. In general, this is not necessary, as support members 136, 1136 of forms 328, 428, 1328 need not extend through the other side of a wall. In general, forms 328, 428, 1328 use support members 136, 1136 to anchor forms 328, 428, 1328 into the concrete. Accordingly, to reduce the amount of material used to make forms 328, 428, 1328 support members 136, 1136 may be made smaller in the inward-outward direction. By way of non-limiting example, support members 136, 1136 may extend only up to connector components 143,1143 in the inward-outward direction 15. As discussed above, forms 328, 428, 1328 may use any of the anchor components described in the Structure-Lining PCT Application.

Tilt-up forms 328, 428, 1328 may be modified to include lifting components similar to any of those described in the Structure-Lining PCT Application.

In some embodiments, it may be desirable to provide walls which incorporate insulation. Insulation 86 may be provided in the form of rigid foam insulation. Non-limiting examples of suitable materials for rigid foam insulation include: expanded poly-styrene, polyurethane, poly-isocyanurate or any other suitable moisture resistant material. By way of non-limiting example, insulation layers may be provided in any of the forms described herein. Such insulation layers may extend in the longitudinal direction and in the transverse direction. Such insulation layers may be located centrally within the wall (e.g. between adjacent connector components 143 (see FIG. 3, for example)) or at one side of the wall (e.g. between connector components 143 and one of wall segments 127, 129, 227, 229, 327, 427). It will be appreciated that when fabricating walls using two-sided forms (e.g. 128, 228), such insulation may be added before the liquid concrete is poured into the form, but when fabricating tilt-up walls with one-sided forms (e.g. forms 328, 428, 1328), concrete and insulation may be layered as required on the generally horizontal table.

In the embodiments described herein, the structural material used to fabricate the wall segments is concrete. This is not necessary. In some applications, it may be desirable to use other structural materials which may be initially be poured or otherwise placed into forms and may subsequently solidify or cure.

In the embodiments describes herein, the outward facing surfaces 131B, 531B, 1131B of some panels (e.g. panels 130, 530, 1130) are substantially flat. In other embodiments, panels 130, 1130 may be provided with corrugations in the inward-outward direction. Such corrugations may extend longitudinally and/or transversely. As is known in the art, such corrugations may help to prevent pillowing. FIG. 10 shows a wall panel 730 according to yet another embodiment of the invention. Wall panel 730 comprises connector components 732, 734, which are substantially similar to connector components 132, 134 described above. Although wall panel 730 extends generally transversely between connector components 732, 734, wall panel 730 incorporates corrugations 731A, 731B, 731C in the inward-outward direction. Corrugations 731A, 731B, 731C extend longitudinally and transversely.

In the embodiments described above, the various features of panels 130, 530 1130 (e.g. connector components 132, 134, 532, 534, 1132, 1314), support members 136, 1136 (e.g. connector components 142, 1142) and tensioning members 140, 1140 (e.g. connector components 141A, 1141A) are substantially co-extensive with panels 130, 530, 1130, support members 136, 1136 and tensioning members 140, 1140 in the longitudinal dimension. This is not necessary. In some embodiments, such features may be located at various locations on the longitudinal dimension of panels 130, 530, 1130, support members 136, 1136 and tensioning members 140, 1140 and may be absent at other locations on the longitudinal dimension 19 of panels 130, 530, 1130, support members 136, 1136 and tensioning members 140, 1140. Forms incorporating any of the other wall panels described herein may comprise similarly dimensioned support members and/or tensioning members.

In some embodiments, sound-proofing materials may be layered into the form-works described above or may be connected to attachment units.

In some embodiments, the forms described herein may be used to fabricate walls, ceilings or floors of buildings or similar structures. In general, the forms described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams and the like.

FIGS. 18A and 18B show columns fabricated from panels 1130. Forms incorporating any of the other panels described herein may be used to fabricate columns according to other embodiments of the invention. Columns may be formed (like FIG. 18A) such that only an outer surface of the column is coated by panels having connector components of the type described herein. Columns may also be formed (like FIG. 18B) to have inside and outside surfaces coated by panels having connector components of the type described herein—i.e. such that the columns have a bore in the center which may be hollow or which contain other materials. Such columns may generally have any cross-section, such as rectangular, polygonal, circular or elliptical, for example. Columns may be reinforced with traditional reinforcement bars or with suitably modified support members.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

In addition or in the alternative to the co-extruded coating materials and/or surface texturing described above, materials (e.g. sealants and the like) may be provided at various interfaces between the connector components described above to improve the impermeability of the resulting connections to liquids and/or gasses. By way of non-limiting example, receptacle 154 of connector component 132 and receptacle 174 of connector component 134 may contain suitable sealants or the like for providing seals with prong 164 (which projects into receptacle 154) and protrusion 158 (which projects into receptacle 174). A bead or coating layer of sealing material may be provided: on distal end 1156A' of arm 1156A; in concavity 1171B; on secondary protrusion 1169A; in secondary recess 1159A; on thumb 1173; in secondary recess 1167; on thumb 1163; and/or in concavity 1171A.

The description set out above makes use of a number of directional terms (e.g. inward-outward direction 15, transverse direction 17 and longitudinal direction 19). These directional terms are used for ease of explanation and for explaining relative directions. In some embodiments, the longitudinal direction 19 may be generally vertical and the transverse and inward-outward directions 17, 15 may be generally horizontal, but this is not necessary. Walls and other structures fabricated from the forms described herein need not be vertically and/or horizontally oriented like those described above. In some circumstances, components of the forms described herein may be assembled in orientations different from those in which they are ultimately used to accept concrete. However, for ease of explanation, directional terms are used in the description to describe the assembly of these form components. Accordingly, the directional terms used herein should not be understood in a literal sense but rather in a sense used to facilitate explanation and/or directions relative to one another.

In some embodiments, contacting surfaces of hook portions 525,526 of seal-retaining projections 508C, 510C and/or contacting surfaces of hook portions 614, 616 of cap 610 could be provided with suitable sealant material (similar to any of the seals described herein) which may be co-extruded and which may used to provide a further sealing effect.

Many embodiments and variations are described above. Those skilled in the art will appreciate that various aspects of any of the above-described embodiments may be incorporated into any of the other ones of the above-described embodiments by suitable modification.

While a number of exemplary aspects and embodiments have been discussed above, those of skill in the art will recognize certain modifications, permutations, additions and sub-combinations thereof. It is therefore intended that the following appended aspects or claims and aspects or claims hereafter introduced are interpreted to include all such modifications, permutations, additions and sub-combinations.

What is claimed is:

1. A stay-in-place form for casting structures from concrete or other curable construction materials, the form comprising:

a plurality of elongated panels connectable to one another in edge-to-edge relationship to provide at least a portion of the form, each panel comprising longitudinally extending inward facing and outward facing surfaces that also extend transversely between pairs of opposing transverse edges;

the plurality of panels comprising first and second panels connectable to one another in edge-adjacent relationship by a connection between a first connector component of the first panel and a second connector component of the second panel, the connection comprising a contact joint between the first and second connector components;

the first panel comprising a first seal-retaining thumb shaped to project from the inward-facing surface of the first panel;

the second panel comprising a second seal-retaining thumb shaped to project from the inward-facing surface of the second panel; and an inner seal having an inner portion in contact with an inward-facing surface of the second thumb, a first transverse portion in contact with a first transverse-facing surface of the second thumb and a second transverse portion in contact with a second transverse-facing surface of the second thumb; wherein:

the inner portion of the inner seal contacts at least an outwardly-facing surface of the first thumb when the connection is made; and the first and second connector components are deformable to permit relative transverse movement between the first and second thumbs when the connection is made between: a first configuration where the second thumb is located in a first transverse location relative to the first thumb and where the first transverse portion of the inner seal is in contact with the first thumb and a second configuration where the second thumb is located in a second transverse location, different from the first transverse location, relative to the first thumb and where the second transverse portion of the inner seal is in contact with the first thumb.

2. A form according to claim 1 wherein the first configuration comprises the first transverse portion of the inner seal contacting a first transverse-facing surface of the first thumb and the second configuration comprises the second transverse portion of the inner seal contacting a second transverse-facing surface of the first thumb.

3. A form according to claim 1 wherein the first configuration comprises the first transverse portion of the inner seal contacting a first transverse-facing surface of the first thumb and the second transverse portion of the inner seal spaced apart from a second transverse-facing surface of the first thumb and the second configuration comprises the second transverse portion of the inner seal contacting the second transverse-facing surface of the first thumb and the first transverse portion of the inner seal spaced apart from the first transverse-facing surface of the first thumb.

4. A form according to claim 2 wherein at least a portion of the first thumb defines a recess.

5. A form according to claim 4 wherein the recess is defined at least in part by the first transverse-facing portion of the first thumb, the second transverse-facing surface of the first thumb and the outwardly-facing surface of the first thumb.

6. A form according to claim 1 wherein the first and second thumbs are spaced apart from one another by the inner seal when the connection is made.

7. A form according to claim 4 wherein at least a portion of the second thumb is received within at least a portion of the recess.

8. A form according to claim 1 wherein the first transverse-facing surface of the second thumb is planar and bevelled.

9. A form according to claim 1 wherein a portion of the first thumb spaced inwardly away from the inward-facing surface of the first panel is shaped to extend outwardly.

10. A form according to claim 4 wherein a transverse dimension of the recess is greater than a transverse dimension between the first and second transverse-facing surfaces of the second thumb.

11. A form according to claim 4 wherein a transverse dimension of the recess is greater than a transverse dimension between the opposing transverse-most surfaces of the first and second transverse portions of the inner seal.

12. A form according to claim 1 wherein an outermost extent of the inner seal is parallel to the outward facing surface of the second panel.

13. A form according to claim 1 wherein the inner seal is bonded to the second thumb.

14. A form according to claim 1 wherein the inner seal comprises a curable material.

15. A stay-in-place form for casting structures from concrete or other curable construction materials, the form comprising:

a plurality of elongated panels connectable to one another in edge-to-edge relationship to provide at least a portion of the form, each panel comprising longitudinally extending inward facing and outward facing surfaces that also extend transversely between pairs of opposing transverse edges;

the plurality of panels comprising first and second panels connectable to one another in edge-adjacent relationship by a connection between a first connector component of the first panel and a second connector component of the second panel, the connection comprising a contact joint between the first and second connector components;

the first panel comprising a first seal-retaining thumb shaped to project from the inward-facing surface of the first panel;

the second panel comprising a second seal-retaining thumb shaped to project from the inward-facing surface of the second panel; and an inner seal having an inner portion in contact with an outward-facing surface of the first thumb, a first transverse portion in contact with a first transverse-facing surface of the first thumb and a second transverse portion in contact with a second transverse-facing surface of the first thumb; wherein:

the inner portion of the inner seal contacts at least an inwardly-facing surface of the second thumb when the connection is made; and the first and second connector components are deformable to permit relative transverse movement between the first and second thumbs when the connection is made between: a first configuration where the second thumb is located in a first transverse location relative to the first thumb and where the first transverse portion of the inner seal is in contact with the second thumb and a second configuration where the second thumb is located in a second transverse location, different from the first transverse location, relative to the first thumb and where the second transverse portion of the inner seal is in contact with the second thumb.

16. A form according to claim 1, the first panel comprising a longitudinally extending first seal-retaining projection shaped to project outwardly from the outer surface of the first panel at a location spaced apart from a first outer-surface transverse edge of the first panel in a first transverse direction;

the second panel comprising a longitudinally extending second seal-retaining projection shaped to project outwardly from the outer surface of the second panel at a location spaced apart from a second outer-surface transverse edge of the second panel in a second transverse direction opposite the first transverse direction;

the first and second seal-retaining projections and the outer surfaces of the first and second panels defining at least a portion of a seal-receiving concavity which opens outwardly from the form when the connection is made.

17. A stay-in-place form for casting structures from concrete or other curable construction materials, the form comprising:

a plurality of elongated panels connectable to one another in edge-to-edge relationship to provide at least a portion of the form, each panel comprising a longitudinally extending outer surface that also extends transversely between a pair of opposing outer-surface transverse edges;

the plurality of panels comprising first and second panels connectable to one another in edge-adjacent relationship by a connection between a first connector component of the first panel and a second connector component of the second panel, the connection comprising a contact joint between the first and second connector components;

the first panel comprising a longitudinally extending first seal-retaining projection shaped to project outwardly from the outer surface of the first panel at a location spaced apart from a first outer-surface transverse edge of the first panel in a first transverse direction;

the second panel comprising a longitudinally extending second seal-retaining projection shaped to project outwardly from the outer surface of the second panel at a location spaced apart from a second outer-surface transverse edge of the second panel in a second transverse direction opposite the first transverse direction;

the first and second seal-retaining projections and the outer surfaces of the first and second panels defining at least a portion of a seal-receiving concavity which opens outwardly from the form when the connection is made.

18. A form according to claim 17 wherein a portion of the first seal-retaining projection is shaped to extend transversely toward the first outer-surface transverse edge.

19. A form according to claim 18 wherein the portion of the first seal-retaining projection is shaped to extend both transversely toward the first outer-surface transverse edge and outwardly from the outer surface of the first panel.

20. A form according to claim 18 wherein the portion of the first seal-retaining projection is shaped to extend transversely toward the first outer-surface transverse edge at a location spaced outwardly apart from the outer surface of the first panel.

21. A form according to claim 17 wherein a portion of the first seal-retaining projection is shaped to extend transversely away from the first outer-surface transverse edge.

22. A form according to claim 17 wherein a first portion of the first seal-retaining projection is shaped to extend transversely away from the first outer-surface transverse edge and a second portion of the first seal-retaining projection is shaped to extend transversely toward the first outer-surface transverse edge, the first portion of the first seal-retaining projection located relatively closer to the outer surface of the first panel than the second portion of the first seal-retaining projection.

23. A form according to claim 17 wherein the first seal-retaining projection comprises a first hook portion at a location spaced apart from the outer surface of the first panel, the first hook portion shaped to define a first hook concavity that opens toward the outer surface of the first panel and wherein the second seal-retaining projection comprises a second hook portion at a location spaced apart from the outer surface of the second panel, the second hook portion shaped to define a second hook concavity that opens toward the outer surface of the second panel.

24. A form according to claim 23 wherein the first hook portion comprises a first beveled surface that extends both toward the outer surface of the first panel and transversely away from the first outer-surface transverse edge and the second hook portion comprises a second beveled surface that extends both toward the outer surface of the second panel and transversely away from the second outer-surface transverse edge.

25. A form according to claim 17 wherein, when the connection is made, the first and second seal-retaining projections extend toward one another as they extend outwardly from the outer surfaces of the first and second panels respectively.

26. A form according to claim 17 wherein, when the connection is made, an outermost opening of the seal-receiving concavity has a transverse dimension that is smaller than a transverse dimension of the seal-receiving concavity at an interior of the seal-receiving concavity, the interior of the seal-receiving concavity closer to the outer surfaces of the first and second panels.

27. A form according to claim 17 wherein the first seal-retaining projection is shaped to provide, together with the outer surface of the first panel, a first transversely-opening secondary seal-receiving concavity, the first transversely-opening secondary seal-receiving concavity opening toward the second seal-retaining projection when the connection is made and wherein the second seal-retaining projection is shaped to provide, together with the outer surface of the second panel, a second transversely-opening secondary seal-receiving concavity, the second transversely-opening secondary seal-receiving concavity opening toward the first seal-retaining projection when the connection is made.

28. A form according to claim 17 comprising a flexible seal located in the seal-receiving concavity.

29. A form according to claim 28 wherein: the seal is bonded on the first transverse side of the first outer-surface transverse edge to at least one of the outer surface of the first panel and a surface of the first seal-retaining projection; and on the second transverse side of the second outer-surface transverse edge to at least one of the outer surface of the second panel and a surface of the second seal-retaining projection.

30. A form according to claim 28 wherein the seal comprises a curable material.

31. A form according to claim 28 wherein the seal is sized to be deformed by location of the seal in the seal-receiving concavity and wherein the deformed seal is sized to exert restorative deformation forces, on the first transverse side of the first outer-surface transverse edge, against at least one of the outer surface of the first panel and a surface of the first seal-retaining projection; and, on the second transverse side of the second outer-surface transverse edge, against at least one of the outer surface of the second panel and a surface of the second seal-retaining projection.

32. A form according to claim 23 comprising a cap, the cap comprising first and second complementary hook portions for connecting to the first and second hook portions and, when so connected, the cap covering the outwardly opening seal-receiving concavity.

33. A method for casting structures from concrete or other curable materials using a stay-in-place form, the method comprising:

connecting pairs of panels, each panel comprising longitudinally extending inward facing and outward facing surfaces that also extend transversely between pairs of transverse edges, to one another in edge-adjacent relationship to provide a form, connecting pairs of panels comprising, for each connection between a first panel and a second panel:

forming a contact joint between a first connector component of the first panel and a second connector component of the second pane;

providing a first seal-retaining thumb shaped to project from the inward-facing surface of the first panel;

providing a second seal-retaining thumb shaped to project from the inward-facing surface of the second panel; and contacting an inner seal with the second thumb, contacting the inner seal comprising: contacting an inner portion of the inners seal with an inward-facing surface of the second thumb, contacting a first transverse portion of the inner seal with a first transverse-facing surface of the of the second thumb and contacting a second transverse portion of the inner seal with a second transverse-facing surface of the second thumb;

contacting the inner portion of the inner seal with at least an outwardly-facing surface of the first thumb when the connection is made; and permitting deformation of the first and second connector components thereby to permit relative transverse movement between the first and second thumbs when the connection is made between: a first configuration where the second thumb is located in a first transverse location relative to the first thumb and where the first transverse portion of the inner seal is in contact with the first thumb and a second configuration where the second thumb is located in a second transverse location, different from the first transverse location, relative to the first thumb and where the second transverse portion of the inner seal is in contact with the first thumb.

* * * * *